US006138638A

United States Patent [19]

Morikawa

[11] Patent Number: 6,138,638

[45] Date of Patent: Oct. 31, 2000

[54] SYSTEM FOR DIAGNOSING AND CONTROLLING HIGH-PRESSURE FUEL SYSTEM FOR IN-CYLINDER FUEL INJECTION ENGINE

[75] Inventor: Koji Morikawa, Higashikurume, Japan

[73] Assignee: Fuji Jukogyo Kabushiki Kaisha, Tokyo-To, Japan

[21] Appl. No.: 09/144,980

[22] Filed: Sep. 1, 1998

[30] Foreign Application Priority Data

Sep. 3, 1997 [JP] Japan ..... 9-238547

[51] Int. Cl.[7] ..... F02D 41/22

[52] U.S. Cl. ..... 123/295; 123/305; 123/690; 123/479

[58] Field of Search ..... 123/305, 690, 123/479, 295; 73/119 A, 117.3

[56] References Cited

U.S. PATENT DOCUMENTS 5,241,933 9/1993 Morikawa ..... 123/198 D

FOREIGN PATENT DOCUMENTS 9-32617 2/1997 Japan .

*Primary Examiner*—Andrew M. Dolinar
*Attorney, Agent, or Firm*—Smith, Gambrell & Russell, LLP

[57] ABSTRACT

A system for controlling an in-cylinder fuel injection engine determines that a high-pressure fuel system is abnormal, when meeting at least one of conditions that the fuel pressure Pf of the high-pressure fuel system does not reach a preset pressure PFS (S24) even if a predetermined period of time elapses after the engine start-up (S22), that the fuel pressure Pf of the high-pressure fuel system is not within an ordinary fuel pressure range defined by the lower limit PFL and the upper limit PFH after the engine start-up (S27, S28), and that the fuel injection pulse width Ti continues to exceed the upper limit TiNGMAX, which can not usually be obtained, for a predetermined period of time at a lean air-fuel ratio (S30~S33). Thus, the abnormality of the high-pressure fuel system of the in-cylinder fuel injection engine can be accurately diagnosed.

15 Claims, 24 Drawing Sheets

STROKE

| | | | | | |
|---|---|---|---|---|---|
| #1 | COMPRESSION | COMBUSTION | EXHAUST | INTAKE | COMPRESSION |
| #3 | INTAKE | COMPRESSION | COMBUSTION | EXHAUST | INTAKE |
| #2 | EXHAUST | INTAKE | COMPRESSION | COMBUSTION | EXHAUST |
| #4 | COMBUSTION | EXHAUST | INTAKE | COMPRESSION | COMBUSTION |

→ TIME

STROKE

| | | | | | |
|---|---|---|---|---|---|
| #1 | COMPRESSION | COMBUSTION | EXHAUST | INTAKE | COMPRESSION |
| #3 | INTAKE | COMPRESSION | COMBUSTION | EXHAUST | INTAKE |
| #2 | EXHAUST | INTAKE | COMPRESSION | COMBUSTION | EXHAUST |
| #4 | COMBUSTION | EXHAUST | INTAKE | COMPRESSION | COMBUSTION |

→ TIME

SYSTEM FOR DIAGNOSING AND CONTROLLING HIGH-PRESSURE FUEL SYSTEM FOR IN-CYLINDER FUEL INJECTION ENGINE

BACKGROUND OF THE INVENTION

The present invention relates generally to a system for diagnosing and controlling a high-pressure fuel system for an in-cylinder fuel injection engine. More specifically, the invention relates to a system for diagnosing the abnormality of a high-pressure fuel system of an in-cylinder fuel injection engine, and a control system capable of coping with the abnormality of the high-pressure fuel system of the in-cylinder fuel injection engine.

Conventionally, there has been known an in-cylinder fuel injection engine for injecting a fuel directly into a cylinder (a combustion chamber) to ignite and burn the injected fuel by means of a spark plug, in order to improve fuel consumption, engine output and exhaust emission.

As disclosed in Japanese Patent Laid-Open No. 2-169834 or 8-177699, an in-cylinder fuel injection engine of this type must maintain a fuel pressure fed to an injector to be a high pressure in order to inject the fuel directly into a cylinder against the cylinder pressure, so that the fuel is fed from a fuel tank to a high pressure pump by means of a low pressure pump (a feed pump) to raise the pressure of the fuel by means of the high pressure pump to feed a high pressure fuel to the injector.

That is, the high pressure pump does not have a sufficient fuel self-priming power, so that a low pressure pump, such as an electric feed pump, is provided upstream of the high pressure pump to feed the fuel from the fuel tank to the high pressure pump by means of the low pressure pump.

In addition, in order to stably feed the fuel to the high pressure pump, the low pressure pump has a discharge capacity which is the same as or more than the maximum discharge capacity of the high pressure pump, and a low pressure regulator is provided for regulating the fuel pressure fed from the low pressure pump to a predetermined fuel pressure to feed the pressure regulated fuel to the high pressure pump.

Moreover, in an in-cylinder fuel injection engine of this type, a fuel injection pulse width defining the fuel injection quantity is set on the basis of the engine operating condition, and a drive signal indicative of the fuel injection pulse width is outputted to an injector to obtain a desired fuel injection quantity by the injection-valve opening period of the injector based on the fuel injection pulse width. Therefore, the fuel pressure of the high-pressure fuel system for feeding the fuel from the high pressure pump to the injector must be held at a predetermined fuel pressure. For that reason, the pressure of the fuel raised by the high pressure pump is regulated to a predetermined controlled fuel pressure by means of a high pressure regulator, and a high pressure fuel of the controlled fuel pressure is fed to the injector.

However, if something is wrong with the high pressure pump or high pressure regulator, which form the high-pressure fuel system, or if the fuel leaks out of the high-pressure fuel system, the fuel pressure of the high pressure fuel fed to the injector can not be maintained to the predetermined controlled fuel pressure, so that the controllability of fuel injection deteriorates. In addition, if the injector has abnormality, such as defective injection-valve opening, a desired fuel injection quantity can not be obtained, so that the controllability of fuel injection deteriorates.

Then, if the degree of the abnormality of the high-pressure fuel system increases, the controllability of fuel injection more deteriorates, so that the engine combustion state deteriorates. If the degree of the abnormality remarkably increases, the engine may be inoperable or damaged.

SUMMARY OF THE INVENTION

It is therefore an object of the present invention to eliminate the aforementioned problems and to provide a system for diagnosing a high-pressure fuel system for an in-cylinder fuel injection engine, which can accurately diagnose the abnormality of a high-pressure fuel system of an in-cylinder fuel injection engine.

It is another object of the present invention to provide a system for controlling an in-cylinder fuel injection engine, which can carry out the fail safe when the high-pressure fuel system is abnormal.

In order to accomplish the aforementioned and other objects, according to a first aspect of the present invention, there is provided a system for diagnosing a high-pressure fuel system for an in-cylinder fuel injection engine wherein the pressure of a fuel is raised by a high pressure pump to feed a high pressure fuel to an injector for injecting the high pressure fuel directly into a cylinder, the diagnosing system comprising: as shown in the basic block diagram of FIG. 1(*a*), diagnosing means for monitoring at least one of the behavior of a fuel pressure of a high-pressure fuel system and the relationship between an air-fuel ratio and a fuel injection pulse width for an injector, the diagnosing means determining that the high-pressure fuel system is abnormal to inform of the abnormality of the high-pressure fuel system when meeting at least one of conditions that the behavior of the fuel pressure is abnormal and that the air-fuel ratio is incompatible with the fuel injection pulse width.

This diagnosing system monitors at least one of the behavior of the fuel pressure of the high-pressure fuel system of the in-cylinder fuel injection engine and the relationship between the air-fuel ratio and the fuel injection pulse width for the injector. When meeting at least one of conditions that the behavior of the fuel pressure is abnormal and that the air-fuel ratio is incompatible with the fuel injection pulse width, the diagnosing system determines that the high-pressure fuel system is abnormal and informs of the abnormality of the high-pressure fuel system.

According to this diagnosing system, at least one of the behavior of the fuel pressure of the high-pressure fuel system of the in-cylinder fuel injection engine and the relationship between the air-fuel ratio and the fuel injection pulse width for the injector is monitored. When meeting at least one of conditions that the behavior of the fuel pressure is abnormal and that the air-fuel ratio is incompatible with the fuel injection pulse width, it is determined that the high-pressure fuel system is abnormal. Therefore, when the high-pressure fuel is abnormal, e.g., when the high pressure pump or high pressure regulator forming the high-pressure fuel system is abnormal, or when the fuel leaks from the high-pressure fuel system, or when the injector is abnormal, it is possible to accurately diagnose the abnormality of the high-pressure fuel system.

In addition, since this diagnosing system informs of the abnormality of the high-pressure fuel system when it is determined that the high-pressure fuel system is abnormal, it is possible to prevent the abnormality of the high-pressure fuel system from deteriorating the exhaust emission and from having a bad influence on the engine.

According to a second aspect of the present invention, there is provided a system for controlling an in-cylinder fuel injection engine, wherein a low pressure fuel fed from a low pressure pump is regulated to a predetermined fuel pressure by a low pressure regulator to be fed to a high pressure pump, the pressure of the fuel being raised by the high pressure pump and regulated to a predetermined controlled fuel pressure by a high pressure regulator to feed a high pressure fuel to an injector, and wherein a fuel injection quantity is set on the basis of an engine operating condition, the fuel injection quantity of the fuel being injected directly into a cylinder by the injector, the control system comprising: as shown in the basic block diagram of FIG. 1(*b*), opening/closing valve means provided in a fuel by-pass passage provided for by-passing the high pressure regulator to establish a communication between a high-pressure fuel system and a low-pressure fuel system; diagnosing means for monitoring at least one of the behavior of a fuel pressure of the high-pressure fuel system and the relationship between an air-fuel ratio and a fuel injection pulse width for the injector, the diagnosing means determining that the high-pressure fuel system is abnormal when meeting at least one of conditions that the behavior of the fuel pressure is abnormal and that the air-fuel ratio is incompatible with the fuel injection pulse width; opening/closing valve control means for closing the opening/closing valve means when the high-pressure fuel system is normal and for opening the opening/closing valve means when the high-pressure fuel system is abnormal; and fuel injection control means for setting a fuel injection pulse width defining a fuel injection quantity for the injector on the basis of the engine operating condition in accordance with the controlled fuel pressure regulated by the high pressure regulator when the high-pressure fuel system is normal, the fuel injection control means setting the fuel injection pulse width on the basis of the engine operating condition in accordance with the pressure of a low pressure fuel regulated by the low pressure regulator when the high-pressure fuel system is abnormal.

This control system monitors at least one of the behavior of the fuel pressure of the high-pressure fuel system of the in-cylinder fuel injection engine and the relationship between the air-fuel ratio and the fuel injection pulse width for the injector. When meeting at least one of conditions that the behavior of the fuel pressure is abnormal and that the air-fuel ratio is incompatible with the fuel injection pulse width, the control system determines that the high-pressure fuel system is abnormal. When the high-pressure fuel system is normal, the opening/closing valve means, which is provided in the fuel by-pass passage for by-passing the high pressure regulator to establish the communication between the high-pressure fuel system and the low-pressure fuel system, is closed to feed the high pressure fuel, the pressure of which has been raised by the high pressure pump and regulated to the predetermined controlled fuel pressure by the high pressure regulator, to the injector. At this time, the fuel injection pulse width defining the fuel injection quantity for the injector is set on the basis of the engine operating condition in accordance with the controlled fuel pressure regulated by the high pressure regulator. On the other hand, when the high-pressure fuel system is abnormal, the opening/closing valve means is open to feed the low pressure fuel, which has been fed by the low pressure pump to be regulated to the predetermined fuel pressure by the low pressure regulator, directly to the high-pressure fuel system to feed the low pressure fuel to the injector. Then, the fuel injection pulse width is set on the basis of the engine operating condition in accordance with the pressure of the low pressure fuel regulated by the low pressure regulator.

According to this control system, at least one of the behavior of the fuel pressure of the high-pressure fuel system of the in-cylinder fuel injection engine and the relationship between the air-fuel ratio and the fuel injection pulse width for the injector is monitored. When meeting at least one of conditions that the behavior of the fuel pressure is abnormal and that the air-fuel ratio is incompatible with the fuel injection pulse width, it is determined that the high-pressure fuel system is abnormal. Therefore, when the high-pressure fuel is abnormal, e.g., when the high pressure pump or high pressure regulator forming the high-pressure fuel system is abnormal, or when the fuel leaks from the high-pressure fuel system, or when the injector is abnormal, it is possible to accurately diagnose the abnormality of the high-pressure fuel system.

Then, the diagnosis results for the high-pressure fuel system are reflected in the fuel injection control, and when the high-pressure fuel system is normal, the opening/closing valve means, which is provided in the fuel by-pass passage for by-passing the high pressure regulator to establish the communication between the high-pressure fuel system and the low-pressure fuel system, is closed, so that the high pressure fuel, the pressure of which has been raised by the high pressure pump and regulated to the predetermined controlled fuel pressure by the high pressure regulator, is fed to the injector. At this time, since the fuel injection pulse width defining the fuel injection quantity for the injector is set on the basis of the engine operating condition in accordance with the controlled fuel pressure regulated by the high pressure regulator, the pressure of the high pressure fuel fed to the injector is compatible with the fuel injection pulse width, so that an appropriate quantity of fuel corresponding to the required fuel injection quantity can be injected from the injector similar to conventional systems.

On the other hand, when the high-pressure fuel system is abnormal, the opening/closing valve means is open, so that the low pressure fuel, which has been fed by the low pressure pump and regulated to the predetermined fuel pressure by the low pressure regulator, is fed directly to the high-pressure fuel system to be fed to the injector, independent of the high pressure fuel fed by the high pressure pump and high pressure regulator forming the high-pressure fuel system. Then, the fuel injection pulse width is set on the basis of the engine operating condition in accordance with the pressure of the low pressure fuel regulated by the low pressure regulator. Therefore, the fuel injection pulse width for the injector is set so as to obtain a predetermined fuel injection quantity at the pressure of the low pressure fuel, and even if something is wrong with the high-pressure fuel system, the valve opening period of the injector can be controlled by the fuel injection pulse width so as to be coincident with the required fuel injection quantity, so that it is possible to inhibit the difference between the required fuel injection quantity and the fuel injection quantity actually injected from the injector to inhibit the deterioration of the controllability of fuel injection. Therefore, since the deterioration of the controllability of fuel injection can be inhibited even if something is wrong with the high-pressure fuel system, it is possible to prevent the engine from being damaged by the deterioration of the combustion state of the engine, so that the engine can continue to operate.

In addition, at this time, since the low pressure fuel is fed from the low-pressure fuel system to the high-pressure fuel system, the load of the high pressure pump due to the compression of the fuel can be decreased, and the high pressure regulator is in the inoperative state. Therefore, even if something is wrong with the high pressure pump or the high pressure regulator, it is possible to inhibit the degree of the abnormality of the high pressure pump or high pressure regulator from increasing to prevent fatal damage and so forth.

In addition, when the defective injection-valve opening occurs in the injector as the abnormality of the high-pressure fuel system, the low pressure fuel is fed to the injector. Therefore, the injection-valve opening load against the fuel pressure of the injector can be reduced, so that the controllability of fuel injection can be ensured to some extent. Also in this case, it is possible to inhibit the controllability of fuel injection from deteriorating.

Moreover, when the fuel leaks from the high-pressure fuel system as the abnormality of the high-pressure fuel system, the low pressure fuel is fed to the high-pressure fuel system to reduce the fuel pressure of the high-pressure fuel system, so that it is possible to inhibit the fuel from leaking from at least the high-pressure fuel system.

According to a third aspect of the present invention, there is provided a system for controlling an in-cylinder fuel injection engine, wherein a low pressure fuel fed from a low pressure pump is regulated to a predetermined fuel pressure by a low pressure regulator to be fed to a high pressure pump, the pressure of the fuel being raised by the high pressure pump and regulated by an electromagnetic high pressure regulator to feed a high pressure fuel to an injector, and wherein a fuel injection timing and a fuel injection quantity are set on the basis of an engine operating condition, the fuel injection quantity of the fuel being injected directly into a cylinder by the injector at the fuel injection timing, the control system comprising: as shown in the basic block diagram of FIG. 1(*c*), diagnosing means for connecting a downstream side of the electromagnetic high pressure regulator to a low-pressure fuel system and for monitoring at least one of the behavior of a fuel pressure of a high-pressure fuel system and the relationship between an air-fuel ratio and a fuel injection pulse width for the injector, the diagnosing means determining that the high-pressure fuel system is abnormal when meeting at least one of conditions that the behavior of the fuel pressure is abnormal and that the air-fuel ratio is incompatible with the fuel injection pulse width; high pressure regulator control means for setting a controlled variable for the electromagnetic high pressure regulator so as to obtain a predetermined controlled fuel pressure when the high-pressure fuel system is normal, the high pressure regulator control means setting a controlled variable so as to fully open the electromagnetic high pressure regulator when the high-pressure fuel system is abnormal; and fuel injection control means for setting a fuel injection pulse width defining a fuel injection quantity for the injector on the basis of the engine operating condition in accordance with the controlled fuel pressure regulated by the electromagnetic high pressure regulator when the high-pressure fuel system is normal, the fuel injection control means setting a fuel injection pulse width on the basis of the engine operating condition in accordance with the pressure of a low pressure fuel regulated by the low pressure regulator when the high-pressure fuel system is abnormal.

This control system uses the electromagnetic high pressure regulator as the high pressure regulator, and the downstream side of the electromagnetic high pressure regulator is connected to the low-pressure fuel system. The control system monitors at least one of the behavior of the fuel pressure of the high-pressure fuel system of the in-cylinder fuel injection engine and the relationship between the air-fuel ratio and the fuel injection pulse width for the injector. When meeting at least one of conditions that the behavior of the fuel pressure is abnormal and that the air-fuel ratio is incompatible with the fuel injection pulse width, it is determined that the high-pressure fuel system is abnormal. When the high-pressure fuel system is normal, the controlled variable is set for the electromagnetic high pressure regulator so as to obtain the predetermined controlled fuel pressure, and the high pressure fuel, the pressure of which has been raised by the high pressure pump to be regulated to the predetermined controlled fuel pressure by the electromagnetic high pressure regulator, is fed to the injector. At this time, the fuel injection pulse width defining the fuel injection quantity for the injector is set on the basis of the engine operating condition in accordance with the controlled fuel pressure regulated by the electromagnetic high pressure regulator. On the other hand, when the high-pressure fuel system is abnormal, the electromagnetic high pressure regulator is fully open, so that the low pressure fuel fed by the low pressure pump to be regulated to the predetermined fuel pressure by the low pressure regulator is fed directly to the high-pressure fuel system to be fed to the injector. Then, the fuel injection pulse width is set on the basis of the engine operating condition in accordance with the pressure of the low pressure fuel regulated by the low pressure regulator.

According to this control system, at least one of the behavior of the fuel pressure of the high-pressure fuel system of the in-cylinder fuel injection engine and the relationship between the air-fuel ratio and the fuel injection pulse width for the injector is monitored. When meeting at least one of conditions that the behavior of the fuel pressure is abnormal and that the air-fuel ratio is incompatible with the fuel injection pulse width, it is determined that the high-pressure fuel system is abnormal. Therefore, when the high-pressure fuel is abnormal, e.g., when the high pressure pump or high pressure regulator forming the high-pressure fuel system is abnormal, or when the fuel leaks from the high-pressure fuel system, or when the injector is abnormal, it is possible to accurately diagnose the abnormality of the high-pressure fuel system.

In addition, this control system uses the electromagnetic high pressure regulator as the high pressure regulator, and the downstream side of the electromagnetic high pressure regulator is connected to the low-pressure fuel system. The diagnosed results for the high-pressure fuel system are reflected in the fuel injection control, and when the high-pressure fuel system is normal, the controlled variable is set for the electromagnetic high pressure regulator so as to obtain the predetermined controlled fuel pressure, and the high pressure fuel, the pressure of which has been raised by the high pressure pump and regulated to the predetermined controlled fuel pressure by the electromagnetic high pressure regulator, is fed to the injector. At this time, the fuel injection pulse width defining the fuel injection quantity for the injector is set on the basis of the engine operating condition in accordance with the controlled fuel pressure regulated by the electromagnetic high pressure regulator. Therefore, the pressure of the high pressure fuel fed to the injector is compatible with the fuel injection pulse width, so that an appropriate quantity of fuel corresponding to the required fuel injection quantity can be injected from the injector similar to conventional systems.

On the other hand, when the high-pressure fuel system is abnormal, the electromagnetic high pressure regulator is fully open, so that the low pressure fuel fed by the low pressure pump to be regulated to the predetermined fuel pressure by the low pressure regulator is fed directly to the high-pressure fuel system to be fed to the injector, independent of the high pressure fuel. Then, the fuel injection pulse width is set on the basis of the engine operating condition in accordance with the pressure of the low pressure fuel regulated by the low pressure regulator. Therefore, the fuel injection pulse width for the injector is set so as to obtain a predetermined fuel injection quantity at the pressure of the low pressure fuel, and even if something is wrong with the high-pressure fuel system, the valve opening period of the injector can be controlled by the fuel injection pulse width so as to be coincident with the required fuel injection quantity, so that it is possible to inhibit the difference between the required fuel injection quantity and the fuel injection quantity actually injected from the injector to inhibit the deterioration of the controllability of fuel injection. Therefore, since the deterioration of the controllability of fuel injection can be inhibited even if something is wrong with the high-pressure fuel system, it is possible to prevent the engine from being damaged by the deterioration of the combustion state of the engine, so that the engine can continue to operate.

In addition, at this time, since the low pressure fuel is fed from the low-pressure fuel system to the high-pressure fuel system, the load of the high pressure pump due to the compression of the fuel can be decreased, and the electromagnetic high-pressure regulator is substantially in the inoperative state. Therefore, even if something is wrong with the high pressure pump or the electromagnetic high-pressure regulator, it is possible to inhibit the degree of the abnormality of the high pressure pump or high pressure regulator from increasing to prevent fatal damage and so forth.

In addition, when the defective injection-valve opening occurs in the injector as the abnormality of the high-pressure fuel system, the low pressure fuel is fed to the injector. Therefore, the injection-valve opening load against the fuel pressure of the injector can be reduced, so that the controllability of fuel injection can be ensured to some extent. Also in this case, it is possible to inhibit the controllability of fuel injection from deteriorating.

Moreover, when the fuel leaks from the high-pressure fuel system as the abnormality of the high-pressure fuel system, the low pressure fuel is fed to the high-pressure fuel system to reduce the fuel pressure of the high-pressure fuel system, so that it is possible to inhibit the fuel from leaking from at least the high-pressure fuel system.

In addition, since the electromagnetic high-pressure regulator has both functions of the high pressure regulator and the opening/closing valve means according to the second aspect of the present invention, it is possible to dispense with the high pressure regulator and the opening/closing valve means according to the second aspect of the present invention. Therefore, it is possible to reduce the number of parts of the fuel feed system to simplify the construction of the fuel feed system in comparison with the control system according to the second aspect of the present invention.

According to a fourth aspect of the present invention, the control system may further comprise: a fuel pressure correction factor table which uses a fuel pressure in a practical use range of the high-pressure fuel system as a parameter for storing therein a fuel pressure correction factor for correcting the variation in fuel injection quantity based on the fuel pressure; and an abnormal period fuel pulse width table which uses an engine speed and an engine load as parameters for storing therein a fuel injection pulse width suited to obtain a required fuel injection quantity at the pressure of a low pressure fuel regulated by the low pressure regulator, wherein when the high-pressure fuel system is normal, the fuel injection control means sets a basic fuel injection quantity on the basis of the engine operating condition to set a basic fuel injection pulse width, which is used for obtaining the basic fuel injection quantity at a predetermined controlled fuel pressure regulated by the high-pressure regulator or the electromagnetic high-pressure regulator and which defines a basic valve opening period for the injector, on the basis of the basic fuel injection quantity, and the fuel injection control means makes reference to the fuel pressure correction factor table on the basis of the fuel pressure of the high-pressure fuel system to set a fuel pressure correction factor to correct the basic fuel injection pulse width by the fuel pressure correction factor to set a final fuel injection pulse width for the injector, and wherein when the high-pressure fuel system is abnormal, the fuel injection control means makes reference to the abnormal period fuel injection pulse width table on the basis of the engine speed and the engine load to set a final fuel injection pulse width for the injector.

In order to set the fuel injection pulse width, this control system includes the fuel pressure correction factor table which uses the fuel pressure in the practical use range of the high-pressure fuel system as a parameter for storing therein the fuel pressure correction factor for correcting the variation in fuel injection quantity based on the fuel pressure, and the abnormal period fuel pulse width table which uses the engine speed and the engine load as parameters for storing therein the fuel injection pulse width suited to obtain the required fuel injection quantity at the pressure of the low pressure fuel regulated by the low pressure regulator. When the high-pressure fuel system is normal, the fuel basic fuel injection quantity is set on the basis of the engine operating condition to set the basic fuel injection pulse width, which is used for obtaining the basic fuel injection quantity at a predetermined controlled fuel pressure regulated by the high-pressure regulator or the electromagnetic high-pressure regulator and which defines the basic valve opening period for the injector, on the basis of the basic fuel injection quantity, and the reference to the fuel pressure correction factor table is made on the basis of the fuel pressure of the high-pressure fuel system to set the fuel pressure correction factor. By this fuel pressure correction factor, the basic fuel injection pulse width is corrected to set the final fuel injection pulse width for the injector. On the other hand, when the high-pressure fuel system is abnormal, the reference to the abnormal period fuel injection pulse width table is made on the basis of the engine speed and the engine load to set the final fuel injection pulse width for the injector.

As described above, the control system includes the fuel pressure correction factor table which uses the fuel pressure in the practical use range of the high-pressure fuel system as a parameter for storing therein the fuel pressure correction factor for correcting the variation in fuel injection quantity based on the fuel pressure, and the abnormal period fuel pulse width table which uses the engine speed and the engine load as parameters for storing therein the fuel injection pulse width suited to obtain the required fuel injection quantity at the pressure of the low pressure fuel regulated by the low pressure regulator. In order to set the fuel injection pulse width, when the high-pressure fuel system is normal, the fuel basic fuel injection quantity is set on the basis of the engine operating condition to set the basic fuel injection pulse width, which is used for obtaining the basic fuel injection quantity at a predetermined controlled fuel pressure regulated by the high-pressure regulator or the electromagnetic high-pressure regulator and which defines the basic valve opening period for the injector, on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by this fuel pressure correction factor to set the final fuel injection pulse width for the injector. Therefore, in addition to the advantages obtained according to the second or third aspect of the present invention, the variation in actual fuel injection quantity with respect to the required fuel injection quantity can be corrected in accordance with the actual fuel pressure of the high-pressure fuel system, i.e., the actual fuel pressure fed to the injector, to set the final fuel injection pulse width defining the injection-valve opening period for the injector, since the basic fuel injection pulse width, which has been set in accordance with the predetermined controlled fuel pressure regulated by the high pressure regulator or the electromagnetic high-pressure regulator, is corrected by the fuel pressure correction factor when the high-fuel pressure system wherein the high pressure fuel is fed to the injector is normal. Therefore, an appropriate fuel injection pulse width suited to obtain the required fuel injection quantity can be set in accordance with the pressure of the high pressure fuel actually fed to the injector. As a result, an appropriate quantity of fuel corresponding to the required fuel injection quantity can be surely injected from the injector, so that the control accuracy of fuel injection can be more improved.

In addition, when the high-pressure fuel system for feeding the low pressure fuel of the low-pressure fuel system directly to the injector is abnormal, the reference to the abnormal period fuel injection pulse width table is made on the basis of the engine speed and the engine load to set the final fuel injection pulse width for the injector. Therefore, a fuel injection pulse width suited to obtain the required fuel injection quantity at the pressure of the low pressure fuel regulated by the low pressure regulator can be accurately set. Therefore, even if the high-pressure fuel system for feeding the low pressure fuel of the low-pressure fuel system directly to the injector is abnormal, the difference between the required fuel injection quantity and the fuel injection quantity actually injected from the injector can be surely decreased, so that the controllability of fuel injection can be improved.

According to a fifth aspect of the present invention, the control system may which further comprise: a fuel pressure correction factor table which uses a fuel pressure in a practical use range of the high-pressure fuel system as a parameter for storing therein a fuel pressure correction factor for correcting the variation in fuel injection quantity based on the fuel pressure, the fuel injection control means setting a basic fuel injection quantity on the basis of the engine operating condition to set a basic fuel injection pulse width, which is used for obtaining the basic fuel injection quantity at a predetermined controlled fuel pressure regulated by the high-pressure regulator or the electromagnetic high-pressure regulator and which defines a basic valve opening period for the injector, on the basis of the basic fuel injection quantity, and the fuel injection control means making reference to the fuel pressure correction factor table on the basis of the fuel pressure of the high-pressure fuel system to set a fuel pressure correction factor, the fuel injection control means setting an abnormal period correction factor for correcting to increase the basic fuel injection pulse width in accordance with the pressure of a low pressure fuel regulated by the low pressure regulator when at least the high-pressure fuel system is abnormal, and the fuel injection control means correcting the basic fuel injection pulse width by the fuel pressure correction factor and the abnormal period correction factor to set a final fuel injection pulse width for the injector.

This control system includes the fuel pressure correction factor table which uses the fuel pressure in the practical use range of the high-pressure fuel system as a parameter for storing therein the fuel pressure correction factor for correcting the variation in fuel injection quantity based on the fuel pressure. In order to set the fuel injection pulse width, the basic fuel injection quantity is set on the basis of the engine operating condition to set the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, on the basis of the basic fuel injection quantity, and the reference to the fuel pressure correction factor table is made on the basis of the fuel pressure of the high-pressure fuel system to set the fuel pressure correction factor. In addition, when at least the high-pressure fuel system is abnormal, the abnormal period correction factor for correcting to increase the basic fuel injection pulse width in accordance with the pressure of the low pressure fuel regulated by the low pressure regulator. Then, the basic fuel injection pulse width is corrected by the fuel pressure correction factor and the abnormal period correction factor to set the final fuel injection pulse width for the injector.

As described above, this control system includes the fuel pressure correction factor table which uses the fuel pressure in the practical use range of the high-pressure fuel system as a parameter for storing therein the fuel pressure correction factor for correcting the variation in fuel injection quantity based on the fuel pressure. In order to set the fuel injection pulse width, the basic fuel injection quantity is set on the basis of the engine operating condition to set the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, on the basis of the basic fuel injection quantity, and the reference to the fuel pressure correction factor table is made on the basis of the fuel pressure of the high-pressure fuel system to set the fuel pressure correction factor. In addition, when at least the high-pressure fuel system is abnormal, the abnormal period correction factor for correcting to increase the basic fuel injection pulse width in accordance with the pressure of the low pressure fuel regulated by the low pressure regulator. Then, the basic fuel injection pulse width is corrected by the fuel pressure correction factor and the abnormal period correction factor to set the final fuel injection pulse width for the injector. Therefore, when the basic fuel pulse width, which has been set in accordance with the controlled fuel pressure regulated by the high pressure regulator, can be corrected to be increased by the abnormal period correction factor in accordance with the pressure of the low pressure fuel regulated by the low pressure regulator, so that the fuel injection pulse width can be simply set in accordance with the pressure of the low pressure fuel in comparison with the fourth aspect of the present invention.

Therefore, the abnormal period fuel injection pulse width adopted in the fourth aspect of the present invention can be omitted, so that it is possible to reduce the data setting man-hour for the fuel injection pulse width stored in the abnormal period fuel injection table, and the memory capacity used by the table.

In addition, since the abnormal period correction factor can be used, the settings of the fuel injection pulse width during normal and abnormal state of the high-pressure fuel system can be commonly used to some extent to simplify the control, so that the data setting man-hour can be remarkably reduced in comparison with the fourth aspect of the present invention.

According to a sixth aspect of the present invention, the control system may further comprise: a fuel pressure correction factor table which uses the pressure of a low pressure fuel regulated by the low pressure regulator and a fuel pressure in a practical use range of the high-pressure fuel system as parameters for storing therein a fuel pressure correction factor for correcting the variation in fuel injection quantity based on the fuel pressure, the fuel injection control means setting a basic fuel injection quantity on the basis of the engine operating condition to set a basic fuel injection pulse width, which is used for obtaining the basic fuel injection quantity at a predetermined controlled fuel pressure regulated by the high-pressure regulator or the electromagnetic high-pressure regulator and which defines a basic valve opening period for the injector, on the basis of the basic fuel injection quantity, and the fuel injection control means making reference to the fuel pressure correction factor table on the basis of the fuel pressure of the high-pressure fuel system to set a fuel pressure correction factor to correct the basic fuel injection pulse width by the fuel pressure correction factor to set a final fuel injection pulse width for the injector.

This control system includes the fuel pressure correction factor table which uses the pressure of the low pressure fuel regulated by the low pressure regulator and the fuel pressure in the practical use range of the high-pressure fuel system as parameters for storing therein the fuel pressure correction factor for correcting the variation in fuel injection quantity based on the fuel pressure. In order to set the fuel injection pulse width, the basic fuel injection quantity is set on the basis of the engine operating condition to set the basic fuel injection pulse width, which is used for obtaining the basic fuel injection quantity at the predetermined controlled fuel pressure regulated by the high-pressure regulator or the electromagnetic high-pressure regulator and which defines a basic valve opening period for the injector, on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by the fuel pressure correction factor to set the final fuel injection pulse width for the injector.

As described above, this control system includes the fuel pressure correction factor table which uses the pressure of the low pressure fuel regulated by the low pressure regulator and the fuel pressure in the practical use range of the high-pressure fuel system as parameters for storing therein the fuel pressure correction factor for correcting the variation in fuel injection quantity based on the fuel pressure. In order to set the fuel injection pulse width, the basic fuel injection quantity is set on the basis of the engine operating condition to set the basic fuel injection pulse width, which is used for obtaining the basic fuel injection quantity at the predetermined controlled fuel pressure regulated by the high-pressure regulator or the electromagnetic high-pressure regulator and which defines a basic valve opening period for the injector, on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by the fuel pressure correction factor to set the final fuel injection pulse width for the injector. That is, the fuel pressure range covered by the fuel pressure correction factor table is extended to the pressure range of the low pressure fuel regulated by the low pressure regulator without being limited to the fuel pressure range in the practical use range of the high-pressure fuel system. Therefore, even if the low pressure fuel regulated by the low pressure regulator is fed to the injector when the high-pressure fuel system is abnormal, the basic fuel injection pulse width, which has been set in accordance with the controlled fuel pressure regulated by the high pressure regulator, can be compensated by the fuel pressure correction factor in accordance with the actual fuel pressure fed to the injector, so that the fuel pressure fed to the injector can be compatible with the fuel injection pulse width when the high-pressure fuel receiving the high pressure fuel is normal, or even if the high-pressure fuel system receiving the low pressure fuel is abnormal.

Therefore, the settings of the fuel injection pulse width during normal and abnormal states of the high-pressure fuel system can be quite commonly used, the control system can be more simplified than that in the fifth aspect of the present invention.

According to a seventh aspect of the present invention, there is provided a system for controlling an in-cylinder fuel injection engine, wherein a low pressure fuel fed from a low pressure pump is regulated to a predetermined fuel pressure by a low pressure regulator to be fed to a high pressure pump, the pressure of the fuel being raised by the high pressure pump and regulated to a predetermined controlled fuel pressure by a high pressure regulator to feed a high pressure fuel to an injector, and wherein during low engine speeds with low loads, a stratified combustion based on a late injection is selected to set a fuel injection quantity, a fuel injection timing and an ignition timing, which are adapted to the stratified combustion, on the basis of the engine operating condition, and during high engine speeds with high loads, a uniform premixed combustion based on an early injection is selected to set a fuel injection quantity, a fuel injection timing and an ignition timing, which are adapted to the uniform premixed combustion, on the basis of the engine operating condition, the injection quantity of fuel being injected directly into a cylinder by the injector to ignite the injected fuel by a spark plug at the ignition timing to achieve the stratified combustion or the uniform premixed combustion, the control system comprising: as shown in the basic block diagram of FIG. 2(*a*), opening/closing valve means provided in a fuel by-pass passage provided for by-passing the high pressure regulator to establish a communication between a high-pressure fuel system and a low-pressure fuel system; diagnosing means for monitoring at least one of the behavior of a fuel pressure of the high-pressure fuel system and the relationship between an air-fuel ratio and a fuel injection pulse width for the injector, the diagnosing means determining that the high-pressure fuel system is abnormal when meeting at least one of conditions that the behavior of the fuel pressure is abnormal and that the air-fuel ratio is incompatible with the fuel injection pulse width; opening/closing valve control means for closing the opening/closing valve means when the high-pressure fuel system is normal and for opening the opening/closing valve means when the high-pressure fuel system is abnormal; and combustion system selecting means for selecting the stratified combustion based on the late injection during low engine speeds with low loads, and the uniform premixed combustion based on the early injection during high engine speeds with high loads, on the basis of the engine operating condition; fuel injection control means for setting a fuel injection pulse width for the injector, which defines a fuel injection quantity adapted to the stratified combustion, on the basis of the engine operating condition in accordance with the controlled fuel pressure regulated by the high pressure regulator and for setting a fuel injection timing in a compression stroke of a cylinder to be injected when the high-pressure fuel system is normal and when the stratified combustion is selected, the fuel injection control means setting a fuel injection pulse width for the injector, which is adapted to the uniform premixed combustion, on the basis of the engine operating condition in accordance with the controlled fuel pressure regulated by the high pressure regulator and setting a fuel injection timing in an exhaust stroke end or intake stroke of a cylinder to be injected when the high pressure fuel system is normal and when the uniform premixed combustion is selected, and the fuel injection control means setting a fuel injection pulse width adapted to the uniform premixed combustion on the basis of the engine operating condition in accordance with the pressure of a low pressure fuel regulated by the low pressure regulator and setting a fuel injection timing adapted to the uniform premixed combustion when the high-pressure fuel system is abnormal; and ignition timing control means for setting an ignition timing adapted to the stratified combustion on the basis of the engine operating condition when the high-pressure fuel system is normal and when the stratified combustion is selected, and for setting an ignition timing adapted to the uniform premixed combustion on the basis of the engine operating condition when the high-pressure fuel system is normal and when the uniform premixed combustion is selected or when the high-pressure fuel system is abnormal.

This control system monitors at least one of the behavior of the fuel pressure of the high-pressure fuel system and the relationship between the air-fuel ratio and the fuel injection pulse width for the injector. When meeting at least one of conditions that the behavior of the fuel pressure is abnormal and that the air-fuel ratio is incompatible with the fuel injection pulse width, it is determined that the high-pressure fuel system is abnormal. In addition, on the basis of the engine operating condition, the stratified combustion based on the late injection is selected during low engine speeds with low loads, and the uniform premixed combustion based on the early injection is selected during high engine speeds with high loads. When the high-pressure fuel system is normal, the opening/closing valve means provided in the fuel by-pass passage for by-passing the high pressure pump to establish the communication between the high-pressure fuel system and the low-pressure fuel system is open to feed the high pressure fuel, the pressure of which has been raised by the high pressure pump to be regulated to the predetermined controlled fuel pressure by the high pressure regulator, to the injector. When the high-pressure fuel system is normal and when the stratified combustion is selected, the fuel injection pulse width for the injector defining the fuel injection quantity adapted to the stratified combustion is set on the basis of the engine operating condition in accordance with the controlled fuel pressure regulated by the high pressure regulator, and the fuel injection timing is set in the compression stroke of the cylinder to be injected. In addition, the ignition timing adapted to the stratified combustion is set on the basis of the engine operating condition to carry out the stratified combustion. When the high-pressure fuel system is normal and when the uniform premixed combustion is selected, the fuel injection pulse width for the injector, which is adapted to the uniform premixed combustion and which defines the fuel injection quantity, is set on the basis of the engine operating condition in accordance with the controlled fuel pressure regulated by the high pressure regulator, and the fuel injection timing is set in the exhaust stroke end or intake stroke of the cylinder to be injected. In addition, the ignition timing adapted to the uniform premixed combustion is set to carry out the uniform premixed combustion. On the other hand, when the high pressure fuel system is abnormal, the opening/closing valve means is open to feed the low pressure fuel, which has fed by the low pressure pump to be regulated to the predetermined fuel pressure by the low pressure regulator, directly to the high-pressure fuel system to feed the fuel to the injector. In addition, when the high-pressure fuel system is abnormal, the fuel injection pulse width adapted to the uniform premixed combustion is set on the engine operating condition in accordance with the low pressure fuel regulated by the low pressure regulator. At this time, the fuel injection timing and ignition timing, which are adapted to the uniform premixed combustion, are set on the basis of the engine operating condition to carry out the uniform premixed combustion based on the early injection regardless of the selection of the combustion system.

According to this control system, at least one of the behavior of the fuel pressure of the high-pressure fuel system of the in-cylinder fuel injection engine and the relationship between the air-fuel ratio and the fuel injection pulse width for the injector is monitored. When meeting at least one of conditions that the behavior of the fuel pressure is abnormal and that the air-fuel ratio is incompatible with the fuel injection pulse width, it is determined that the high-pressure fuel system is abnormal. Therefore, when the high-pressure fuel is abnormal, e.g., when the high pressure pump or high pressure regulator forming the high-pressure fuel system is abnormal, or when the fuel leaks from the high-pressure fuel system, or when the injector is abnormal, it is possible to accurately diagnose the abnormality of the high-pressure fuel system.

In addition, on the basis of the engine operating condition, the stratified combustion based on the late injection is selected during low engine speeds with low loads, and the uniform premixed combustion based on the early injection is selected during high engine speeds with high loads. Then, the diagnosed results for the high-pressure fuel system are reflected in the fuel injection control, and when the high-pressure fuel system is normal, the opening/closing valve means provided in the fuel by-pass passage for by-passing the high pressure pump to establish the communication between the high-pressure fuel system and the low-pressure fuel system is open, so that the high pressure fuel, the pressure of which has been raised by the high pressure pump and regulated to the predetermined controlled fuel pressure by the high pressure regulator, is fed to the injector. When the high-pressure fuel system is normal and when the stratified combustion is selected, the fuel injection pulse width for the injector defining the fuel injection quantity adapted to the stratified combustion is set on the basis of the engine operating condition in accordance with the controlled fuel pressure regulated by the high pressure regulator. In addition, the fuel injection timing is set in the compression stroke of the cylinder to be injected, and the ignition timing adapted to the stratified combustion is set on the basis of the engine operating condition to cry out the stratified combustion. Therefore, it is possible to obtain the compatibility of the pressure of the high pressure fuel fed to the injector with the fuel injection pulse width, and when the high-pressure fuel system is normal and when the engine operation condition is during low engine speeds with low loads, an appropriate quantity of fuel corresponding to the required fuel injection quantity, which is adapted to the stratified combustion and which ensures a predetermined output in accordance with the engine operating output at that time, can be injected from the injector, similar to conventional systems, so that it is possible to improve fuel consumption and exhaust emission by the stratified combustion when the engine operating condition is during low engine speeds with low load.

In addition, when the high-pressure fuel system is normal and when the uniform premixed combustion is selected, the fuel injection pulse width for the injector, which is adapted to the uniform premixed combustion and which defines the fuel injection quantity, is set on the basis of the engine operating condition in accordance with the controlled fuel pressure regulated by the high pressure regulator. In addition, the fuel injection timing is set in the exhaust stroke end or intake stroke of the cylinder to be injected, and the ignition timing adapted to the uniform premixed combustion is set to carry out the uniform premixed combustion. Therefore, it is possible to obtain the compatibility of the pressure of the high pressure fuel fed to the injector with the fuel injection pulse width, and when the high-pressure fuel system is normal and when the engine operating condition is during high engine speeds with high loads, an appropriate quantity of fuel corresponding to the required fuel injection quantity, which is adapted to the uniform premixed combustion and which obtains a predetermined output air-fuel ratio in accordance with the engine operating condition at that time, can be injected from the injector, similar to conventional systems. Then, during high engine speeds with high load, a high mean effective pressure can be obtained by the uniform premixed combustion to ensure the required engine output, and the engine output can be improved.

On the other hand, when the high pressure fuel system is abnormal, the opening/closing valve means is open, so that the low pressure fuel, which has fed by the low pressure pump to be regulated to the predetermined fuel pressure by the low pressure regulator, is fed directly to the high-pressure fuel system to be fed to the injector. Then, when the high-pressure fuel system is abnormal, the fuel injection pulse width adapted to the uniform premixed combustion is set on the engine operating condition in accordance with the low pressure fuel regulated by the low pressure regulator. Therefore, the fuel injection pulse width for the injector is set so as to obtain the predetermined fuel injection quantity adapted to the uniform premixed combustion at the pressure of the low pressure, and even if something is wrong with the high-pressure fuel system, the injection-valve opening time of the injector can be controlled by the fuel injection pulse width so as to be coincident with the required fuel injection quantity, so that the difference between the required fuel injection quantity and the fuel injection quantity actually injected from the injector can be reduced to inhibit the deterioration of the controllability of fuel injection.

In addition, when the high-pressure fuel system is abnormal, the fuel injection timing and ignition timing, which are adapted to the uniform premixed combustion, arc set on the basis of the engine operating condition to carry out the uniform premixed combustion based on the early injection regardless of the selection of the combustion system. Therefore, when the high-pressure fuel system is abnormal, even if the low pressure fuel is fed to the injector to be injected from the injector, the fuel injection can be carried out in the exhaust stroke end or intake stroke wherein the difference between the pressure of the low pressure fuel and the cylinder pressure is sufficiently ensured, and the fuel injection quantity can be accurately measured by the injection-valve opening period of the injector based on the fuel injection pulse width, so that it is possible to more surely prevent the deterioration of the controllability of fuel injection.

Therefore, even if something is wrong with the high-pressure fuel system, it is possible to surely prevent the deterioration of the controllability of fuel injection, and it is possible to prevent the engine from being damaged by the deterioration of the combustion state of the engine, so that the engine can continue to operate.

In addition, at this time, since the low pressure fuel is fed from the low-pressure fuel system to the high-pressure fuel system, the load of the high pressure pump due to the compression of the fuel can be decreased, and the high pressure regulator is in the inoperative state. Therefore, even if something is wrong with the high pressure pump or the high pressure regulator, it is possible to inhibit the degree of the abnormality of the high pressure pump or high pressure regulator from increasing to prevent fatal damage and so forth.

In addition, when the defective injection-valve opening occurs in the injector as the abnormality of the high-pressure fuel system, the low pressure fuel is fed to the injector. Therefore, the injection-valve opening load against the fuel pressure of the injector can be reduced, so that the controllability of fuel injection can be ensured to some extent. Also in this case, it is possible to inhibit the controllability of fuel injection from deteriorating.

Moreover, when the fuel leaks from the high-pressure fuel system as the abnormality of the high-pressure fuel system, the low pressure fuel is fed to the high-pressure fuel system to reduce the fuel pressure of the high-pressure fuel system, so that it is possible to inhibit the fuel from leaking from at least the high-pressure fuel system.

According to an eighth aspect of the present invention, there is provided a system for controlling an in-cylinder fuel injection engine, wherein a low pressure fuel fed from a low pressure pump is regulated to a predetermined fuel pressure by a low pressure regulator to be fed to a high pressure pump, the pressure of the fuel being raised by the high pressure pump and regulated by an electromagnetic high pressure regulator to feed a high pressure fuel to an injector, and wherein during low engine speeds with low loads, a stratified combustion based on a late injection is selected to set a fuel injection quantity, a fuel injection timing and an ignition timing, which are adapted to the stratified combustion, on the basis of the engine operating condition, and during high engine speeds with high loads, a uniform premixed combustion based on an early injection is selected to set a fuel injection quantity, a fuel injection timing and an ignition timing, which are adapted to the uniform premixed combustion, on the basis of the engine operating condition, the injection quantity of fuel being injected directly into a cylinder by the injector to ignite the injected fuel by a spark plug at the ignition timing to achieve the stratified combustion or the uniform premixed combustion, the control system comprising: as shown in the block diagram of FIG. 2(*b*), diagnosing means for connecting a downstream side of the electromagnetic high pressure regulator to a low-pressure fuel system and for monitoring at least one of the behavior of a fuel pressure of a high-pressure fuel system and the relationship between an air-fuel ratio and a fuel injection pulse width for the injector, the diagnosing means determining that the high-pressure fuel system is abnormal when meeting at least one of conditions that the behavior of the fuel pressure is abnormal and that the air-fuel ratio is incompatible with the fuel injection pulse width; high pressure regulator control means for setting a controlled variable for the electromagnetic high pressure regulator so as to obtain a predetermined controlled fuel pressure when the high-pressure fuel system is normal, the high pressure regulator control means setting the controlled variable so as to fully open the electromagnetic high pressure regulator when the high-pressure fuel system is abnormal; combustion system selecting means for selecting the stratified combustion based on the late injection during low engine speeds with low loads, and the uniform premixed combustion based on the early injection during high engine speeds with high loads, on the basis of the engine operating condition; fuel injection control means for setting a fuel injection pulse width for the injector, which defines a fuel injection quantity adapted to the stratified combustion, on the basis of the engine operating condition in accordance with the controlled fuel pressure regulated by the electromagnetic high pressure regulator and for setting a fuel injection timing in a compression stroke of a cylinder to be injected when the high-pressure fuel system is normal and when the stratified combustion is selected, the fuel injection control means setting a fuel injection pulse width for the injector, which is adapted to the uniform premixed combustion, on the basis of the engine operating condition in accordance with the controlled fuel pressure regulated by the electromagnetic high pressure regulator and setting a fuel injection timing in an exhaust stroke end or intake stroke of a cylinder to be injected when the high pressure fuel system is normal and when the uniform premixed combustion is selected, and the fuel injection control means setting a fuel injection pulse width adapted to the uniform premixed combustion on the basis of the engine operating condition in accordance with the pressure of a low pressure fuel regulated by the low pressure regulator and setting a fuel injection timing adapted to the uniform premixed combustion when the high-pressure fuel system is abnormal; and ignition timing control means for setting an ignition timing adapted to the stratified combustion on the basis of the engine operating condition when the high-pressure fuel system is normal and when the stratified combustion is selected, and for setting an ignition timing adapted to the uniform premixed combustion on the basis of the engine operating condition when the high-pressure fuel system is normal and when the uniform premixed combustion is selected or when the high-pressure fuel system is abnormal.

This control system uses the electromagnetic high-pressure regulator as the high pressure regulator, and the downstream side of the electromagnetic high pressure regulator is connected to the low-pressure fuel system. The control system monitors at least one of the behavior of the fuel pressure of the high-pressure fuel system of the in-cylinder fuel injection engine and the relationship between the air-fuel ratio and the fuel injection pulse width for the injector. When meeting at least one of conditions that the behavior of the fuel pressure is abnormal and that the air-fuel ratio is incompatible with the fuel injection pulse width, it is determined that the high-pressure fuel system is abnormal. On the basis of the engine operating condition, the stratified combustion based on the late injection is selected during low engine speeds with low loads, and the uniform premixed combustion based on the early injection is selected during high engine speed with high load. When the high-pressure fuel system is normal, the controlled variable for the electromagnetic high pressure regulator is set so as to obtain the predetermined controlled fuel pressure, and the high pressure fuel, the pressure of which has been raised by the high pressure pump and regulated to the predetermined controlled fuel pressure by the electromagnetic high-pressure regulator, is fed to the injector. When the high-pressure fuel system is normal and when the stratified combustion is selected, the fuel injection pulse width for the injector, which defines the fuel injection quantity adapted to the stratified combustion, is set on the engine operating condition in accordance with the controlled fuel pressure regulated by the electromagnetic high-pressure regulator. In addition, the fuel injection timing is set in the compression stroke of the cylinder to be injected, and the ignition timing adapted to the stratified combustion is set on the basis of the engine operating condition, so that the stratified combustion is carried out. When the high-pressure fuel system is normal and when the uniform premixed combustion is selected, the fuel injection pulse width for the injector, which defines the fuel injection quantity adapted to the uniform premixed combustion, is set on the basis of the engine operating condition in accordance with the controlled fuel pressure regulated by the electromagnetic high-pressure regulator. In addition, the fuel injection timing is set in the exhaust stroke end or intake stroke of the cylinder to be injected, and the ignition timing adapted to the uniform premixed combustion is set, so that the uniform premixed combustion is carried out. On the other hand, when the high-pressure fuel system is abnormal, the electromagnetic high-pressure regulator is fully open, so that the low pressure fuel fed by the low pressure pump to be regulated to the predetermined fuel pressure by the low pressure regulator is fed directly to the high-pressure fuel system to be fed to the injector. When the high-pressure fuel system is abnormal, the fuel injection pulse width adapted to the uniform premixed combustion is set on the basis of the engine operating condition in accordance with the pressure of the low pressure fuel regulated by the low pressure regulator. At this time, the fuel injection timing and ignition timing, which are adapted to the uniform premixed combustion, are set on the basis of the engine operating condition, so that the uniform premixed combustion based on the early injection is carried out regardless of the selection of the combustion system.

According to this control system, at least one of the behavior of the fuel pressure of the high-pressure fuel system of the in-cylinder fuel injection engine and the relationship between the air-fuel ratio and the fuel injection pulse width for the injector is monitored. When meeting at least one of conditions that the behavior of the fuel pressure is abnormal and that the air-fuel ratio is incompatible with the fuel injection pulse width, it is determined that the high-pressure fuel system is abnormal. Therefore, when the high-pressure fuel is abnormal, e.g., when the high pressure pump or high pressure regulator forming the high-pressure fuel system is abnormal, or when the fuel leaks from the high-pressure fuel system, or when the injector is abnormal, it is possible to accurately diagnose the abnormality of the high-pressure fuel system.

In addition, the control system uses the electromagnetic high-pressure regulator as the high pressure regulator, and the downstream side of the electromagnetic high pressure regulator is connected to the low-pressure fuel system. In addition, on the basis of the engine operating condition, the stratified combustion based on the late injection is selected during low engine speeds with low loads, and the uniform premixed combustion based on the early injection is selected during high engine speed with high load. Then, the diagnosed results for the high-pressure fuel system are reflected in the fuel injection control, and when the high-pressure fuel system is normal, the controlled variable for the electromagnetic high pressure regulator is set so as to obtain the predetermined controlled fuel pressure, and the high pressure fuel, the pressure of which has been raised by the high pressure pump and regulated to the predetermined controlled fuel pressure by the electromagnetic high-pressure regulator, is fed to the injector. When the high-pressure fuel system is normal and when the stratified combustion is selected, the fuel injection pulse width for the injector, which defines the fuel injection quantity adapted to the stratified combustion, is set on the engine operating condition in accordance with the controlled fuel pressure regulated by the electromagnetic high-pressure regulator. In addition, the fuel injection timing is set in the compression stroke of the cylinder to be injected, and the ignition timing adapted to the stratified combustion is set on the basis of the engine operating condition, so that the stratified combustion is carried out. Therefore, it is possible to obtain the compatibility of the pressure of the high pressure fuel fed to the injector with the fuel injection pulse width, and when the high-pressure fuel system is normal and when the engine operation condition is during low engine speeds with low loads, an appropriate quantity of fuel corresponding to the required fuel injection quantity, which is adapted to the stratified combustion and which ensures a predetermined output in accordance with the engine operating output at that time, can be injected from the injector, similar to conventional systems, so that it is possible to improve fuel consumption and exhaust emission by the stratified combustion when the engine operating condition is during low engine speeds with low load.

In addition, when the high-pressure fuel system is normal and when the uniform premixed combustion is selected, the fuel injection pulse width for the injector, which defines the fuel injection quantity adapted to the uniform premixed combustion, is set on the basis of the engine operating condition in accordance with the controlled fuel pressure regulated by the electromagnetic high-pressure regulator. In addition, the fuel injection timing is set in the exhaust stroke end or intake stroke of the cylinder to be injected, and the ignition timing adapted to the uniform premixed combustion is set, so that the uniform premixed combustion is carried out. Therefore, it is possible to obtain the compatibility of the pressure of the high pressure fuel fed to the injector with the fuel injection pulse width, and when the high-pressure fuel system is normal and when the engine operating condition is during high engine speeds with high loads, an appropriate quantity of fuel corresponding to the required fuel injection quantity, which is adapted to the uniform premixed combustion and which obtains a predetermined output air-fuel ratio in accordance with the engine operating condition at that time, can be injected from the injector, similar to conventional systems. Then, during high engine speeds with high load, a high mean effective pressure can be obtained by the uniform premixed combustion to ensure the required engine output, and the engine output can be improved.

On the other hand, when the high-pressure fuel system is abnormal, the electromagnetic high-pressure regulator is fully open, so that the low pressure fuel fed by the low pressure pump to be regulated to the predetermined fuel pressure by the low pressure regulator is fed directly to the high-pressure fuel system to be fed to the injector, independent of the high pressure fuel. When the high-pressure fuel system is abnormal, the fuel injection pulse width adapted to the uniform premixed combustion is set on the basis of the engine operating condition in accordance with the pressure of the low pressure fuel regulated by the low pressure regulator. Therefore, the fuel injection pulse width for the injector is set so as to obtain the predetermined fuel injection quantity adapted to the uniform premixed combustion at the pressure of the low pressure, and even if something is wrong with the high-pressure fuel system, the injection-valve opening time of the injector can be controlled by the fuel injection pulse width so as to be coincident with the required fuel injection quantity, so that the difference between the required fuel injection quantity and the fuel injection quantity actually injected from the injector can be reduced to inhibit the deterioration of the controllability of fuel injection.

In addition, when the high-pressure fuel system is abnormal, the fuel injection timing and ignition timing, which are adapted to the uniform premixed combustion, are set on the basis of the engine operating condition, so that the uniform premixed combustion based on the early injection is carried out regardless of the selection of the combustion system. Therefore, when the high-pressure fuel system is abnormal, even if the low pressure fuel is fed to the injector to be injected from the injector, the fuel injection can be carried out in the exhaust stroke end or intake stroke wherein the difference between the pressure of the low pressure fuel and the cylinder pressure is sufficiently ensured, and the fuel injection quantity can be accurately measured by the injection-valve opening period of the injector based on the fuel injection pulse width, so that it is possible to more surely prevent the deterioration of the controllability of fuel injection.

Therefore, even if something is wrong with the high-pressure fuel system, it is possible to surely prevent the deterioration of the controllability of fuel injection, and it is possible to prevent the engine from being damaged by the deterioration of the combustion state of the engine, so that the engine can continue to operate.

In addition, at this time, since the low pressure fuel is fed from the low-pressure fuel system to the high-pressure fuel system, the load of the high pressure pump due to the compression of the fuel can be decreased, and the electromagnetic high-pressure regulator is substantially in the inoperative state. Therefore, even if something is wrong with the high pressure pump or the electromagnetic high-pressure regulator, it is possible to inhibit the degree of the abnormality of the high pressure pump or high pressure regulator from increasing to prevent, fatal damage and so forth.

In addition, when the defective injection-valve opening occurs in the injector as the abnormality of the high-pressure fuel system, the low pressure fuel is fed to the injector. Therefore, the injection-valve opening load against the fuel pressure of the injector can be reduced, so that the controllability of fuel injection can be ensured to some extent. Also in this case, it is possible to inhibit the controllability of fuel injection from deteriorating.

Moreover, when the fuel leaks from the high-pressure fuel system as the abnormality of the high-pressure fuel system, the low pressure fuel is fed to the high-pressure fuel system to reduce the fuel pressure of the high-pressure fuel system, so that it is possible to inhibit the fuel from leaking from at least the high-pressure fuel system.

In addition, since the electromagnetic high-pressure regulator has both functions of the high pressure regulator and the opening/closing valve means according to the seventh aspect of the present invention, it is possible to dispense with the high pressure regulator and the opening/closing valve means according to the seventh aspect of the present invention. Therefore, it is possible to reduce the number of parts of the fuel feed system to simplify the construction of the fuel feed system in comparison with the control system according to the seventh aspect of the present invention.

According to a ninth aspect of the present invention, the control system may further comprise: a fuel pressure correction factor table which uses a fuel pressure in a practical use range of the high-pressure fuel system as a parameter for storing therein a fuel pressure correction factor for correcting the variation in fuel injection quantity based on the fuel pressure; and an abnormal period fuel pulse width table which uses an engine speed and an engine load as parameters for storing therein a fuel injection pulse width suited to obtain a required fuel injection quantity adapted to the uniform premixed combustion at the pressure of a low pressure fuel regulated by the low pressure regulator; the fuel injection control means setting a basic fuel injection quantity adapted to the stratified combustion on the basis of the engine operating condition when the high-pressure fuel system is normal and when the stratified combustion is selected and setting a basic fuel injection quantity adapted to the uniform premixed combustion on the basis of the engine operating condition when the high-pressure fuel system is normal and when the uniform premixed combustion is selected, the fuel injection control means setting a basic fuel injection pulse width, which is used for obtaining the basic fuel injection quantity at a predetermined controlled fuel pressure regulated by the high-pressure regulator or the electromagnetic high-pressure regulator and which defines a basic valve opening period for the injector, on the basis of the basic fuel injection quantity, and the fuel injection control means making reference to the fuel pressure correction factor table on the basis of the fuel pressure of the high-pressure fuel system to set a fuel pressure correction factor to correct the basic fuel injection pulse width by the fuel pressure correction factor to set a final fuel injection pulse width for the injector, and the fuel injection control means making reference to the abnormal period fuel injection pulse width table on the basis of the engine speed and the engine load to set a final fuel injection pulse width for the injector when the high-pressure fuel system is abnormal.

In order to set the fuel injection pulse width, this control system includes: the fuel pressure correction factor table which uses the fuel pressure in the practical use range of the high-pressure fuel system as a parameter for storing therein the fuel pressure correction factor for correcting the variation in fuel injection quantity based on the fuel pressure; and the abnormal period fuel pulse width table which uses the engine speed and the engine load as parameters for storing therein the fuel injection pulse width suited to obtain the required fuel injection quantity adapted to the uniform premixed combustion at the pressure of the low pressure fuel regulated by the low pressure regulator. When the high-pressure fuel system is normal and when the stratified combustion is selected, the basic fuel injection quantity adapted to the stratified combustion is set on the basis of the engine operating condition. When the high-pressure fuel system is normal and when the uniform premixed combustion is selected, the basic fuel injection quantity adapted to the uniform premixed combustion is set on the basis of the engine operating condition. Then, the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, is set on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by the fuel pressure correction factor to set the final fuel injection pulse width for the injector. On the other hand, when the high-pressure fuel system is abnormal, the reference to the abnormal period fuel injection pulse width table is made on the basis of the engine speed and the engine load to set the final fuel injection pulse width for the injector.

As described above, this control system includes: the fuel pressure correction factor table which uses the fuel pressure in the practical use range of the high-pressure fuel system as a parameter for storing therein the fuel pressure correction factor for correcting the variation in fuel injection quantity based on the fuel pressure; and the abnormal period fuel pulse width table which uses the engine speed and the engine load as parameters for storing therein the fuel injection pulse width suited to obtain the required fuel injection quantity adapted to the uniform premixed combustion at the pressure of the low pressure fuel regulated by the low pressure regulator. In order to set the fuel injection pulse width, when the high-pressure fuel system is normal and when the stratified combustion is selected, the basic fuel injection quantity adapted to the stratified combustion is set on the basis of the engine operating condition. When the high-pressure fuel system is normal and when the uniform premixed combustion is selected, the basic fuel injection quantity adapted to the uniform premixed combustion is set on the basis of the engine operating condition. Then, the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, is set on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by the fuel pressure correction factor to set the final fuel injection pulse width for the injector. In addition to the advantages obtained according to the seventh or eighth aspect of the present invention, the variation in actual fuel injection quantity with respect to the required fuel injection quantity can be compensated in accordance with the actual fuel pressure of the high-pressure fuel system, i.e., the actual fuel pressure fed to the injector, to set the final fuel injection pulse width defining the injection-valve opening period for the injector, since the basic fuel injection pulse width, which has been set in accordance with the predetermined controlled fuel pressure regulated by the high pressure regulator or the electromagnetic high-pressure regulator, is corrected by the fuel pressure correction factor when the high-fuel pressure system wherein the high pressure fuel is fed to the injector is normal. Therefore, an appropriate fuel injection pulse width suited to obtain the required fuel injection quantity can be set in accordance with the pressure of the high pressure fuel actually fed to the injector. As a result, an appropriate quantity of fuel corresponding to the required fuel injection quantity adapted to either of the stratified combustion or the uniform premixed combustion can be surely injected from the injector, so that the control accuracy of fuel injection can be more improved.

In addition, when the high-pressure fuel system for feeding the low pressure fuel of the low-pressure fuel system directly to the injector is abnormal, the reference to the abnormal period fuel injection pulse width table is made on the basis of the engine speed and the engine load to set the final fuel injection pulse width for the injector. Therefore, a fuel injection pulse width suited to obtain the required fuel injection quantity adapted to the uniform premixed combustion at the pressure of the low pressure fuel regulated by the low pressure regulator can be accurately set. Therefore, even if the high-pressure fuel system for feeding the low pressure fuel of the low-pressure fuel system directly to the injector is abnormal, the difference between the required fuel injection quantity and the fuel injection quantity actually injected from the injector can be surely decreased, so that the controllability of fuel injection can be improved.

According to a tenth aspect of the present invention, the control system may further comprise: a fuel pressure correction factor table which uses a fuel pressure in a practical use range of the high-pressure fuel system as a parameter for storing therein a fuel pressure correction factor for correcting the variation in fuel injection quantity based on the fuel pressure, the fuel injection control means setting a basic fuel injection quantity adapted to the stratified combustion on the basis of the engine operating condition when the high-pressure fuel system is normal and when the stratified combustion is selected and setting a basic fuel injection quantity adapted to the uniform premixed combustion on the basis of the engine operating condition when the high-pressure fuel system is normal and when the uniform premixed combustion is selected or when the high-pressure fuel system is abnormal, the fuel injection control means setting a basic fuel injection pulse width, which is used for obtaining the basic fuel injection quantity at a predetermined controlled fuel pressure regulated by the high-pressure regulator or the electromagnetic high-pressure regulator and which defines a basic valve opening period for the injector, on the basis of the basic fuel injection quantity, the fuel injection control means making reference to the fuel pressure correction factor table on the basis of the fuel pressure of the high-pressure fuel system to set a fuel pressure correction factor, the fuel injection control means setting an abnormal period correction factor for correcting to increase the basic fuel injection pulse width in accordance with the pressure of a low pressure fuel regulated by the low pressure regulator when at least the high-pressure fuel system is abnormal, and the fuel injection control means correcting the basic fuel injection pulse width by the fuel pressure correction factor and the abnormal period correction factor to set a final fuel injection pulse width for the injector.

This control system include the fuel pressure correction factor table which uses the fuel pressure in the practical use range of the high-pressure fuel system as a parameter for storing therein the fuel pressure correction factor for correcting the variation in fuel injection quantity based on the fuel pressure. In order to set the fuel injection pulse width, when the high-pressure fuel system is normal and when the stratified combustion is selected, the basic fuel injection quantity adapted to the stratified combustion is set on the basis of the engine operating condition, and when the high-pressure fuel system is normal and when the uniform premixed combustion is selected or when the high-pressure fuel system is abnormal, the basic fuel injection quantity adapted to the uniform premixed combustion is set on the basis of the engine operating condition. Then, the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, is set on the basis of the basic fuel injection quantity, and the reference to the fuel pressure correction factor table is made on the basis of the fuel pressure of the high-pressure fuel system to set the fuel pressure correction factor. In addition, when at least the high-pressure fuel system is abnormal, the abnormal period correction factor for correcting to increase the basic fuel injection pulse width in accordance with the pressure of the low pressure fuel regulated by the low pressure regulator is set. Then, the basic fuel injection pulse width is corrected by the fuel pressure correction factor and the abnormal period correction factor to set the final fuel injection pulse width for the injector.

As described above, this control system include the fuel pressure correction factor table which uses the fuel pressure in the practical use range of the high-pressure fuel system as a parameter for storing therein the fuel pressure correction factor for correcting the variation in fuel injection quantity based on the fuel pressure. In order to set the fuel injection pulse width, when the high-pressure fuel system is normal and when the stratified combustion is selected, the basic fuel injection quantity adapted to the stratified combustion is set on the basis of the engine operating condition, and when the high-pressure fuel system is normal and when the uniform premixed combustion is selected or when the high-pressure fuel system is abnormal, the basic fuel injection quantity adapted to the uniform premixed combustion is set on the basis of the engine operating condition. Then, the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, is set on the basis of the basic fuel injection quantity, and the reference to the fuel pressure correction factor table is made on the basis of the fuel pressure of the high-pressure fuel system to set the fuel pressure correction factor. In addition, when at least the high-pressure fuel system is abnormal, the abnormal period correction factor for correcting to increase the basic fuel injection pulse width in accordance with the pressure of the low pressure fuel regulated by the low pressure regulator is set. Then, the basic fuel injection pulse width is corrected by the fuel pressure correction factor and the abnormal period correction factor to set the final fuel injection pulse width for the injector. Therefore, when the basic fuel pulse width, which has been set in accordance with the controlled fuel pressure regulated by the high pressure regulator, can be corrected to be increased by the abnormal period correction factor in accordance with the pressure of the low pressure fuel regulated by the low pressure regulator, so that the fuel injection pulse width can be simply set in accordance with the pressure of the low pressure fuel in comparison with the ninth aspect of the present invention.

Therefore, the abnormal period fuel injection pulse width adopted in the ninth aspect of the present invention can be omitted, so that it is possible to reduce the data setting man-hour for the fuel injection pulse width stored in the abnormal period fuel injection table, and the memory capacity used by the table.

In addition, since the abnormal period correction factor can be used, the settings of the fuel injection pulse width during normal and abnormal state of the high-pressure fuel system can be commonly used to some extent to simplify the control, so that the data setting man-hour can be remarkably reduced in comparison with the ninth aspect of the present invention.

According to an eleventh aspect of the present invention, the control system may further comprise: a fuel pressure correction factor table which uses the pressure of a low pressure fuel regulated by the low pressure regulator and a fuel pressure in a practical use range of the high-pressure fuel system as parameters for storing therein a fuel pressure correction factor for correcting the variation in fuel injection quantity based on the fuel pressure, the fuel injection control means setting a basic fuel injection quantity adapted to the stratified combustion on the basis of the engine operating condition when the high-pressure fuel system is normal and when the stratified combustion is selected and setting a basic fuel injection quantity adapted to the uniform premixed combustion on the basis of the engine operating condition when the high-pressure fuel system is normal and when the uniform premixed combustion is selected or when the high-pressure fuel system is abnormal, the fuel injection control means setting a basic fuel injection pulse width, which is used for obtaining the basic fuel injection quantity at a predetermined controlled fuel pressure regulated by the high-pressure regulator or the electromagnetic high-pressure regulator and which defines a basic valve opening period for the injector, on the basis of the basic fuel injection quantity, and the fuel injection control means making reference to the fuel pressure correction factor table on the basis of the fuel pressure of the high-pressure fuel system to set a fuel pressure correction factor to correct the basic fuel injection pulse width by the fuel pressure correction factor to set a final fuel injection pulse width for the injector.

This control system include the fuel pressure correction factor table which uses the pressure of the low pressure fuel regulated by the low pressure regulator and the fuel pressure in the practical use range of the high-pressure fuel system as parameters for storing therein the fuel pressure correction factor for correcting the variation in fuel injection quantity based on the fuel pressure. In order to set the fuel injection pulse width, when the high-pressure fuel system is normal and when the stratified combustion is selected, the basic fuel injection quantity adapted to the stratified combustion is set on the basis of the engine operating condition, and when the high-pressure fuel system is normal and when the uniform premixed combustion is selected or when the high-pressure fuel system is abnormal, the basic fuel injection quantity adapted to the uniform premixed combustion is set on the basis of the engine operating condition. Then, the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, is set on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by the fuel pressure correction factor to set the final fuel injection pulse width for the injector.

As described above, this control system include the fuel pressure correction factor table which uses the pressure of the low pressure fuel regulated by the low pressure regulator and the fuel pressure in the practical use range of the high-pressure fuel system as parameters for storing therein the fuel pressure correction factor for correcting the variation in fuel injection quantity based on the fuel pressure. In order to set the fuel injection pulse width, when the high-pressure fuel system is normal and when the stratified combustion is selected, the basic fuel injection quantity adapted to the stratified combustion is set on the basis of the engine operating condition, and when the high-pressure fuel system is normal and when the uniform premixed combustion is selected or when the high-pressure fuel system is abnormal, the basic fuel injection quantity adapted to the uniform premixed combustion is set on the basis of the engine operating condition. Then, the basic fuel injection pulse width, which is used for obtaining the basic fuel injection quantity at the predetermined controlled fuel pressure regulated by the high-pressure regulator or the electromagnetic high-pressure regulator and which defines the basic valve opening period for the injector, is set on the basis of the basic fuel injection quantity, and the reference to the fuel pressure correction factor table is made on the basis of the fuel pressure of the high-pressure fuel system to set the fuel pressure correction factor. Then, the basic fuel injection pulse width is corrected by the fuel pressure correction factor to set the final fuel injection pulse width for the injector. That is, the fuel pressure range covered by the fuel pressure correction factor table is extended to the pressure range of the low pressure fuel regulated by the low pressure regulator without being limited to the fuel pressure range in the practical use range of the high-pressure fuel system. Therefore, even if the low pressure fuel regulated by the low pressure regulator is fed to the injector when the high-pressure fuel system is abnormal, the basic fuel injection pulse width, which has been set in accordance with the controlled fuel pressure regulated by the high pressure regulator, can be compensated by the fuel pressure correction factor in accordance with the actual fuel pressure fed to the injector, so that the fuel pressure fed to the injector can be compatible with the fuel injection pulse width when the high-pressure fuel receiving the high pressure fuel is normal, or even if the high-pressure fuel system receiving the low pressure fuel is abnormal.

Therefore, the settings of the fuel injection pulse width during normal and abnormal states of the high-pressure fuel system can be quite commonly used, the control system can be more simplified than that in the tenth aspect of the present invention.

According to a twelfth aspect of the present invention, the fuel injection control means may carry out the upper limitation of the fuel injection pulse width which is set when the high-pressure fuel system is abnormal.

In this control system, in order to set the fuel injection pulse width when the high-pressure fuel system is abnormal, the upper limitation of the fuel injection pulse width is carried out, so that the engine output is restricted when the high-pressure fuel system is abnormal.

According to this control system, since the upper limitation of the fuel injection pulse width is carried out to restrict the engine output in a case where the fuel injection pulse width is set when the high-pressure fuel system is abnormal, it is possible to prevent the abnormality of the high-pressure fuel from increasing and it is possible to surely prevent the deterioration of the controllability of fuel injection due to the fail safe control to prevent the engine combustion state from deteriorating, in addition to the advantages obtained according to the second through eleventh aspects of the present invention.

According to a thirteenth aspect of the present invention, in the system for diagnosing a high-pressure fuel system for an in-cylinder fuel injection engine or the system for controlling an in-cylinder fuel injection engine, the diagnosing means may determine that the high-pressure fuel system is abnormal, when meeting at least one of conditions that the fuel pressure of the high-pressure fuel system does not reach a predetermined pressure even if a predetermined period of time elapses after the engine start-up, that the fuel pressure of the high-pressure fuel system is not within an ordinary fuel pressure range after the engine start-up, and that the fuel injection pulse width continues to exceed a predetermined value for a predetermined period of time at a lean air-fuel ratio.

In this diagnosing or control system, when meeting at least one of conditions that the fuel pressure of the high-pressure fuel system does not reach a predetermined pressure even if the predetermined period of time elapses after the engine start-up, that the fuel pressure of the high-pressure fuel system is not within the ordinary fuel pressure range after the engine start-up, and that the fuel injection pulse width continues to exceed a predetermined value for a predetermined period of time at a lean air-fuel ratio, it is determined that the high-pressure fuel system is abnormal.

As described above, in this diagnosing or control system, when meeting at least one of conditions that the fuel pressure of the high-pressure fuel system does not reach a predetermined pressure even if the predetermined period of time elapses after the engine start-up, that the fuel pressure of the high-pressure fuel system is not within the ordinary fuel pressure range after the engine start-up, and that the fuel injection pulse width continues to exceed a predetermined value for a predetermined period of time at a lean air-fuel ratio, it is determined that the high-pressure fuel system is abnormal. Therefore, in addition to the advantages obtained according to the first through twelfth aspect of the present invention, when the high-pressure fuel is abnormal, e.g., when the high pressure pump, the high pressure regulator and/or the electromagnetic high-pressure regulator, which form the high-pressure fuel system is abnormal, or when the fuel leaks from the high-pressure fuel system, or when the injector is abnormal, it is possible to accurately and early diagnose the abnormality of the high-pressure fuel system.

In addition, when the abnormality of the high-pressure fuel system is determined by the compatibility of the air-fuel ratio with the fuel injection pulse width, the fuel injection pulse width is determined on the basis of the lean air-fuel ratio. When the fuel injection pulse width defining the fuel injection quantity exceeds a predetermined value which can not usually be obtained if the high-pressure fuel system is normal, it is determined that the high-pressure is abnormal. Therefore, it is possible to surely diagnose the abnormality of the high-pressure fuel system.

Moreover, when the compatibility of the air-fuel ratio with the fuel injection pulse width is determined, the continuing period of the abnormal state of the compatibility is also determined. Therefore, it is possible to prevent misdiagnosis due to the abnormal output value of the air-fuel sensor or the abnormal fuel injection pulse width based on the response time lag in the air-fuel ratio feedback correction, the influence of disturbance or the like.

DESCRIPTION OF THE PREFERRED EMBODIMENTS

Referring now to the accompanying drawings, the preferred embodiments of the present invention will be described below. FIGS. 3 through 23 show the first preferred embodiment of the present invention.

Figure 19:
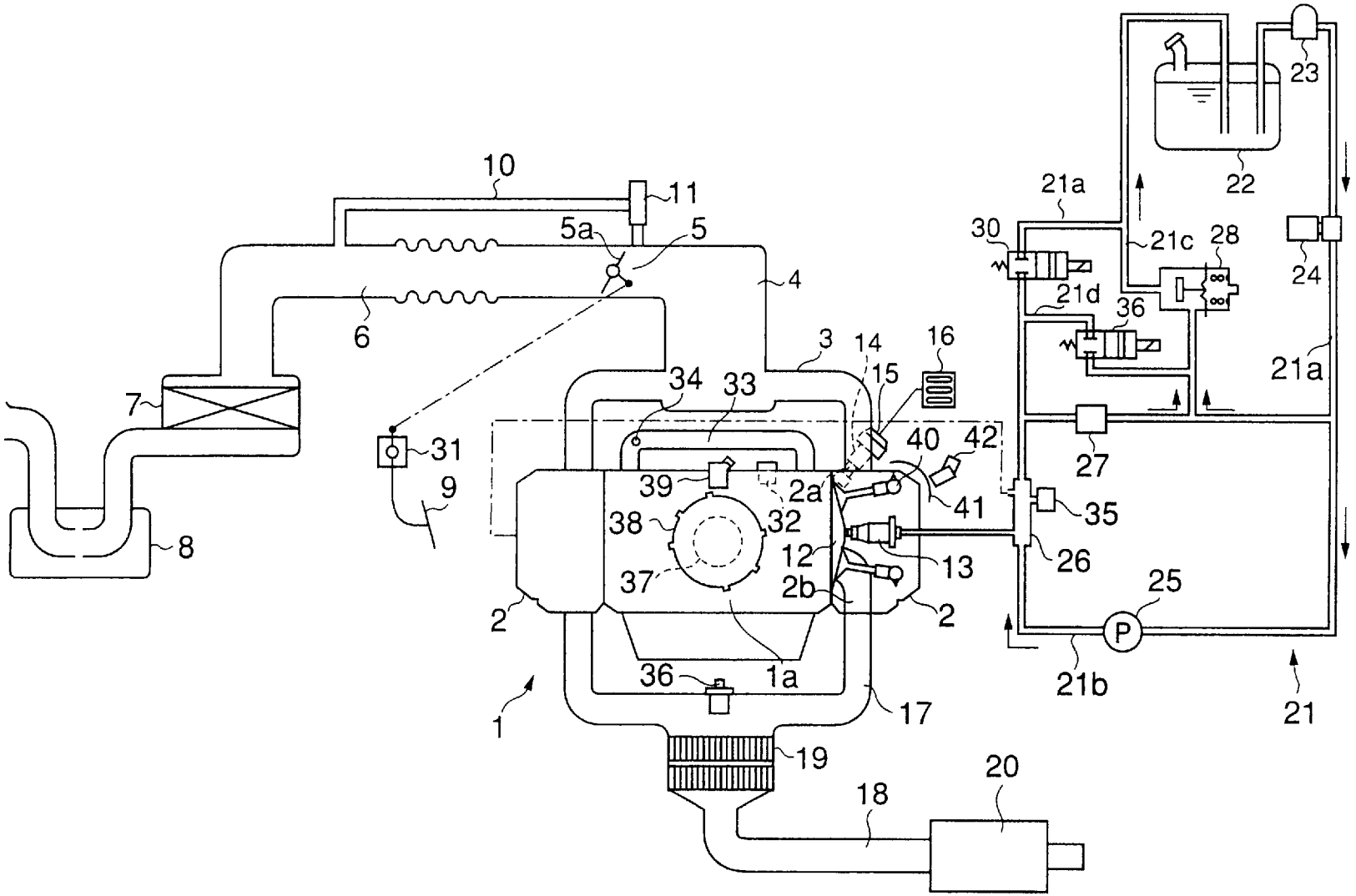
FIG. 19 is a general schematic view of an in-cylinder fuel injection engine in the first preferred embodiment of the present invention.

First, referring to FIG. 19, the schematic construction of an in-cylinder fuel injection engine will be described. In FIG. 19, reference number 1 denotes a horizontally opposed four-cycle, four-cylinder, cylinder-direct-injection gasoline engine (which will be hereinafter simply referred to as an "engine") for an automotive vehicle as an example of an in-cylinder fuel injection engine. This engine 1 is provided with cylinder heads 2 on both of right and left banks of a cylinder block la thereof. Each of the cylinder heads 2 is formed with an intake port 2*a* and an exhaust port 2*b* for each cylinder.

In the intake system of this engine 1, each of the intake ports 2*a* is communicated with an intake manifold 3 which is communicated with a throttle chamber 5 via an air chamber 4, in which intake passages for the respective cylinders are assembled. An air cleaner 7 is arranged upstream of the throttle chamber 5 via an intake pipe 6. The air cleaner 7 is communicated with an air intake chamber 8.

The throttle chamber 5 is provided with a throttle valve 5*a* which works with an accelerator pedal 9. To the intake pipe 6, a by-pass passage 10 for by-passing the throttle valve 5*a* is connected. In the bypass passage 10, an idling speed control valve (ISC valve) 11 is provided. The idling speed control valve 11 is designed to control the idling speed of the engine 1 by regulating the quantity of a by-pass air flowing through the by-pass passage 10 on the basis of the valve position during idling.

In the cylinder heads 2, injectors 13 for injecting a fuel directly into a combustion chamber (cylinder) 12 are provided for each cylinder. For each cylinder of the cylinder heads 2, a spark plug 13 having a discharge electrode at the tip thereof exposed to the combustion chamber 12 is provided. The spark plug 13 is connected to an igniter 16 via an ignition coil 15 provided for each cylinder.

As the exhaust system of the engine 1, an exhaust pipe 18 is communicated with an assembly part of an exhaust manifolds 17 communicated with each of the exhaust ports 2*b* of the cylinder heads 2. A catalytic converter 19 is provided in the exhaust pipe 18 to be communicated with a muffler 20.

Figure 20:
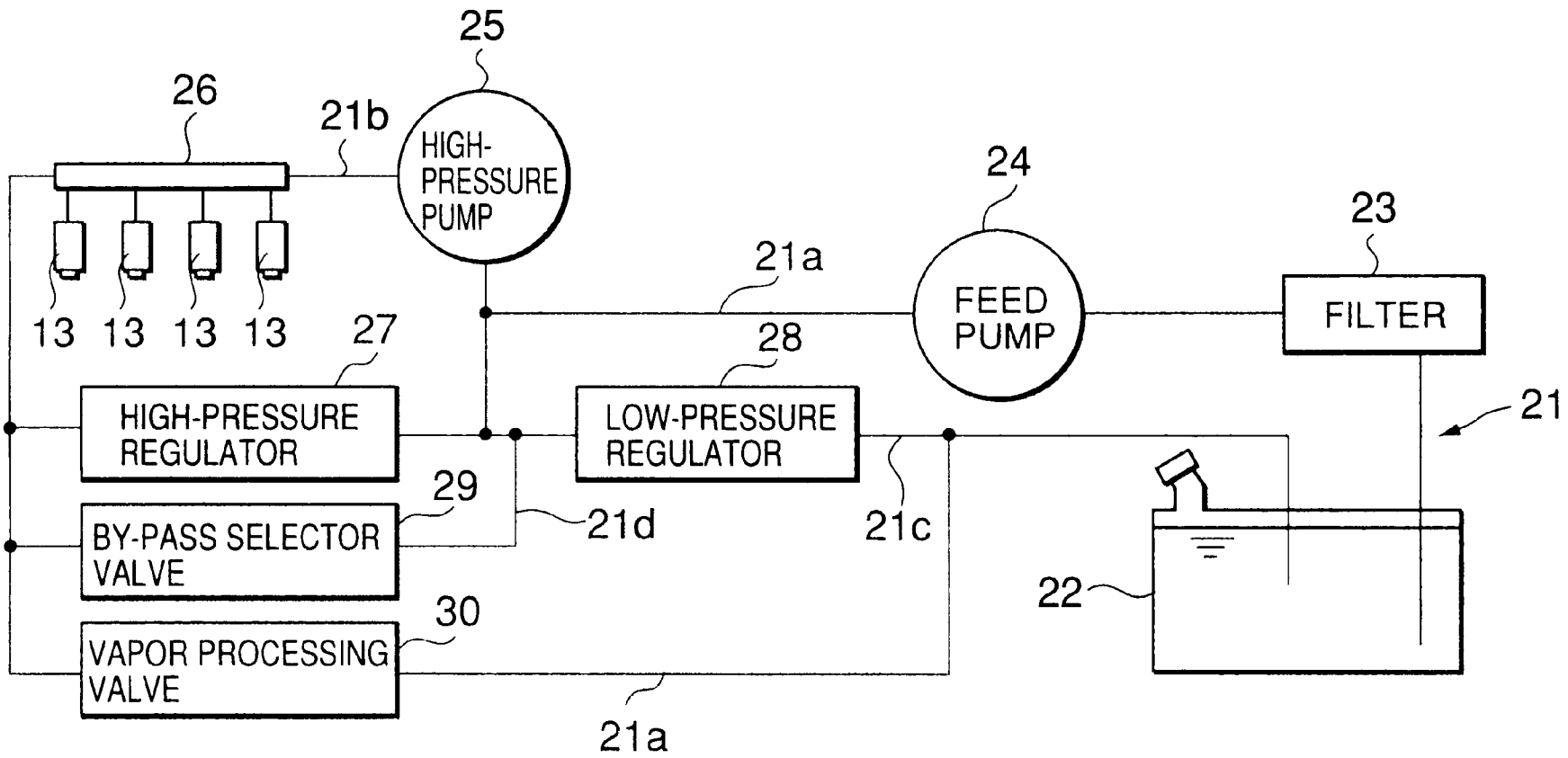
FIG. 20 is a schematic block diagram of a fuel feed system in the first preferred embodiment of the present invention.

Referring to FIGS. 19 and 20, the construction of a fuel feed system of the engine 1 will be described below. In FIGS. 19 and 20, reference number 21 denotes a fuel passage for feeding a fuel from a fuel tank 22 to each of the injectors 13. In the fuel passage 21, a fuel filter 23, an electric feed pump 24 serving as an example of a low pressure pump, a high pressure pump of an engine drive plunger pump or the like for raising the pressure of the fuel fed from the feed pump 24 to a predetermined high pressure, a common rail 26 communicated with and connected to each of the injectors 13, and a high pressure regulator 27 of a well-known mechanical pressure regulator for regulating the fuel pressure fed to the injectors 13 to a predetermined controlled fuel pressure (e.g., PfB=7 MPa) are provided sequentially from the upstream side.

A low-pressure fuel passage 21 *a* for transmitting the fuel from the fuel tank 22 by means of the feed pump 24 is formed upstream of the high pressure pump 25 in the fuel passage 21. A high-pressure fuel passage 21*b* for raising the pressure of the fuel fed from the low-pressure fuel passage 21*a* to feed a predetermined high pressure fuel to the respective injectors 13 is formed between the high pressure pump 25 and the high pressure regulator 27.

The low-pressure fuel passage 21*a* downstream of the feed pump 24 is communicated with the fuel tank 22 via a fuel return passage 21*c*. In the fuel return passage 21*c*, a low pressure regulator 28 of a diaphragm type pressure regulator or the like is provided for regulating the fuel pressure in the low-pressure fuel passage 21*a* to a predetermined pressure (e.g., 0.2 MPa).

As a low-pressure fuel system, the downstream side of the high pressure regulator 27 is connected to the fuel return passage 21*c* between the low-pressure fuel passage 21*a* downstream of the feed pump 24 and the low pressure regulator 28. Thus, it is possible to adopt a small capacity feed pump 24 by returning excessive fuel from the high pressure regulator 27 to the low-pressure fuel passage 21*a*.

On the other hand, a fuel by-pass passage 21*d* for by-passing the high pressure regulator 27 to establish the communication between the high pressure fuel system and the low-pressure fuel system is communicated with and connected to the high-pressure fuel passage 21*b* between the common rail 26 and the high pressure regulator 27. The fuel by-pass passage 21*d* is also communicated with and connected to the fuel return passage 21*c* upstream of the low pressure regulator 28. In the fuel by-pass passage 21*d*, a by-pass selector valve 29 of an electromagnetic selector valve as an example of opening/closing valve means is provided.

In a purge passage 21*e* for establishing the communication between the high-pressure fuel passage 21*b*, which is provided between the common rail 26 and the high pressure regulator 27, and the fuel return passage 21*c* provided downstream of the low pressure regulator 28, a vapor processing valve 30 of an electromagnetic selector valve is provided.

Sensors and so forth for detecting the engine operating condition will be described below.

An accelerator position sensor 31 of a potentiometer or the like is provided at the supporting portion of the accelerator pedal 9 for detecting the treading quantity (accelerator position) of the accelerator pedal 9 indicative of a required load as an example of an engine load.

A knock sensor 32 is mounted on the cylinder block 1*a* of the engine 1, and a cooling water temperature sensor 34 faces a cooling water passage 33 communicated with both of right and left banks of the cylinder block 1*a*. A fuel pressure sensor 35 is provided on the common rail 26 for detecting a fuel pressure Pf in the high-pressure fuel system fed to the injectors 13.

Upstream of the catalytic converter 19, a linear $O_2$ sensor 36 is provided as an example of an air-fuel ratio sensor for detecting an air-fuel ratio. As is well known, the linear $O_2$ sensor 36 has a linear output characteristic with respect to an air-fuel ratio, so that it is possible to directly detect the air-fuel ratio on the basis of the output value of the linear $O_2$ sensor.

A crank angle sensor 39 of an electromagnetic pickup or the like is provided so as to face the outer periphery of a crank rotor 38 pivotably mounted on a crank shaft 37 of the engine 1. A cylinder determining sensor 42 of an electromagnetic pickup or the like is provided so as to face a cam rotor 41 provided on a cam shaft 40 which rotates by ½ rotation with respect to the crank shaft 37.

Figure 21:
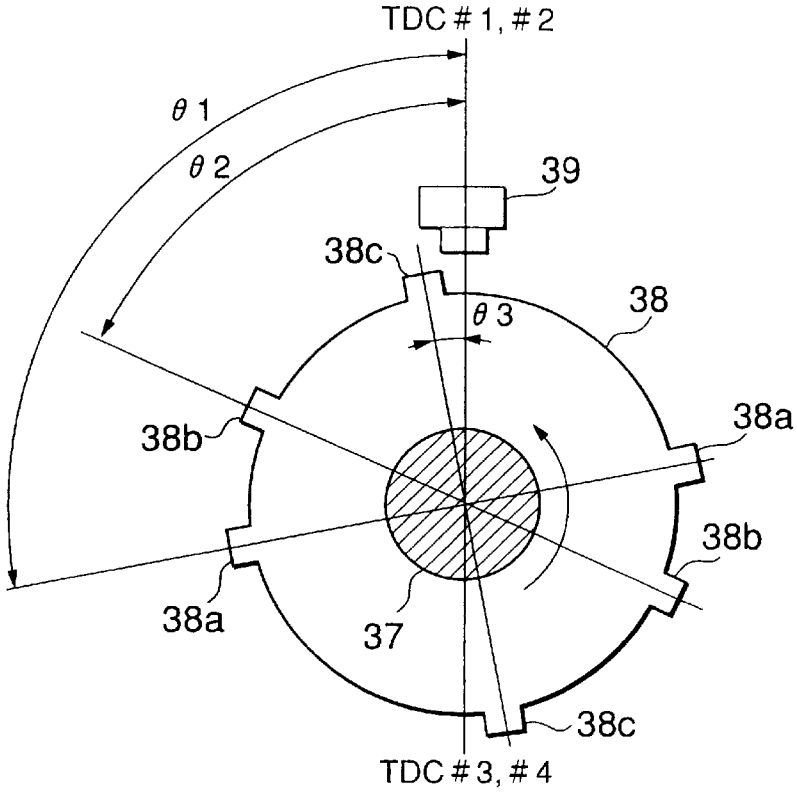
FIG. 21 is a front elevation of a crank rotor and a crank angle sensor in the first preferred embodiment of the present invention.

As shown in FIG. 21, the crank rotor 38 is formed with protrusions 38*a*, 38*b* and 38*c* on the outer periphery thereof.

These protrusions 38*a*, 38*b* and 38*c* are positioned at crank angles θ1, θ2 and θ3 before compression top dead centers (BTDC) for each of cylinders (cylinders #1, #2 and cylinders #3, #4). In this preferred embodiment, θ1=97° CA, θ2=65° CA and θ3=10° CA.

Figure 22:
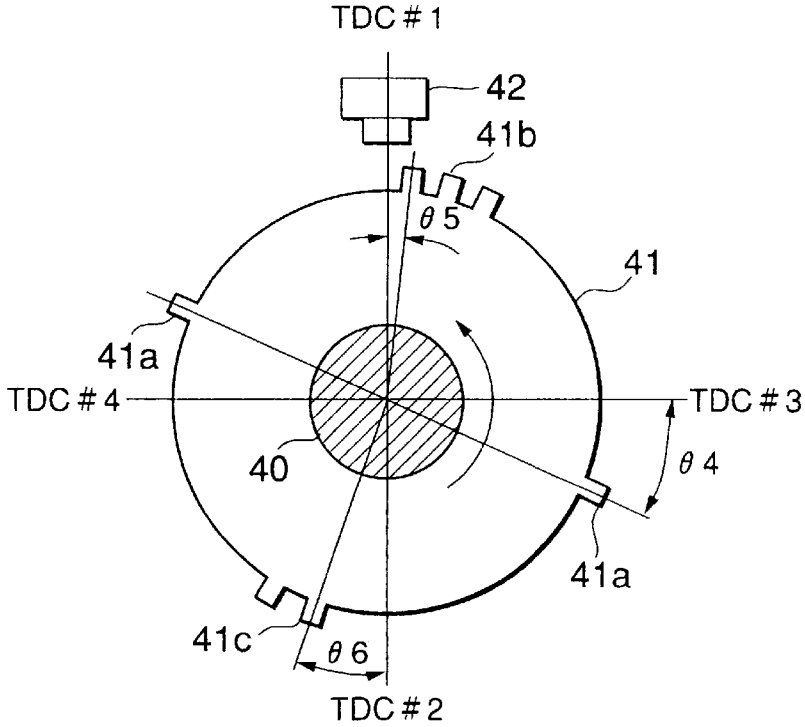
FIG. 22 is a front elevation of a cam rotor and a cylinder determining sensor in the first preferred embodiment of the present invention.

As shown in FIG. 22, the cam rotor 38 is provided with cylinder determining protrusions 41*a*, 41*b* and 41*c* on the outer periphery thereof. The protrusion 41*a* is positioned at a crank angle θ4 after compression top dead center (ATDC) of cylinders #3 and #4. The protrusion 41*b* comprises three protrusions, and the first protrusion is positioned at a crank angle ATDC θ5 of cylinder #1. The protrusion 41*c* comprises two protrusions, and the first protrusion is positioned at a crank angle ATDC θ6 of cylinder #2. In this preferred embodiment, θ4=20° CA, θ5=5° CA, and θ6=20° CA.

In accordance with the engine operation, the crank rotor 38 and the cam rotor 41 rotate with the crank shaft 37 and the cam shaft 40. The respective protrusions 38*a*, 38*b* and 38*c* of the crank rotor 38 are detected by the crank angle sensor 39. As shown in the time charts of FIGS. 14 and 15, crank pulses θ1, θ2 and θ3 (BTDC 97°, 65°, 10° CA) are outputted from the crank angle sensor 39 every ½ rotation of the engine (180° CA). On the other hand, the protrusions of the cam rotor 41 are detected by the cylinder determining sensor 42 between the crank pulses θ3 and θ1, and a predetermined number of cylinder determining pulses are outputted from the cylinder determining sensor 42.

As will be described later, an electronic control unit 50 (see FIG. 23) calculates an engine speed NE on the basis of an input interval between the respective crank pulses outputted from the crank angle sensor 39. The electronic control unit 50 also determines cylinders, such as a cylinder to be fuel-injected and a cylinder to be ignited, on the basis of a pattern of the combustion stroke sequence of the respective cylinders (cylinder #1→cylinder #2→cylinder #3→cylinder #4 in this preferred embodiment) and on the basis of the values obtained by counting the cylinder determining pulses outputted from the cylinder determining pulses by means of a counter.

Figure 23:
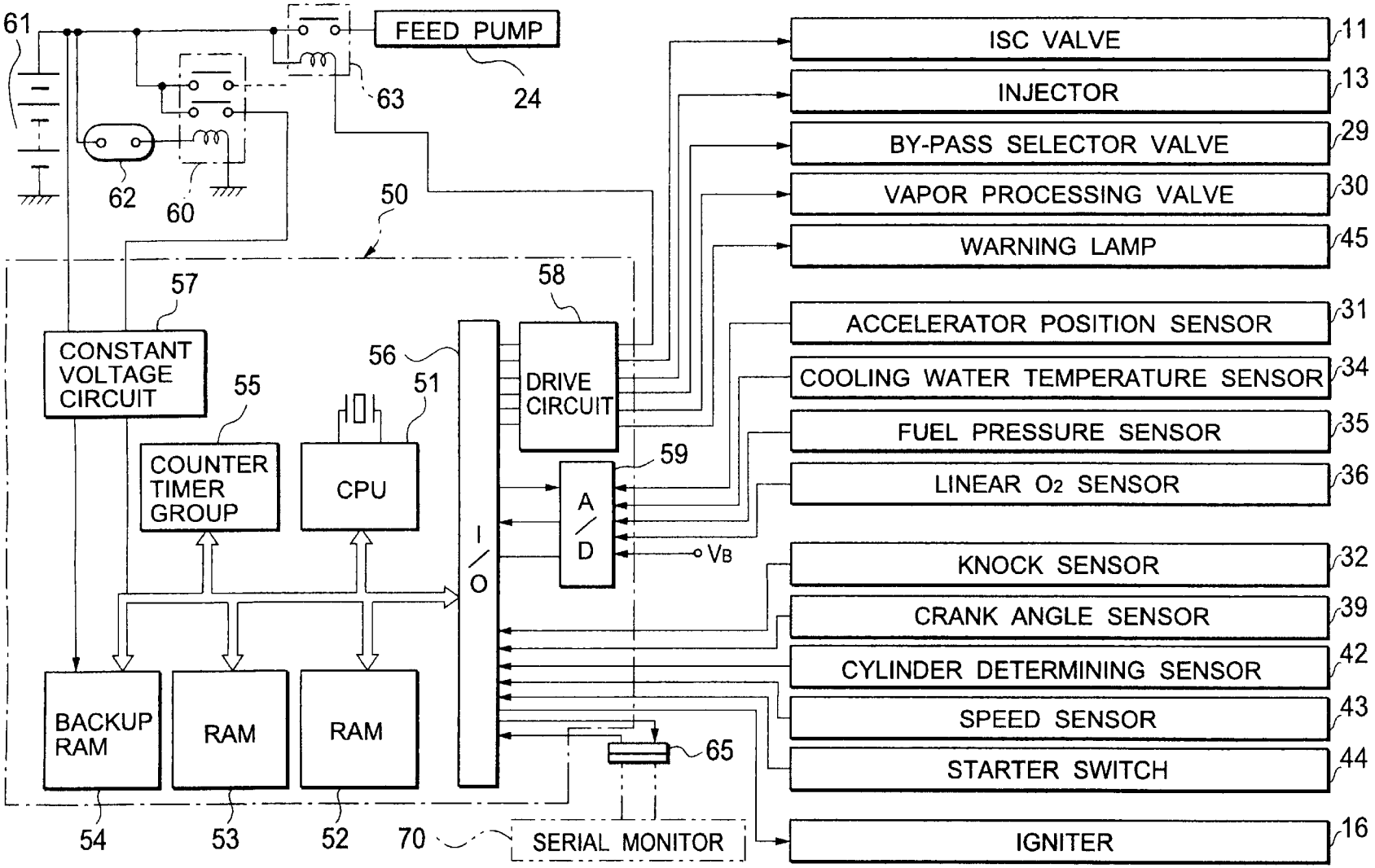
FIG. 23 is a circuit diagram of an electronic control system in the first preferred embodiment of the present invention.

The electronic control unit (ECU) 50 shown in FIG. 23 calculates the controlled variables of the injectors 13, the spark plugs 14 and the ISC valve 11, and performs various controls of the outputs of control signals, i.e., the engine controls such as fuel injection control, ignition timing control and idling speed control, the operation control of the feed pump 24, the opening/closing control of the by-pass selector valve 29, and the opening/closing control of the purge processing valve 30.

The ECU 50 generally comprises a microcomputer wherein a CPU 51, a ROM 52, a RAM 53, a backup RAM 54, a counter/timer group 55 and an I/O interface 56 are connected to each other via bus lines. The ECU 50 has, on board, various peripheral devices, such as a constant voltage circuit 57 for supplying stabilized power supply voltages to the respective parts, and a drive circuit 58 and an A/D converter 59 which are connected to the I/O interface 56.

Furthermore, the counter/timer group is a generic term, for convenience, for various counters, such as a free running counter and a counter for counting the inputs of cylinder determining sensor signals (cylinder determining pulses), and various timers, such as a timer for fuel injection, a timer for ignition, a timer for clocking the input interval of crank angle sensor signals (crank pulses) and a watch dog timer for monitoring the abnormality of the system. In addition, various software counters/timers are used.

The constant voltage circuit 57 is connected to a battery 61 via a first relay contact of a power supply relay 60 having two relay contacts of two circuits. The relay coil of the power supply relay 60 is connected to the battery 61 via an ignition switch 62. The constant voltage circuit 57 is also directly connected to the battery 61 so that power is supplied to the respective parts of the ECU 50 when the ignition switch 62 is turned ON to close the contact of the power supply relay 60 and so that backup power is always supplied to the backup RAM 54 regardless of the turning ON and OFF of the ignition switch 62. Moreover, the battery is connected to the feed pump 24 via the relay contact of a feed pump relay 63. A second relay contact of the power supply relay 60 is connected to a power supply line for supplying power from the battery 61 to respective actuators.

The input port of the I/O interface 56 is connected to the knock sensor 32, the crank angle sensor 39, the cylinder determining sensor 42, a speed sensor 43 for detecting a vehicular speed, and a starter switch 44 for detecting the engine starting condition. The input port of the I/O interface 56 is also connected, via the A/D converter 59, to the accelerator position sensor 31, the cooling water temperature sensor 34, the fuel pressure sensor 35 and the linear $O_2$ sensor 36. Moreover, a battery voltage VB is inputted to the input port of the I/O interface 56 to be monitored.

On the other hand, the output port of the I/O interface 56 is connected, via the drive circuit 58, to the ISC valve 11, the injectors 13, the by-pass selector valve 29, the vapor processing valve 30, a warning lamp 45 provided on an instrument panel (not shown) for the centralized display of various warning signals, and the relay coil of the feed pump relay. The output port of the I/O interface 56 is also connected to the igniter 16.

The I/O interface 56 is also connected to a connector 65 for external connection. When a serial monitor (a portable fault diagnosing apparatus) 70 is connected to the connector 65 for external connection, the serial monitor 70 can read the input/output data of the ECU 50, and trouble data indicative of fault sites and contents, which include a high-pressure fuel system NG flag FHPNG (which will be described later) indicative of the abnormality of the high-pressure fuel system stored in the backup RAM 54 by the self-diagnosis function of the ECU 50, to diagnose the high-pressure fuel system. Moreover, the serial monitor 70 can carry out the initial set (clear) of the trouble data.

The diagnosis and initial set of trouble data performed by the serial monitor 70 is described in detail in Japanese Patent Publication No. 7-76730 filed by the applicant of the present application.

The CPU 51 processes the detection signals inputted from sensor switches via the I/O interface 56 and the battery voltage inputted via the I/O interface 56, in accordance with a control program stored in the ROM 52, and calculates the fuel injection quantity, the fuel injection timing, the ignition timing, the duty ratio of a drive signal to the ISC valve 11, on the basis of various data stored in the ROM 53, various learned value data stored in the backup RAM 54 and fixed data stored in the ROM 52, to carry out engine controls, such as fuel injection control, ignition timing control and idling speed control, and various controls, such as operation control of the feed pump 24, opening/closing control of the by-pass selector valve 29 and opening/closing control of the purge processing valve 30.

In such a control system, the ECU 50 also monitors the behavior of the fuel pressure Pf in the high-pressure fuel system detected by the fuel pressure sensor 35, and the relationship between the air-fuel ratio A/F detected by the linear $O_2$ sensor 36 and the fuel injection pulse width Ti defining the injection-valve opening period of the injector 13. When meeting at least one of conditions that the behavior of the fuel pressure Pf is abnormal and that the air-fuel ratio A/F is incompatible with the fuel injection pulse width, the ECU 50 determines the abnormality of the high-pressure fuel system to turn the warning lamp 45 on to inform of the abnormality of the high-pressure fuel system and to set a high-pressure fuel system NG flag FHPNG indicative of the abnormality of the high-pressure fuel system to a predetermined address of the backup RAM 54.

That is, when the high pressure pump 25 or the high pressure regulator 27, which form the high-pressure fuel system, is abnormal or when the fuel leaks from the high-pressure fuel system, the fuel pressure Pf of the high pressure fuel fed to the injectors 13 can not be maintained at a predetermined controlled fuel pressure, so that the behavior of the fuel pressure Pf of the high-pressure fuel system is abnormal. In addition, when the injectors 13 is abnormal due to defective injection-valve opening or the like, it is not possible to obtain a desired fuel injection quantity, so that the air-fuel ratio A/F is incompatible with the fuel injection pulse width Ti defining the injection-valve opening period of the injectors 13.

Therefore, it is possible to accurately diagnose the abnormality of the high-pressure fuel system by determining the behavior of the fuel pressure Pf of the high-pressure fuel system and the relationship between the air-fuel ratio A/F and the fuel injection pulse width Ti defining the injection-valve opening period of the injectors 13.

More specifically, when the high-pressure fuel system is diagnosed, the ECU 50 determines the abnormality of the high-pressure fuel system if meeting at least one of conditions that the fuel pressure Pf of the high-pressure fuel system does not reach a predetermined pressure even if a predetermined period of time elapse after the engine is started, that the fuel pressure Pf of the high-pressure fuel system is not within the ordinary range of fuel pressure after the engine is started and that the fuel injection pulse width Ti continues to exceed a predetermined value for a predetermined period of time in the lean air-fuel ratio.

In addition, the diagnosed results of the high-pressure fuel system are reflected in the fuel injection control to carry out a fail safe control. That is, when the high-pressure fuel system is normal, the by-pass selector valve 29 is closed to prevent the fuel from leaking from the fuel by-pass passage 21*d* to supply the injectors 13 with a high pressure fuel, the pressure of which is raised by the high pressure pump 25 to be regulated to a predetermined controlled fuel pressure by the high pressure regulator 27. At this time, if the fuel injection pulse width Ti defining the fuel injection quantity for the injectors 13 is set on the basis of the engine operating condition in accordance with the controlled fuel pressure PfB defined by the high pressure regulator 27, it is possible to obtain a fuel injection quantity corresponding to a required injection quantity similar to conventional systems.

On the other hand, when the high-pressure fuel system is abnormal, the by-pass selector valve 29 is open to establish the communication between the high-pressure fuel system and the low-pressure fuel system via the fuel by-pass passage 21*d,* the low pressure fuel fed by the feed pump 24 to be regulated to a predetermined fuel pressure by the low pressure regulator 28 is directly fed to the high-pressure fuel system to be fed to the injectors 13. Then, the fuel injection pulse width Ti defining the fuel injection quantity for the injectors 13 is set on the basis of the engine operating condition in accordance with the pressure of the low pressure fuel, the pressure of which is regulated by the low pressure regulator 28.

That is, when the pressure of the high pressure fuel of the high-pressure fuel system does not reach the predetermined controlled fuel pressure PfB due to the abnormality of the high pressure pump 25 or the high pressure regulator 27, which form the high-pressure fuel system, or due to the fuel leakage of the high-pressure fuel system, or when the fuel pressure Pf of the high-pressure fuel system is abnormally raised due to the abnormality of the high pressure regulator 27 such as the enclosed fixing, the by-pass selector valve 29 is closed to feed the low pressure fuel of the low-pressure fuel system directly to the high-pressure fuel system to feed the fuel to the injectors 13 independent of the high pressure fuel from the high pressure pump 25 and the high pressure regulator 27. Since the fuel injection pulse width Ti for the injectors 13 is set so as to obtain a predetermined fuel injection quantity under the pressure of the low pressure fuel, even if the abnormality of the high-pressure fuel system occurs, the injection-valve opening period of the injectors 13 can be controlled by the fuel injection pulse width Ti so as to be coincident with a required injection quantity, so that the difference between the fuel injection quantity actually injected from the injectors 13 and the required injection quantity can be reduced to inhibit the deterioration of the controllability of fuel injection.

Therefore, since the deterioration of the controllability of fuel injection is inhibited even if the abnormality of the high-pressure fuel system occurs, it is possible to prevent the engine from being damaged by the deterioration of the combustion state in the engine to continue the operation of the engine.

In addition, at this time, the low pressure fuel is fed from the low-pressure fuel system to the high-pressure fuel system at this time, so that the load of the high pressure pump 25 due to the compression of the fuel is reduced, and the high pressure regulator 27 is in the inoperative state. For example, even if the high pressure pump 25 or the high pressure regulator 27 is abnormal, it is possible to inhibit the degree of the abnormality from progressing to prevent the engine from being fatally damaged.

In addition, when the defective injection-valve opening occurs in the injectors 13 as the abnormality of the high-pressure fuel system, the low pressure fuel is fed to the injectors 13, so that the injection-valve opening load against the fuel pressure of the injectors 13 is reduced. Therefore, it is possible to ensure the controllability of fuel injection to some extent, so that it is also possible to inhibit the deterioration of the controllability of fuel injection in this case.

Moreover, when the fuel leaks from the high-pressure fuel system as the abnormality of the high-pressure fuel system, the low pressure fuel is fed to the high-pressure fuel system to reduce the fuel pressure of the high-pressure fuel system, so that it is possible to inhibit the fuel from leaking from at least the high-pressure fuel system.

More specifically, in this preferred embodiment, the ECU 50 diagnoses the abnormality of the high-pressure fuel system. On the basis of the engine operating condition, the ECU 50 selects the stratified combustion based on the late injection during low engine speeds with low loads, and the uniform premixed combustion based on the early injection during high engine speeds with high loads. When the high-pressure fuel system is normal, the by-pass selector valve 29 is closed to supply the injector with a high pressure fuel, the pressure of which has been raised by the high pressure pump 25 to be regulated to a predetermined controlled fuel pressure by the high pressure regulator 27.

When the high-pressure fuel system is normal and when the stratified combustion is selected, the fuel injection pulse width Ti defining the fuel injection quantity adapted to the stratified combustion for the injectors 13 is set on the basis of the engine operating condition so as to be coincident with the controlled fuel pressure PfB defined by the high pressure regulator 27, and the fuel injection timing is set in the compression stroke for a cylinder to be injected. Moreover, the ignition timing adapted to the stratified combustion is set on the basis of the engine operating condition. Thus, during low engine speeds with low loads, the stratified combustion is carried out to improve the exhaust emission and fuel consumption.

In addition, when the high-pressure fuel system is normal and when the uniform premixed combustion is selected, the fuel injection pulse width Ti defining the fuel injection quantity adapted to the uniform premixed combustion for the injectors 13 is set on the basis of the engine operating condition so as to be coincident with the controlled fuel pressure PfB defined by the high pressure regulator 27, and the fuel injection timing is set in the exhaust stroke end or intake stroke for a cylinder to be injected. Moreover, the ignition timing adapted to the uniform premixed combustion is set on the basis of the engine operating condition. Thus, during high engine speeds with high loads, the uniform premixed combustion is carried out to improve the engine output.

On the other hand, when the high-pressure fuel system is abnormal, the by-pass selector valve 29 is open so that the low pressure fuel of the low-pressure fuel system is fed directly to the high-pressure fuel system to be fed to the injectors 13. Then, when the high-pressure fuel system is abnormal, the fuel injection pulse width Ti adapted to the uniform premixed combustion is set on the basis of the engine operating condition so as to be coincident with the pressure of the low pressure fuel regulated by the low pressure regulator 28. At this time, if the fuel injection timing and ignition timing adapted to the uniform premixed combustion are set on the basis of the engine operating condition, the uniform premixed combustion based on the early injection is carried out regardless of the selected combustion system.

Figure 16:
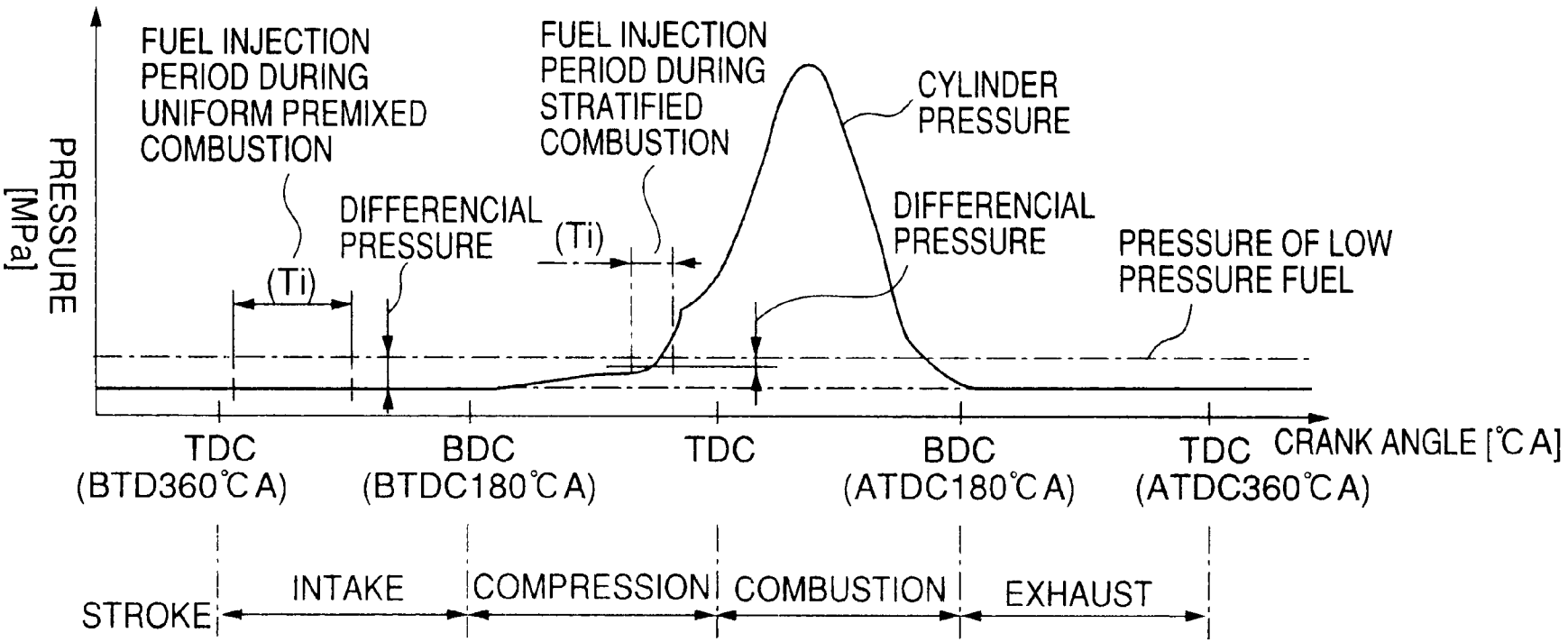
FIG. 16 is a timing chart showing the relationship between the pressure of a low pressure fuel and a cylinder pressure in the first preferred embodiment of the present invention.

When the high-pressure fuel system is abnormal, if the fuel injection timing is set in the compression stroke so as to be coincident with the stratified combustion as shown in FIG. 16 in order to feed the low pressure fuel of the low-pressure fuel system to the injectors 13 to inject the low pressure fuel into the cylinder (the combustion chamber 12), it is not possible to sufficiently ensure the differential pressure between the pressure of the low pressure fuel injected from the injector 13 and the cylinder pressure, and it is not possible to accurately measure the fuel injection quantity by the injection-valve opening timing of the injector 13 based on the fuel injection pulse width Ti, so that the controllability of fuel injection deteriorates. Therefore, at this time, the fuel injection quantity can be accurately measured by the injection-valve opening period of the injector 13 on the basis of the fuel injection pulse width Ti to prevent the deterioration of the controllability of fuel injection by carrying out the uniform premixed combustion wherein the fuel injection timing is set in the exhaust stroke end or intake stroke wherein the differential pressure between the pressure of the low pressure fuel and the cylinder pressure is sufficiently ensured.

That is, the ECU 50 can achieve the respective functions of diagnosing means, opening/closing valve control means, fuel injection control means, combustion system selecting means and ignition timing control means according to the present invention.

Referring to the flow charts of FIGS. 3 through 13, a control process executed by the ECU 50 according to the present invention will be described.

First, the ignition switch 62 is turned ON. When a power supply is inputted to the ECU 50, the system is initialized, and the respective flags and counters are initialized, except for data such as various learned values stored in the backup RAM 54.

When the system initialization of the ECU 50 is carried out, the ECU 50 outputs a drive signal to the vapor processing valve 30 to open the vapor processing valve 30 so that the high-pressure fuel passage 21*b* between the common rail 26 and the high pressure regulator 27 is communicated with the fuel return passage 21*c* downstream of the low pressure regulator 28 via the purge passage 21*e*. In addition, the feed pump relay 63 is turned ON to energize the feed pump 24 to start the operation of the feed pump 24.

Thus, the fuel in the fuel tank 22 is fed to the feed pump 24 via the filter 23.

In addition, when the system initialization of the ECU 50 is carried out, the by-pass selector valve 29 is closed to block the communication between the low-pressure fuel system and the high-pressure fuel system via the fuel by-pass passage 21*d*. Furthermore, after the system initialization, the by-pass selector valve 29 is open and closed in accordance with the diagnosed results of the abnormality of the high-pressure fuel system on the basis of a by-pass selector valve control routine shown in FIG. 5 which will be described later.

The fuel fed by the feed pump 24 is regulated by the low pressure regulator 28 to be fed to the high pressure pump 25, and the excessive fuel is returned from the low pressure regulator 28 to the fuel tank 22 via the fuel return passage 21*c*.

At this time, the engine 1 is not yet started and the high pressure pump 25 is stopped. The high pressure pump 25 comprises the engine drive plunger pump or the like as described above, and each of the inlet and discharge ports thereof has a check valve (not shown), by which the fuel flows into the high-pressure fuel passage 21*b* via the high pressure pump 25. When the vapor processing valve 30 is open so that the high-pressure fuel passage 21*b* between the common rail 26 and the high pressure regulator 27 is communicated with the fuel return passage 21*c* downstream of the low pressure regulator 28 via the purge passage 21*e*, the fuel is returned from the high-pressure fuel passage 21*b* to the fuel tank 22 via the purge passage 21*e* and the fuel return passage 21*c*.

Therefore, even if vapor is generated in the fuel feed system, the vapor is discharged into the fuel tank 22. Thus, it is possible to prevent the controllability of fuel injection from deteriorating due to the vapor to be ready for the starting of the engine 1.

Then, when the starter switch 44 is turned ON to start the engine 1, the ECU 50 closes the vapor processing valve 30 in response to the turning ON of the starter switch 44, and thereafter, blocks the communication between the high-pressure fuel system and the fuel tank 22 via the purge passage 21*e*. Then, the high pressure pump 25 is driven by the starting of the engine 1 to pressurize the fuel fed from the feed pump 24, and the vapor processing valve 30 is open to allow the high pressure regulator 27 to regulate the pressure of the fuel, so that a predetermined high-pressure fuel regulated by the high pressure regulator 27 is fed to the injector 13 for each cylinder via the common rail 26.

Figure 1A:
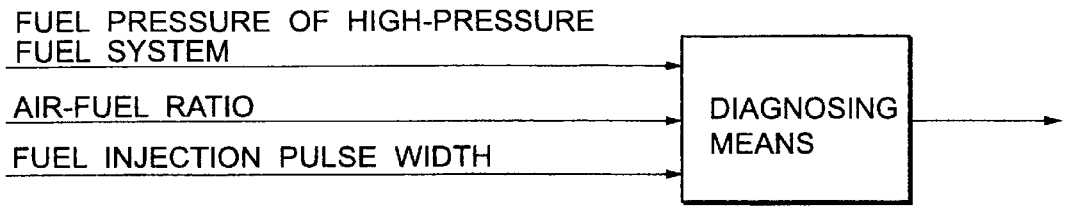
FIGS. 1*a*–1*c* are basic block diagrams of the present invention.
Figure 1B:
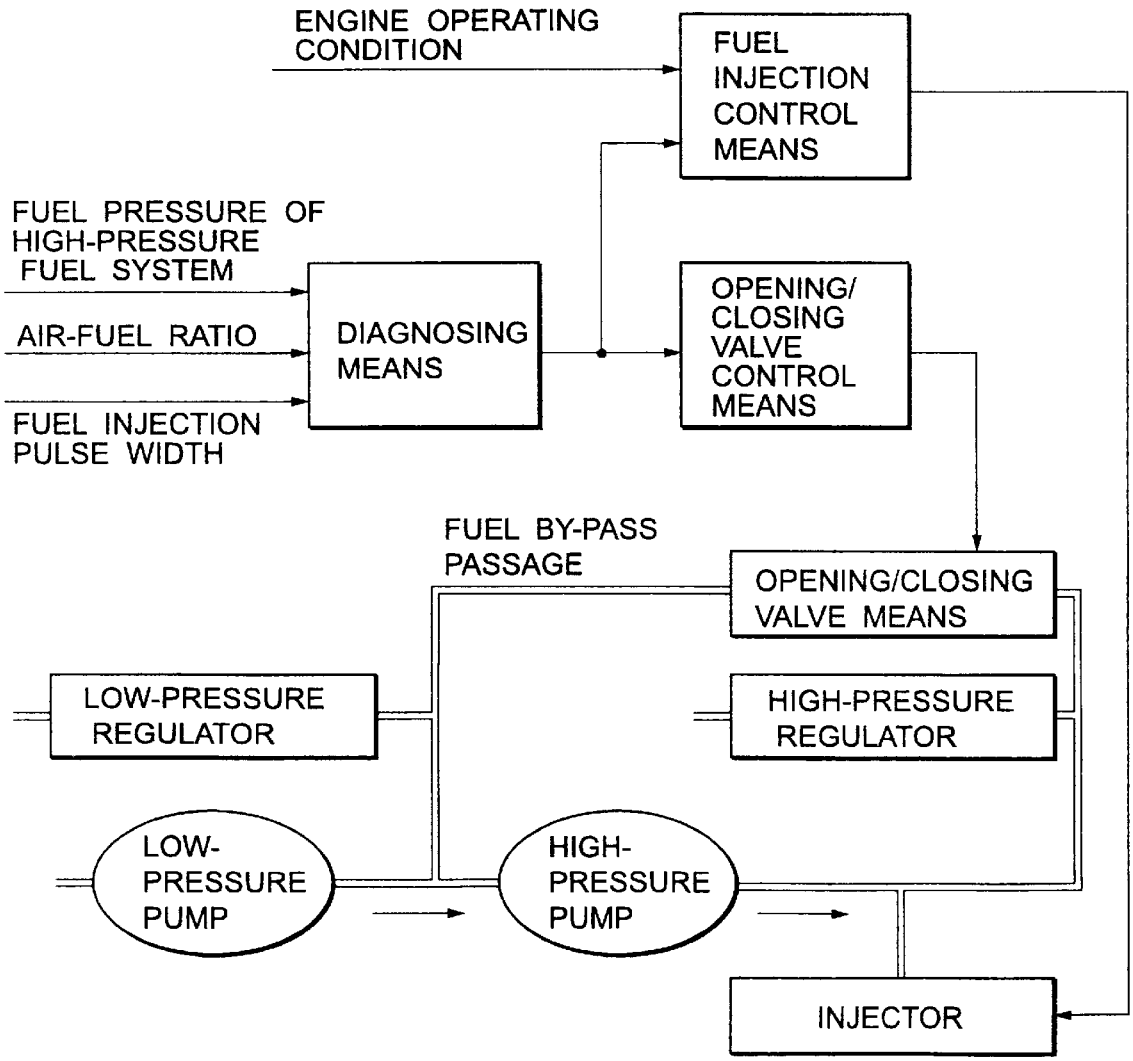
Figure 1C:
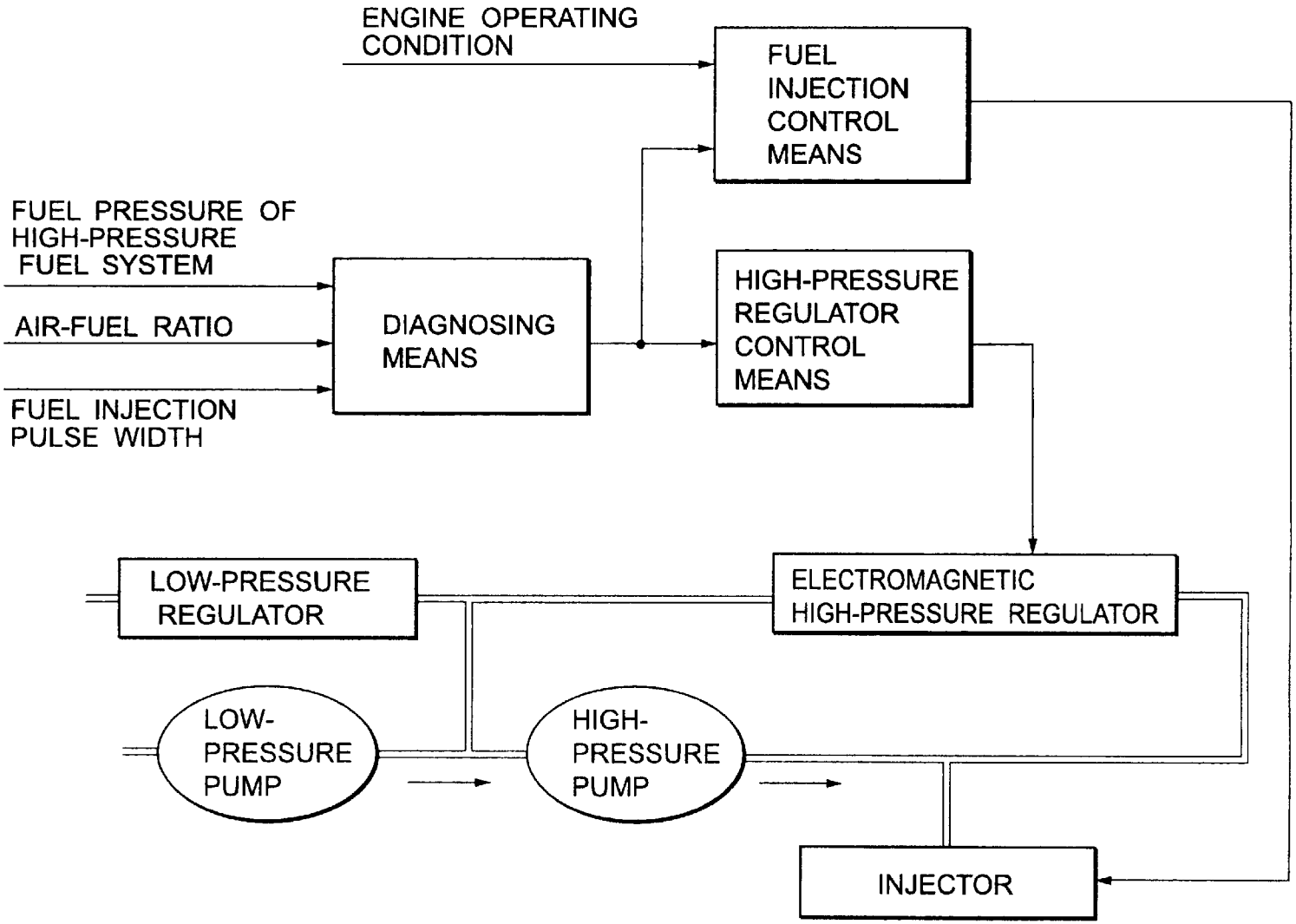
Figure 2A:
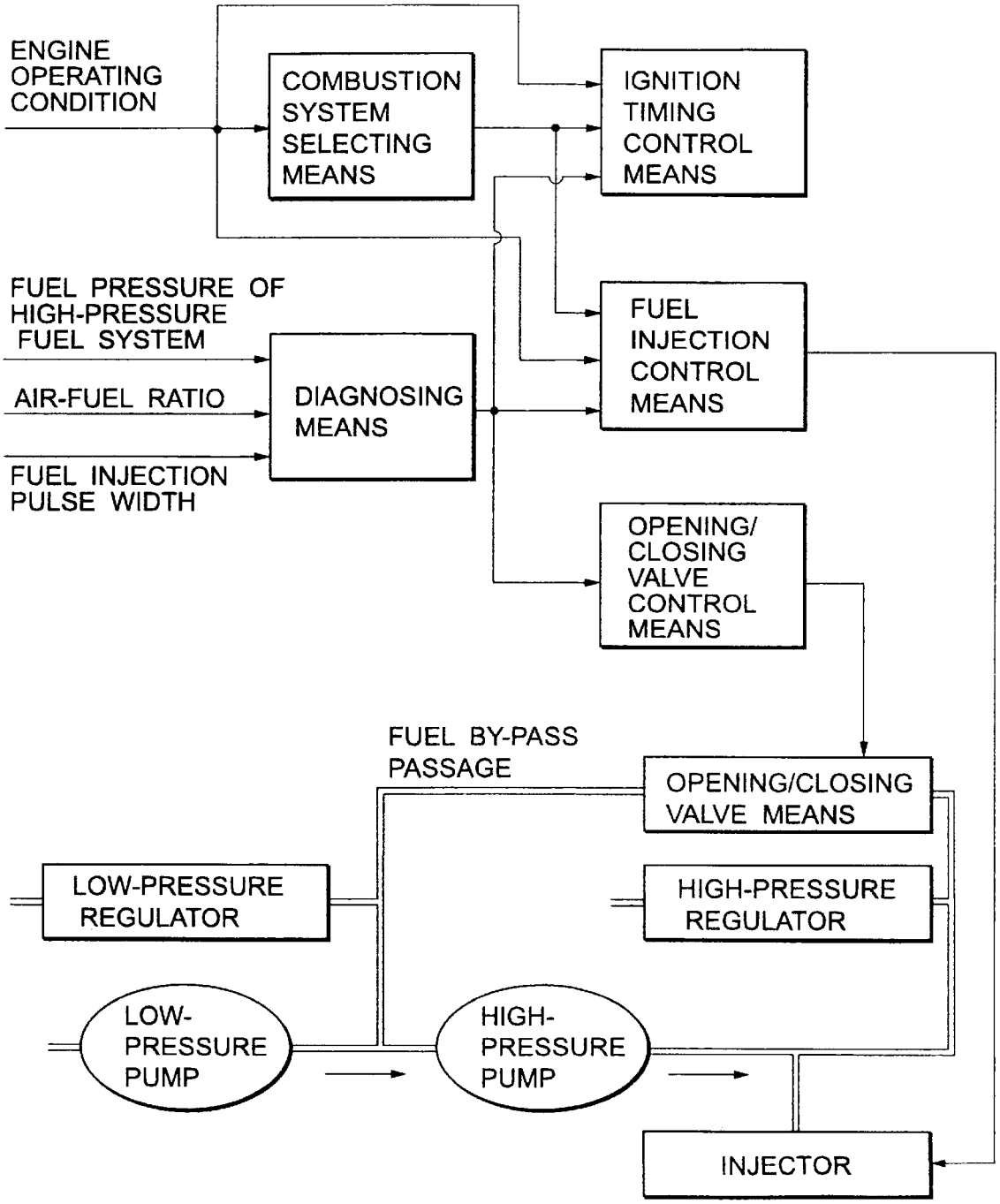
FIGS. 2*a* and 2*b* are basic block diagrams of the present invention (continued from FIGS. 1*a*–1*c;*
Figure 2B:
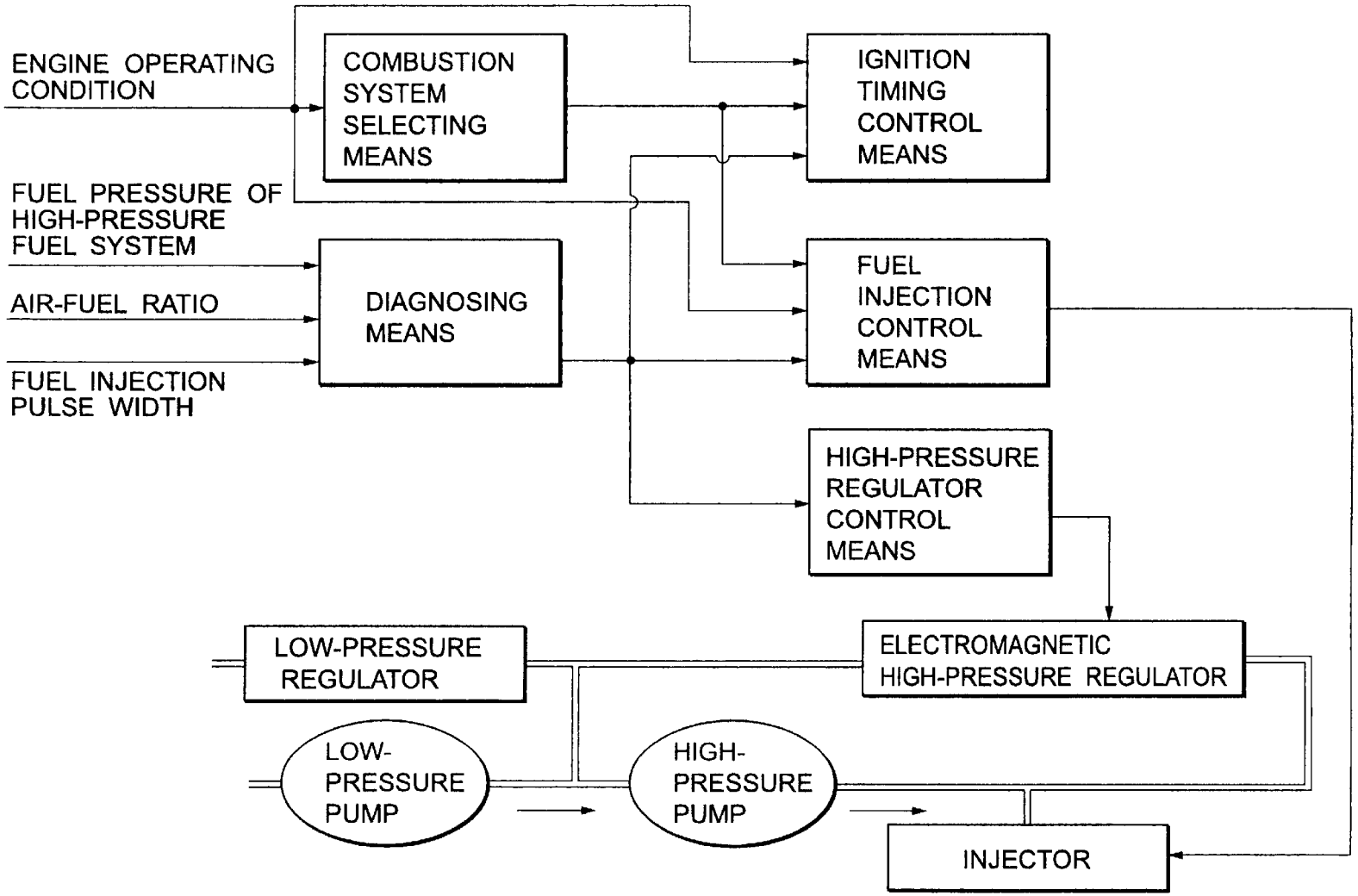
Figure 3:
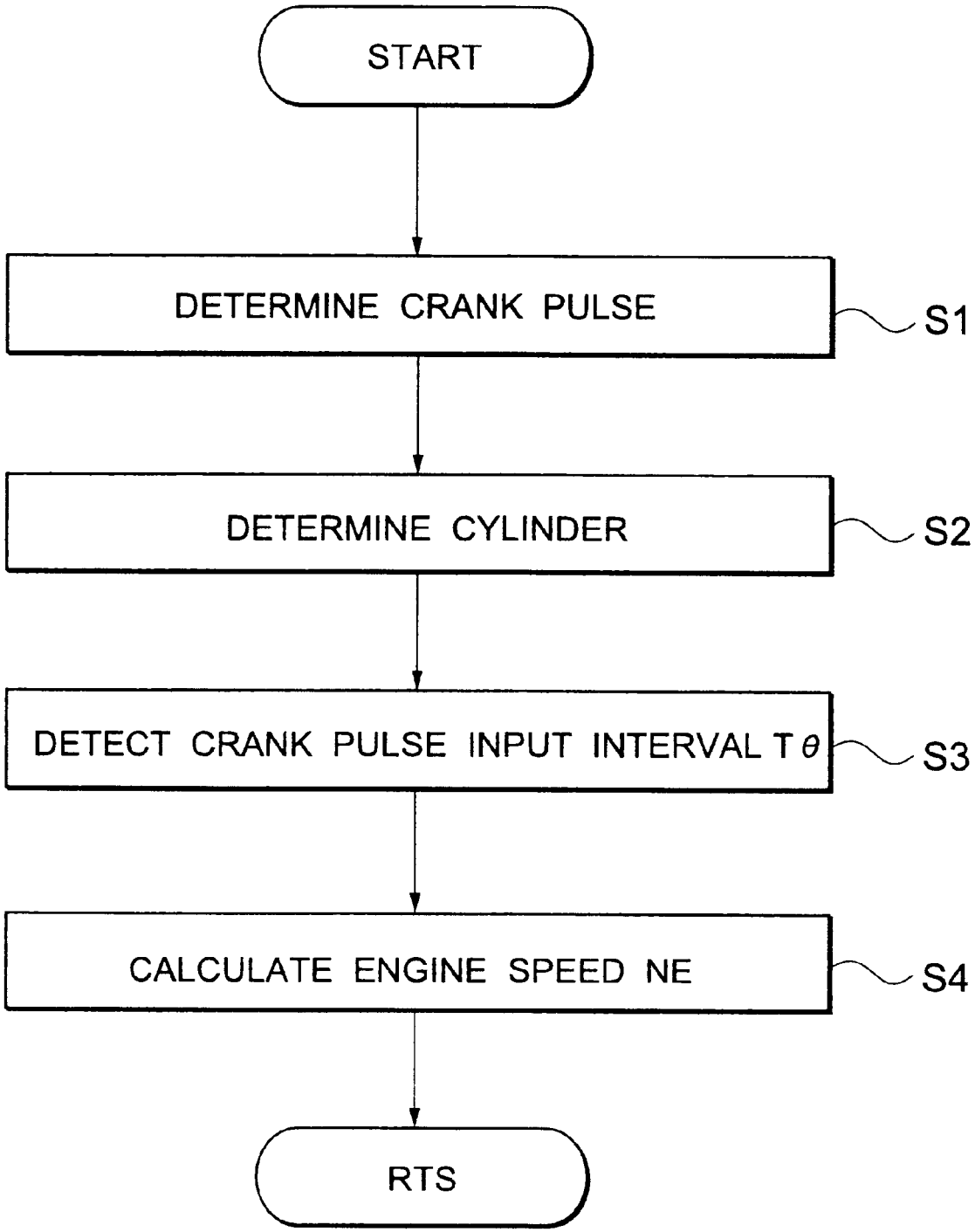
FIG. 3 is a flow chart of a cylinder determining/engine speed calculating routine in the first preferred embodiment of the present invention.

In addition, when the starter switch 44 is turned ON to stat the engine 1, a cylinder determining/engine speed calculating routine shown in FIG. 3 is executed each time a crank pulse is inputted from the crank angle sensor 39.

In this cylinder determining/engine speed calculating routine, when the crank rotor 38 rotates in accordance with the engine operation to input a crank pulse from the crank angle sensor 39, it is first determined on the basis of the input pattern of the cylinder determining pulse from the cylinder determining sensor 42 at step S1 which crank angle θ1, θ2 or θ3 the presently inputted crank pulse corresponds to.

Then, at step S2, the determination of a cylinder, such as a cylinder to be ignited and a cylinder to be injected, is carried out on the basis of the input pattern of the crank pulse and the cylinder determining pulse and on the basis of the combustion stroke sequence of the respective cylinders (cylinder #1→cylinder #3→cylinder #2→cylinder #4 in this preferred embodiment).

Figure 14:
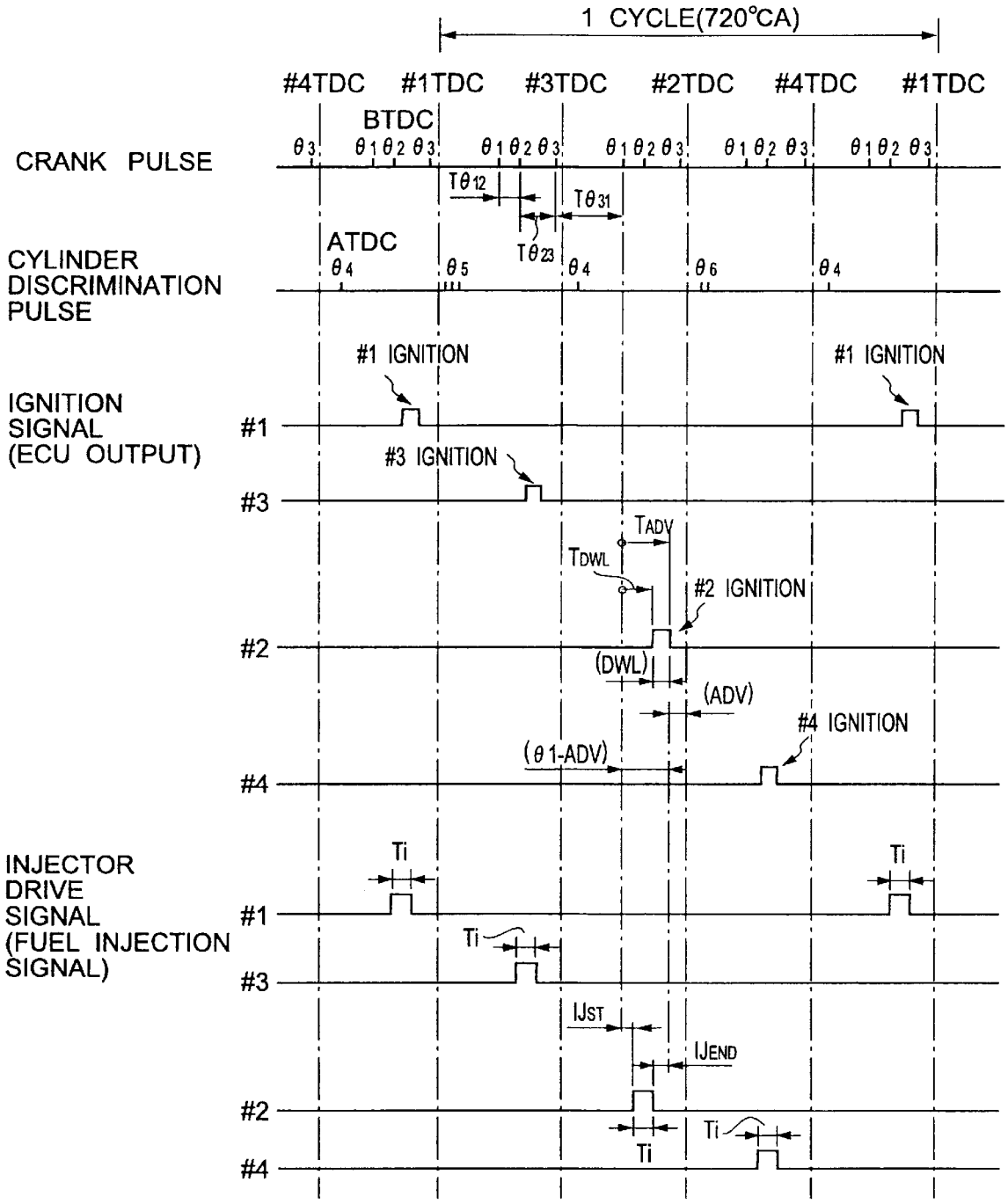
FIG. 14 is a time chart showing the relationship between crank pulses, cylinder determining pulses, ignition signals during the stratified combustion, and injector drive signals in the first preferred embodiment of the present invention.
Figure 15:
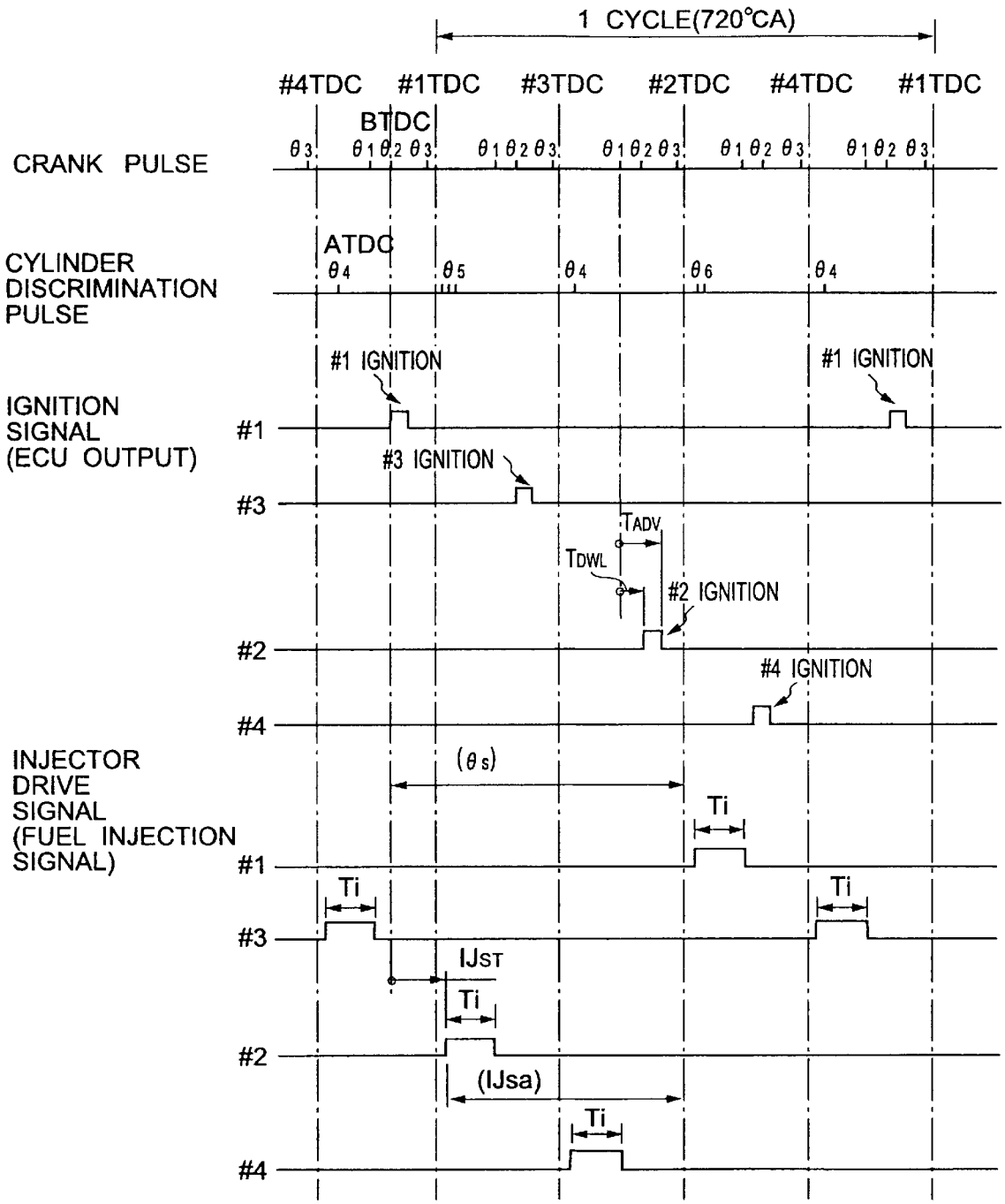
FIG. 15 is a time chart showing the relationship between crank pulses, cylinder determining pulses, ignition signals during the uniform premixed combustion, and injector drive signals in the first preferred embodiment of the present invention.

That is, as shown in time charts of FIGS. 14 and 15, for example, if a cylinder determining pulse is inputted before the current crank pulse is inputted after the last crank pulse is inputted, it can be determined that the current crank pulse is a crank pulse θ1 and the next inputted crank pulse is a crank pulse θ2.

In addition, when no cylinder determining pulse is inputted between the last and current inputs of crank pulses and when a cylinder determining pulse is inputted between the crank pulse input before last and the last crank pulse input, it can be determined that the current crank pulse is the crank pulse θ2 and the next inputted crank pulse is a crank pulse θ3. When no cylinder determining pulse is inputted between the last and current inputs of crank pulses and between the crank pulse input before last and the last crank pulse input, it can be determined that the currently inputted crank pulse is the crank pulse θ3 and the next inputted crank pulse is the crank pulse θ1.

Moreover, when three cylinder determining pulses (a cylinder determining pulse θ5 corresponding to the protrusion 41*b*) are inputted between the inputs of the last and current crank pulses, the cylinder #3 is positioned at a crank angle of the next compression top dead center, and it can be determined that the cylinder to be ignited is the cylinder #3.

FIG. 14 shows a time chart during the stratified combustion, and FIG. 15 shows a time chart during the uniform premixed combustion. In the stratified combustion as shown in FIG. 14, it is required to carry out the fuel injection into a corresponding cylinder in a compression stroke and to complete the fuel injection immediately before ignition. In the uniform premixed combustion as shown in FIG. 15, it is possible to carry out the fuel injection into a corresponding cylinder in an exhaust stroke end or intake stroke since ignition is carried out after the injected fuel is sufficiently diffused in the combustion chamber (cylinder) 12 to be uniformly mixed with air.

In this preferred embodiment, since the fuel injection is started for the corresponding cylinder at a position of BTDC 380° CA of the corresponding cylinder at the maximum during the uniform premixed combustion, it is required to identify a cylinder to be injected before the position of BTDC 380° CA. For that reason, a cylinder #i to be injected is determined on the basis of the cylinder determination results when the crank pulse θ2 inputted at a position of BTDC 425° CA for the corresponding cylinder is inputted and on the basis of the combustion stroke sequence of the respective cylinders (cylinder #1→cylinder #3→cylinder #2→cylinder #4 in this preferred embodiment).

That is, if the current determined cylinder (a cylinder at a position of the next compression top dead center) is the cylinder #3 when the crank pulse θ2 is inputted, it is determined that the cylinder #2 is a cylinder #i to be injected when the stratified combustion is selected (see FIG. 14) and that the cylinder #4 is a cylinder #i to be injected when the uniform premixed combustion is selected (see FIG. 15).

On the other hand, when two cylinder determining pulses (cylinder determining pulses θ6 corresponding to the protrusion 41*c*) are inputted between the last and current inputs of crank pulses, the cylinder #4 is positioned at the next compression top dead center, so that it can be determined that the cylinder to be ignited is the cylinder #4. If the determined cylinder is the cylinder #4 when the crank pulse θ2 is inputted, it is determined that the cylinder #1 is the next cylinder #i to be injected when the stratified combustion is selected and that the cylinder #3 is the next cylinder #i to be injected when the uniform premixed combustion is selected.

In addition, when one cylinder determining pulse (a crank pulse θ4 corresponding to the protrusion 41*a*) is inputted between the last and current inputs of crank pulses and when the last determined cylinder at a position of the compression top dead center is the cylinder #4, it can be determined that the cylinder #1 is positioned at the next compression top dead center and the cylinder #1 is the next cylinder #i to be injected. If the determined cylinder is the cylinder #1 when the crank pulse θ2 is inputted, it is determined that the cylinder #3 is the next cylinder #i to be injected when the stratified combustion is selected and that the cylinder #2 is the next cylinder #i to be injected when the uniform premixed combustion is selected.

Similarly, when one cylinder determining pulse is inputted between the last and current inputs of crank pulses and when the last determined cylinder at a position of the compression top dead center is the cylinder #3, the cylinder #2 is positioned at the next compression top dead center, so that it can be determined that the cylinder to be ignited is the cylinder #2. If the determined cylinder is the cylinder #2 when the crank pulse θ2 is inputted, it is determined that the cylinder #4 is the next cylinder #i to be injected when the stratified combustion is selected and that the cylinder #1 is the next cylinder #i to be injected when the uniform premixed combustion is selected.

Thereafter, the routine goes to step S3 wherein a period of time between the last and current inputs of crank pulses, i.e., a crank pulse input interval (an input interval Tθ12 between θ1 crank pulse and θ2 crank pulse, an input interval Tθ23 between the crank pulse θ2 and the crank pulse θ3, or an input interval Tθ31 between the crank pulse θ3 and the crank pulse θ1), which is clocked by the timer for clocking the crank pulse input interval, is read out, and a crank pulse input interval Tθ is detected.

Then, the routine goes to step S4 wherein an angle between crank pulses corresponding to the currently determined crank pulse is read out, and an engine speed NE is calculated on the basis of the angle between crank pulses and the crank pulse input interval Tθ to be stored in the RAM 53 at a predetermined address. Then, the routine ends.

Furthermore, the angle between crank pulses is known to be previously stored in the ROM 52 as fixed data. In this preferred embodiment, the angle θ12 between the crank pulse θ1 and the crank pulse θ2 is 32° CA, the angle θ23 between the crank pulse θ2 and the crank pulse θ3 is 55° CA, and the angle θ31 between the crank pulse θ3 and the crank pulse θ1 is 93° CA.

Figure 4:
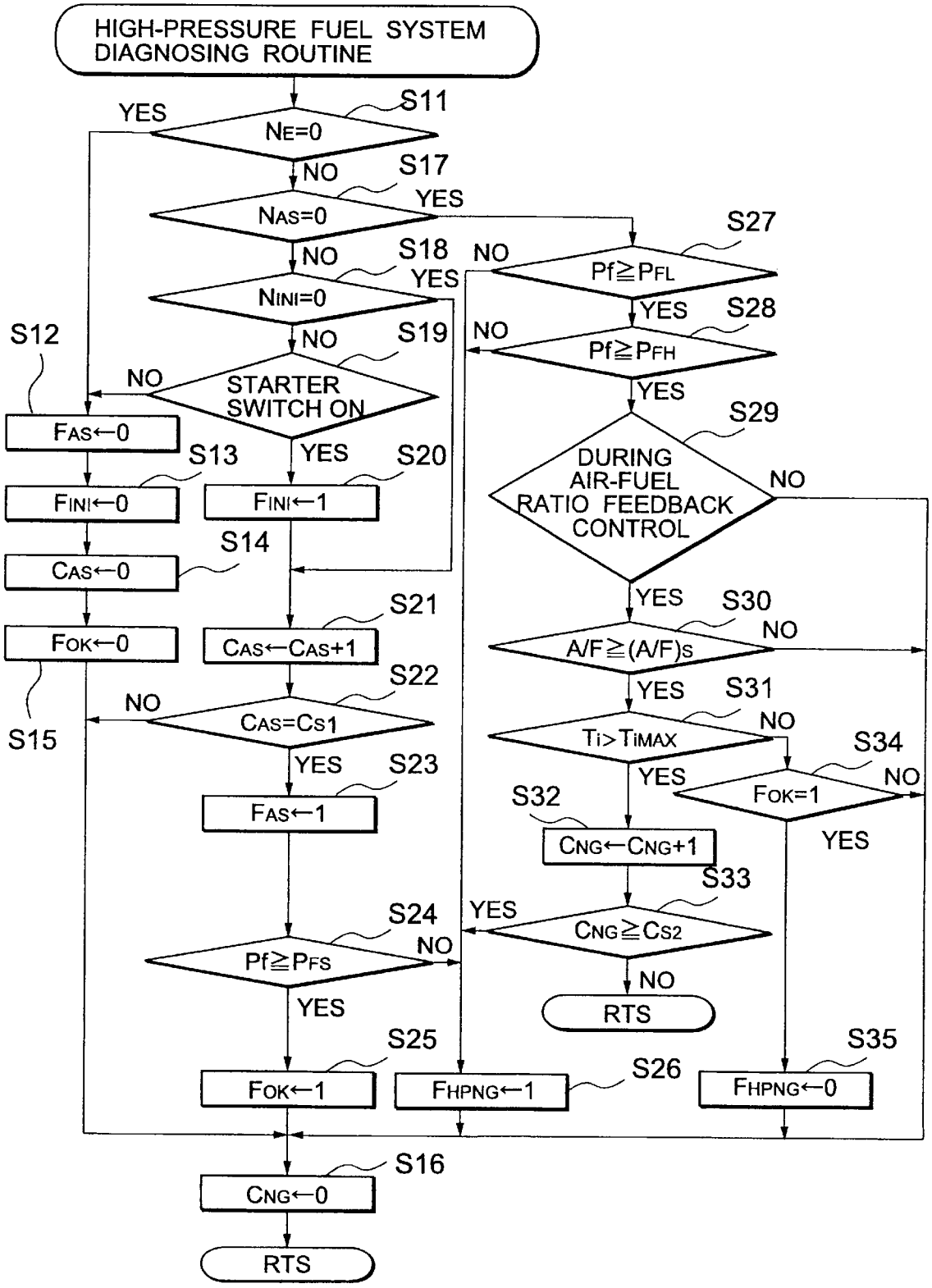
FIG. 4 is a flow chart of a high-pressure fuel system diagnosing routine in the first preferred embodiment of the present invention.

After the system initialization is carried out, a high-pressure fuel system diagnosing routine shown in FIG. 4 is executed every a predetermined period of time (e.g., 10 msec) to carry out the fault diagnosis for the high-pressure fuel system. Then, in a by-pass selector valve control routine shown in FIG. 5 which is executed every a predetermined period of time, the by-pass selector valve 29 is closed when the high-pressure fuel system is normal and open when the high-pressure fuel system is abnormal, in accordance with the diagnosed results for the high-pressure fuel system.

Figure 6:
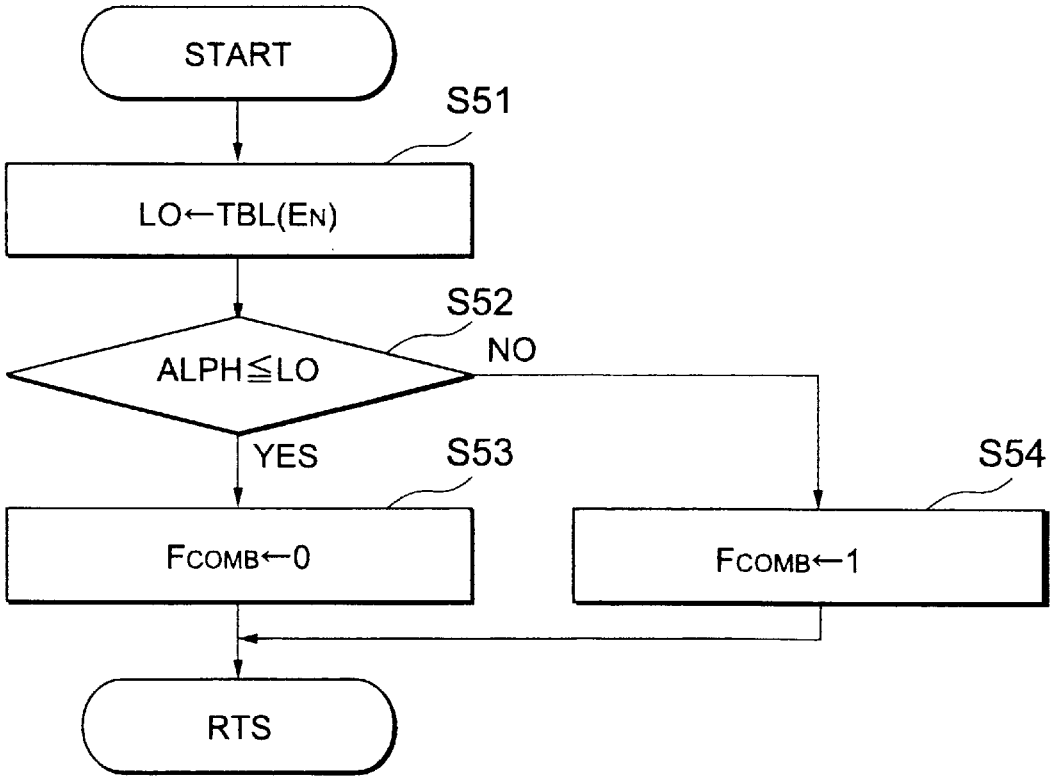
FIG. 6 is a flow chart of a combustion system selecting routine in the first preferred embodiment of the present invention.

In addition, in a combustion system selecting routine of FIG. 6, the engine speed NE is read out to be used for selecting a combustion system. Then, in an ignition control routine of FIG. 7 and a fuel injection control routine of FIG. 8, the engine speed NE, the diagnosed results for the high-pressure fuel system, and the selected results for the combustion system are read out to be used for determining the combustion system and for setting the ignition timing, the fuel injection pulse width and the fuel injection timing.

The high-pressure fuel system diagnosing routine of FIG. 4 will be described below. First, at step S11, a stall determination is carried out by the engine speed NE.

In this preferred embodiment, when meeting at least one of conditions that (1) the fuel pressure Pf of the high-pressure fuel system does not reach a predetermined pressure even if a predetermined period of time elapses after the engine is started, (2) the fuel pressure Pf of the high-pressure fuel system is not within the ordinary range of fuel pressure after the engine is started, and (3) the fuel injection pulse width Ti continues to exceed a predetermined value for a predetermined period of time in the lean air-fuel ratio, it is determined that the high-pressure fuel system is abnormal. In addition, when meeting all the conditions (1) through (3), it is determined that the high-pressure fuel system is normal.

When NE=0, i.e., when a stall occurs, the high pressure pump is not operated, and the fuel injection is not carried out, so that it is not possible to diagnose the abnormality of the high-pressure fuel system. Therefore, in this case, the routine goes from step S11 to step S12 without diagnosing the high-pressure fuel system. At steps S12 through S15, an initial diagnosis end flag FAS, which is set at the end of the abnormality diagnosis of the high-pressure system due to the behavior of fuel pressure immediately after the engine start-up, i.e., the initial diagnosis, a starter switch ON determination end flag FINI, which is set when the starter switch 44 is turned ON, a time counting value CAS after the engine start-up for clocking the time after the engine start-up based on the turning ON of the starter switch 44, and an initial diagnosis OK flag FOK, which is set when it is determined by the initial diagnosis immediately after the engine start-up that the high-pressure fuel system is normal, are cleared, respectively (FAS←0, FINI←0, CAS←0, FOK→0). Then, at step S16, an abnormality continuing time counting value CNG for clocking the continuing time that the fuel injection pulse width Ti continues to exceed a predetermined value in the lean air-fuel ratio is cleared (CNG←0), and the routine ends to be ready for the fault diagnosis for the high-pressure fuel system, which is executed after the engine is started.

On the other hand, when it is determined at step S11 that NE≠0, the routine goes to step S17 wherein it is determined on the basis of the reference to the initial diagnosis end flag FAS whether the initial diagnosis based on the behavior of the fuel pressure Pf of the high-pressure fuel system immediately after the engine start-up is completed.

When FAS=0, i.e., when the initial diagnosis is not yet completed after the engine start-up, the routine goes to step S18. At steps S18 through S26, the abnormality of the high-pressure fuel system due to the above described condition (1) is diagnosed by comparing the fuel pressure Pf of the high-pressure fuel system a predetermined period of time after the engine start-up with a predetermined value.

At step S18, the reference to the starter switch ON determination end flag FINI is made. When FINI=0, i.e., when the turning ON of the starter switch 44 has not yet been determined, the routine goes to step S19 wherein it is determined whether the start switch 44 has been turned ON.

When the starter switch 44 is OFF, i.e., when NE≠0 and FINI=0 and when the starter switch 44 has not been turned ON although the engine speed has been detected first time, there is no compatibility, so that the routine goes to step S12. After steps S12 through S16, the routine ends.

On the other hand, when it is determined at step S19 that the starter switch 44 is ON, the starter switch ON determination end flag FINI is set at step S20 (FINI←1), and the routine goes to step S21. If the starter switch ON determination end flag FINI is set, when the next and subsequent routines until the initial diagnosis for the high-pressure fuel system ends after the engine start-up are executed, the routine goes to step S18 via steps S11 and S17, and then, the routine jumps from step S18 to step S21.

As step S21, the time counting value CAS after the engine startup for clocking the time after the engine start-up based on the turning ON of the starter switch 44 is counted up (CAS←CAS+1). Subsequently, at step S22, the time counting value CAS after the engine start-up is compared with a preset value CS1 to determine whether the time after the engine start-up reaches a predetermined period of time.

The preset value CS1 is previously derived by the folk) wing simulation or experiment. The high-pressure fuel pump 25 is driven by the operation of the engine 1 after the engine start-up when the high-pressure fuel system is normal. The time until the fuel pressure Pf of the high-pressure fuel system reaches a predetermined controlled fuel pressure PfB (PfB=7 MPa in this preferred embodiment) by the regulating function of the high pressure regulator 27 after the fuel pressure Pf of the high-pressure fuel system is raised by driving the high-pressure fuel pump 25 is derived. This time value is assumed as the preset value CS1 to be stored in the ROM 52 as fixed data. That is, the present value CS1 defines the expected time until the fuel pressure Pf of the high-pressure fuel system rises to reach the controlled fuel pressure PfB defined by the high pressure regulator 27 after the engine start-up if the high-pressure fuel system is normal. In this preferred embodiment, the preset value CS1 is set to be a value corresponding to 2 through 5 sec.

Then, when CAS<CS1, i.e., when it is considered that the time after the engine start-up has not reached a predetermined period of time defined by the preset value CS1 and that the fuel pressure Pf of the high-pressure fuel system has not yet reached the predetermined controlled fuel pressure PfB based on the high-pressure regulator 27 after the engine 1 is started by the turning ON of the starter switch 44, the routine ends via step S16.

On the other hand, when CAS≧CS1 at step S22 and when the time after the engine start-up based on the turning ON of the starter switch 44 reaches the predetermined time, i.e., when it is considered that the fuel pressure Pf of the high-pressure fuel system rises to reach the controlled fuel pressure PfB regulated by the high-pressure regulator 27 after the engine 1 is started, the routine goes to step S23 wherein the initial diagnosis end flag FAS is set (FAS←1). Then, at step S24, the fuel pressure Pf of the high-pressure fuel system detected by the fuel pressure sensor 35 is read out to be compared with the present pressure PFS to verify whether the actual fuel pressure Pf of the high-pressure fuel system has risen normally.

The preset pressure PFS1 is slightly lower than the controlled fuel pressure PfB (PfB=7 MPa in this preferred embodiment) regulated by the high-pressure regulator 27 when the high-pressure fuel system is normal, or than the controlled fuel pressure PfB having a margin, and has been previously stored in the ROM 52 as fixed data. In this preferred embodiment, the preset pressure PFS1 is set to be, e.g., in the range of from 6 to 6.5 MPa.

When Pf≧PFS, i.e., when the fuel pressure Pf of the high-pressure fuel system has reached the present pressure PFS a predetermined period of time after the engine 1 is started and when the fuel pressure Pf of the high-pressure fuel system has risen normally, it is determined that the high-pressure fuel system is normal, and the routine goes to step S25 wherein the initial diagnosis OK flag FOK indicating that the high-pressure fuel system is normal by the initial diagnosis immediately after the engine start-up is set (FOK←1). Then, the routine ends via step S16.

On the other hand, when Pf<PFS at step S24, i.e., when the fuel pressure Pf of the high-pressure fuel system has not reached the preset pressure PFS even if a predetermined period of time elapses after the engine start-up and when the fuel pressure Pf of the high-pressure fuel system has not reached a predetermined pressure, to which the fuel pressure Pf can rise if the high-pressure fuel system is normal, it is determined that the high-pressure fuel system is abnormal, and the routine goes to step S26.

At step S26, the high-pressure fuel system NG flag FHPNG indicative of the abnormality of the high-pressure fuel system, which is stored in the backup RAM 54 as trouble data, is set (FHPNG←1), and the warning lamp 45 is turned on and off by a predetermined blinking code of a blinking period, the number of blinks per a predetermined period of time or the combination thereof, to inform of the abnormality of the high-pressure fuel system. Then, the routine ends via step S16.

When the ignition switch 60 is turned ON, the operation of the feed pump 24 is started to feed the fuel to the high-pressure fuel system via the high pressure pump 25. Then, when the engine 1 is started by the turning ON of the starter switch 44, the high pressure pump 25 is driven, so that the fuel fed from the feed pump 24 is pressurized by the high pressure pump 25 to be fed to the high-pressure fuel system. Then, when the high-pressure fuel system is normal, the fuel pressure Pf of the high-pressure fuel system rises normally by driving the high pressure pump 25 as shown by the solid line of FIG. 17, to be higher than or equal to the present pressure PFS before the predetermined period of time defined by the preset value CS1 elapses. Then, when the fuel pressure Pf of the high-pressure fuel system reaches the controlled fuel pressure PfB regulated by the high pressure regulator 27, the fuel pressure Pf of the high-pressure fuel system is held at the controlled fuel pressure PfB by the pressure regulating function of the high pressure regulator 27.

Figure 17:
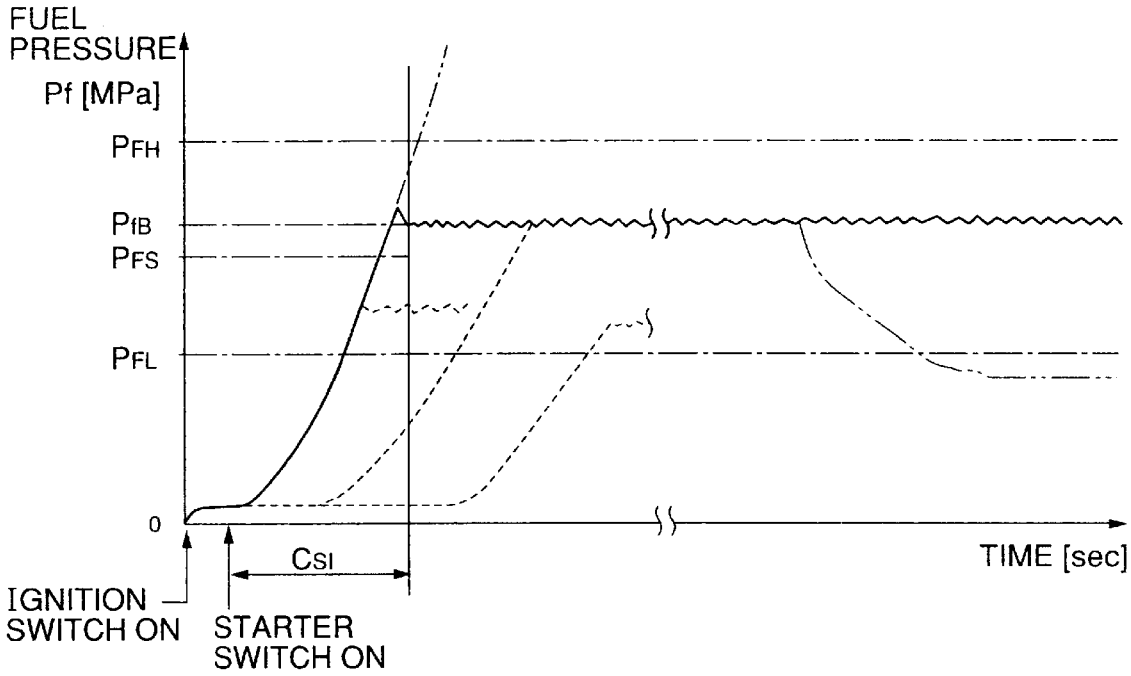
FIG. 17 is a time chart showing the behavior of the fuel pressure in a high-pressure fuel system in the first preferred embodiment of the present invention.

On the other hand, when something is wrong with the high pressure pump 25 forming the high-pressure fuel system, or when the high pressure regulator 29 is inoperative or the fuel leaks from the high pressure regulator 29, or when the fuel leaks from the high-pressure fuel system, the pressure rise of the fuel pressure Pf of the high-pressure fuel system is delayed as shown by the broken line of FIG. 17, or the fuel pressure Pf of the high-pressure fuel system does not rise to the regulated controlled fuel pressure PfB and the pressure rise thereof is stopped halfway.

That is, when the high-pressure fuel system is abnormal, the fuel pressure Pf of the high-pressure fuel system does not reach the preset pressure PFS, even if the predetermined period of time defined by the preset value CS1 elapses, for which the fuel pressure Pf of the high-pressure fuel system can sufficiently rise if the high-pressure fuel system is normal, after the engine start-up. Therefore, if the time after the engine start-up and the fuel pressure Pf of the high-pressure fuel system are determined, the abnormality of the high-pressure fuel system can be early and accurately diagnosed.

After the initial diagnosis immediately after the engine start-up is completed by the setting of the initial diagnosis end flag FAS, the routine goes from step S17 to step S27. At steps S27 and S28, the fuel pressure Pf of the high-pressure fuel system is compared with a lower limit PFL and an upper limit PFH, which define an allowable range of the fuel pressure Pf, to diagnose the abnormality of the high-pressure fuel system based on the above described condition (2).

That is, the abnormality of the high-pressure fuel system is diagnosed during the engine operation after the initial diagnosis ends.

After the engine start-up and after the fuel pressure Pf of the high-pressure fuel system rises normally to reach the controlled fuel pressure PfB regulated by the high pressure regulator 27, if scrapped foreign matters are produced in the high pressure pump 25 or the high pressure regulator 27, which form the high-pressure fuel system, due to the entrapping of the foreign matters in the fuel, or if the high pressure regulator 27 itself is abnormal or the fuel leaks from the high-pressure fuel system, during the engine operation, the fuel pressure Pf of the high-pressure fuel system reduces abnormally as shown by the two-dot chain line of FIG. 17. In addition, the abnormality of the high pressure regulator 27, such as the enclosed fixing, occurs, it is not, possible to regulate the pressure of the fuel due to the fuel discharged from the high pressure regulator 27, so that the fuel pressure Pf of the high-pressure fuel system rises abnormally as shown by the two-dot chain line of FIG. 17.

Therefore, after the initial diagnosis immediately after the engine start-up is completed, the fuel pressure Pf of the high-pressure fuel system is compared with the lower limit PFL and upper limit PFH which define the allowable range, so that it is possible to accurately diagnose the abnormality of the high-pressure fuel system.

At step S27, the current fuel pressure Pf of the high-pressure fuel system detected by the fuel pressure sensor 35 is read out, and the fuel pressure Pf is compared with the lower limit PFL (e.g., 4~5 MPa in this preferred embodiment) which has been previously set to be lower than the controlled fuel pressure PfB and which is not available when the high-pressure fuel system is normal. Then, at step S28, the fuel pressure Pf is compared with the upper limit PFH (e.g., 9 MPa in this preferred embodiment) which has been previously set to be higher than the controlled fuel pressure PfB and which is not available when the high-pressure fuel system is normal.

When Pf<PFL or Pf>PFH, i.e., when the fuel pressure Pf of the high-pressure fuel system is not within the ordinary range of fuel pressure after the engine start-up, the routine goes from the corresponding step to step S26 wherein the high-pressure fuel system NG flag FHPNG is set (FHPNG←1) and the warning lamp 45 is turned on and off by a predetermined blinking code to inform of the abnormality of the high-pressure fuel system. Then, the routine ends via step S16.

On the other hand, when it is determined at steps S27 and S28 that PFL≦Pf≦PFH, i.e., when the fuel pressure Pf of the high-pressure fuel system is within an allowable range, the routine goes to step S29. At step S29 and subsequent steps, the compatibility of the air-fuel ratio A/F with the fuel injection pulse width Ti is determined to diagnose the abnormality of the high-pressure fuel system based on the above described condition (3).

When the high pressure pump 25 or high pressure regulator 27, which form the high-pressure fuel system, is abnormal or when the fuel leaks from the high-pressure fuel system, the fuel pressure Pf of the high pressure fuel fed to the injector 13 can not be maintained at the predetermined controlled fuel pressure. In this case, if a drive signal of the same fuel injection pulse width Ti is applied to the injector, the fuel injection quantity reduces by a drop in fuel pressure Pf of the high-pressure fuel system fed to the injector 13. As is well known, the air-fuel ratio feedback control is incorporated into the fuel injection control, and when the actual air-fuel ratio A/F is lean with respect to the target air-fuel ratio due to the decrease of the fuel injection quantity, the fuel injection pulse width Ti is increased to carry out the fuel increase correction.

For that reason, when the fuel pressure Pf of the high-pressure fuel system reduces due to the abnormality of the fuel pressure system, the air-fuel ratio A/F is lean with respect to the target air-fuel ratio by the decrease of the fuel injection quantity. In order to correct this, the fuel injection pulse width Ti is abnormally increased by the air-fuel ratio feedback correction, so that the air-fuel ratio A/F is not compatible with the fuel injection pulse width Ti defining the injection-valve opening period of the injector 13.

In addition, even if the high pressure fuel is fed to the injector 13 at a normally controlled fuel pressure, when the injector 13 is abnormal due to defective injection-valve opening or the like, it is not possible to obtain a desired fuel injection quantity. Similarly, the fuel injection pulse 1; width Ti is abnormally increased by the air-fuel ratio feedback correction, so that the air-fuel ratio A/F is not compatible with the fuel injection pulse width Ti defining the injection-valve opening period of the injector 13.

Therefore, if the relationship between the air-fuel ratio A/F and the fuel injection pulse width Ti is determined while the air-fuel ratio feedback control is executed, it is possible to accurately diagnose the abnormality of the high-pressure fuel system.

At step S28, it is determined whether the air-fuel ratio feedback control is carried out. During the air-fuel ratio open loop control including the inactive period of the linear $O_2$ sensor 36, the diagnostic conditions are not met, so that the routine ends via step S16 without the diagnosis of the high-pressure fuel system based on the compatibility of the air-fuel ratio A/F with the fuel injection pulse width Ti.

Then, during the air-fuel ratio feedback control, the routine goes from step S28 to step S29 wherein the air-fuel ratio A/F detected by the linear $O_2$ sensor 36 is read out to be compared with a preset value (A/F)S to determine whether the actual air-fuel ratio is a predetermined lean air-fuel ratio or more.

Then, when A/F<(A/F)S, it is determined that the diagnosis conditions are not met, and the routine ends via step S16.

On the other hand, when A/F≧(A/F)S, i.e., when the air-fuel ratio A/F is higher than or equal to a predetermined lean air-fuel ratio defined by the preset value (A/F)S, it is determined that the diagnosis conditions are met, and the routine goes to step S30 wherein the fuel injection pulse width Ti set by a fuel injection control routine, which will be described later, is read out to compare the fuel injection pulse width Ti with an upper limit TiNGMAX which is not usually available at the lean air-fuel ratio, to diagnose the abnormality of the high-pressure fuel system including the injector 13.

During the air-fuel ratio feedback control, when the fuel injection pulse width Ti defining the fuel injection quantity exceeds the upper limit TiNGMAX, which is not usually available if the high-pressure fuel system including the injector 13 is normal, to be abnormally long while the air-fuel ratio A/F is the predetermined lean air-fuel ratio, the fuel injection quantity reduces due to the fuel pressure drop of the high-pressure fuel system or the defective injection-valve opening of the injector 13, so that the fuel injection pulse width Ti is abnormally increased by the air-fuel ratio feedback correction although the air-fuel ratio is higher than or equal to the predetermined lean air-fuel ratio. In this case, it can be determined that the high-pressure fuel system including the injector 13 is abnormal.

Therefore, the preset value (A/F)S and the upper limit TiNGMAX are previously derived by simulations or experiments on the basis of the aforementioned compatibility to be stored in the ROM 52 as fixed data.

Then, at step S30, when Ti>TiNGMAX, i.e., when the fuel injection pulse width Ti exceeds the predetermined value defined by the upper limit TiNGMAX while the air-fuel ratio A/F is higher than or equal to the predetermined lean air-fuel ratio defined by the preset value (A/F)S, it is determined that the high-pressure fuel system including the injector 13 is abnormal, and the routine goes to step S31. Subsequently, at steps S31 and S32, the abnormal state continuing time is determined.

At step S31, an abnormality continuing time counting value CNG for clocking the abnormal state continuing time is counted up (CNG←CNG+1). Then, at step S32, the abnormality continuing time counting value CNG is compared with a preset value CS2.

The preset value CS2 defines a time value, which can surely define that the high-pressure fuel system including the injector 13 is abnormal, by preventing the output value of the linear $O_2$ sensor 36 from temporarily indicating a predetermined lean air-fuel ratio or more under the influence of disturbance or the like or by prevent misdiagnosis by the fuel injection pulse width Ti temporarily having an abnormal value under the influence of disturbance or the like, in view of the response time lag of the air-fuel ratio feedback correction. The preset value CS2 are previously derived by simulations and experiments to be stored in the ROM 52 as fixed data.

Then, when CNG<CS2, i.e., when the continuing time of an abnormal state that the fuel injection pulse width Ti exceeds the upper limit TiNGMAX in the situation of a lean air-fuel ratio does not reach a predetermined period of time defined by the present value CS2, it can not be determined that the high-pressure fuel system is abnormal, and the abnormality is not determined, so that the routine ends.

On the other hand, at step S32, when CNG≧CS2, i.e., when the continuing time of the abnormal state reaches the predetermined period of time defined by the preset value CS2, i.e., when the fuel injection pulse width Ti exceeds the upper limit TiNGMAX, which is not usually available if the high-pressure fuel system including the injector 13 is normal, to continue this state for a predetermined period of time while the air-fuel ratio A/F is higher than or equal to the predetermined lean air-fuel ratio defined by the preset value (A/F)S during the air-fuel ratio feedback control, it is decided that the high pressure pump 25 or high pressure regulator 27 forming the high-pressure fuel system is abnormal, or the fuel leaks from the high-pressure fuel system, or the high-pressure system is abnormal due to the defective injection-valve opening of the injector 13, and the routine goes to step S26. At step S26, the high-pressure fuel system NG flag FHPNG is set (FHPNG←1), and the warning lamp 45 is turned on and off by a predetermined blinking code to inform of the abnormality of the high-pressure fuel system. Then, the routine ends via step S16.

Furthermore, the diagnosis based on the above described behavior (1) and (2) of the fuel pressure Pf of the high-pressure fuel system may be omitted to diagnose the abnormality of the high-pressure fuel system only on the basis of the compatibility of the air-fuel ratio A/F with the fuel injection pulse width Ti although the diagnostic accuracy is slightly deteriorated.

In addition, at step S30, even if Ti≦TiNGMAX, i.e., even if the fuel pressure Pf of the high-pressure fuel system is within the ordinary range defined by the lower limit PFL and the upper limit PFH and even if the air-fuel ratio A/F is higher than or equal to the predetermined lean air-fuel ratio defined by the preset value (A/F)S, when the fuel injection pulse width Ti corresponding to this is set, i.e., when the above described conditions (2) and (3) are not met, the routine goes to step S33 wherein the reference to the initial diagnosis OK flag is made to determine whether it has been determined that the high-pressure fuel system is normal even in the initial diagnosis immediately after the engine start-up.

When FOK=0, i.e., when it has been determined at the initial diagnosis immediately after the engine start-up that the high-pressure fuel system is abnormal, it can not be decided that the high-pressure fuel system is normal even if the above described conditions (2) and (3) are not met, so that the routine ends via steps S16.

On the other hand, at step S33, when FOK=1, i.e., when it has been decided at the initial diagnosis immediately after the engine start-up that the high-pressure fuel system is normal and when all the above described conditions (1) through (3) are not met, it is decided that the -high-pressure fuel system is normal, and the routine goes to step S34 wherein the high-pressure fuel system NG flag FHPNG indicative of the abnormality of the high-pressure fuel system stored in the backup RAM 54 as trouble data is set (FHPNG←0). At this time, if the abnormality of the high-pressure fuel system is indicated by the turning ON and OFF of the predetermined code of the warning lamp 45, this is stopped. Then, the routine ends via step S16.

As a result of the above described steps, when something is wrong with the high-pressure fuel system, the warning lamp 45 is turned on and off to inform of the abnormality of the high-pressure fuel system, so that the driver can easily determine the fault.

In addition, when the trouble shooting is carried out in a service factory such as a dealer, the serial monitor 70 can be connected to the connector 65 for external connection to read the trouble data on the basis of the high-pressure fuel system NG flag FHPNG in the ECU 50 to accurately determine the fault of the high-pressure fuel system.

Then, after the corresponding fault part is repaired, the high-pressure fuel system NG flag FHPNG is cleared by the serial monitor 70. Furthermore, in this preferred embodiment, even if the high-pressure fuel system NG flag FHPNG is not cleared by the serial monitor 70 after the corresponding fault part is repaired, the high-pressure fuel system NG flag FHPNG is cleared in the high-pressure fuel system diagnosing routine if the high-pressure fuel system is returned to be normal.

Figure 5:
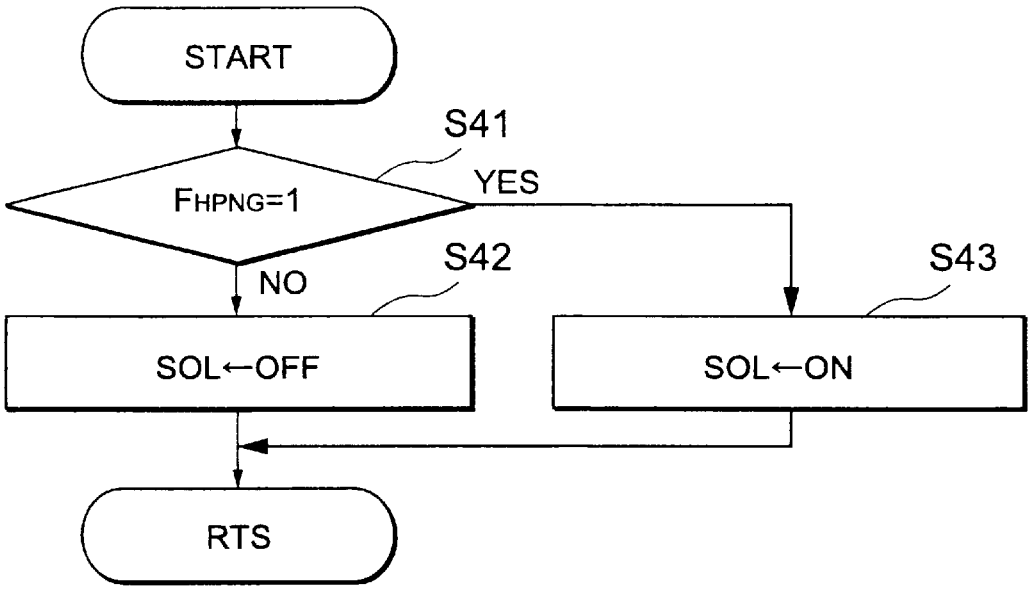
FIG. 5 is a flow chart of a by-pass selector valve control routine in the first preferred embodiment of the present invention.
Figure 7:
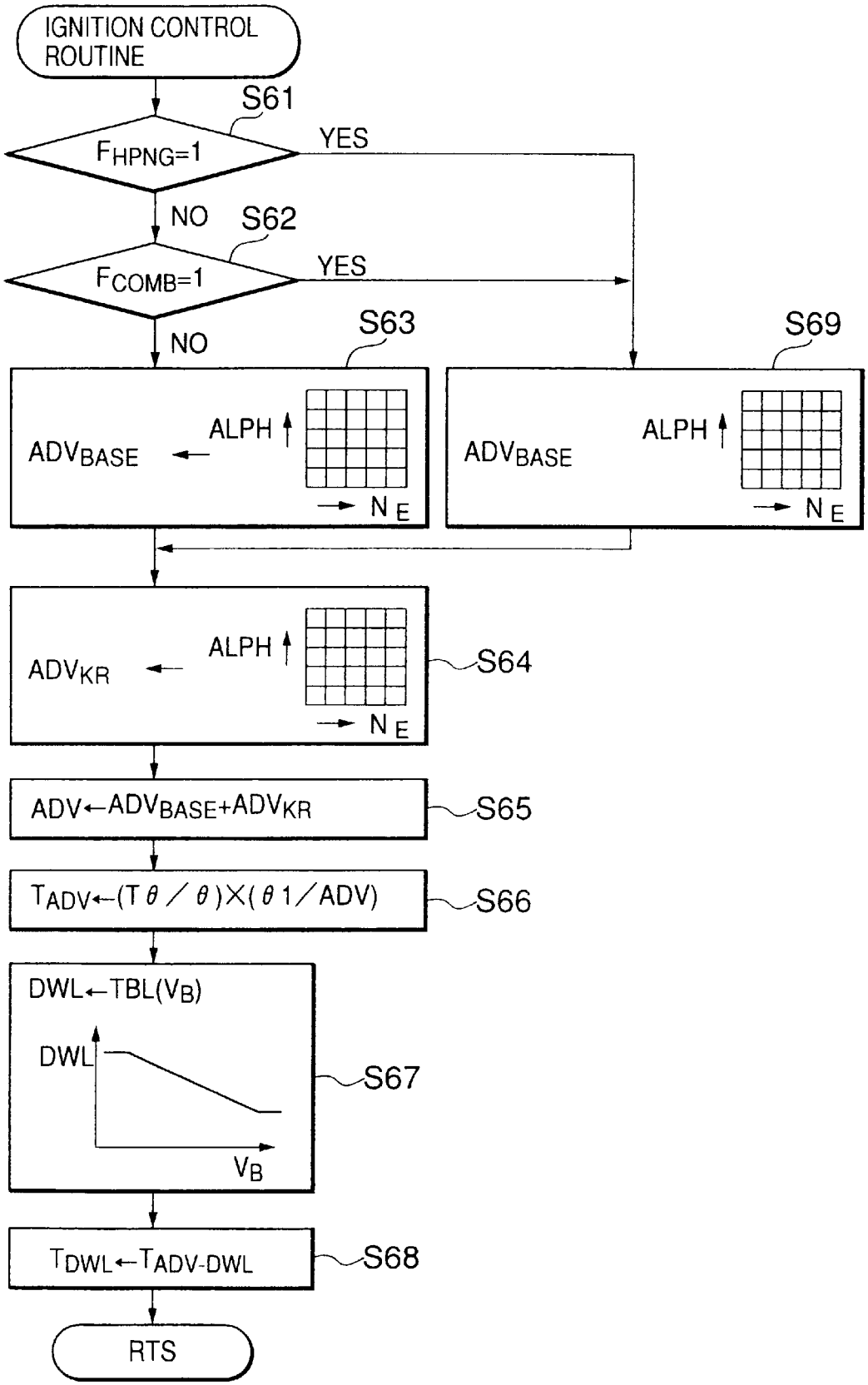
FIG. 7 is a flow chart of an ignition control routine in the first preferred embodiment of the present invention.
Figure 8:
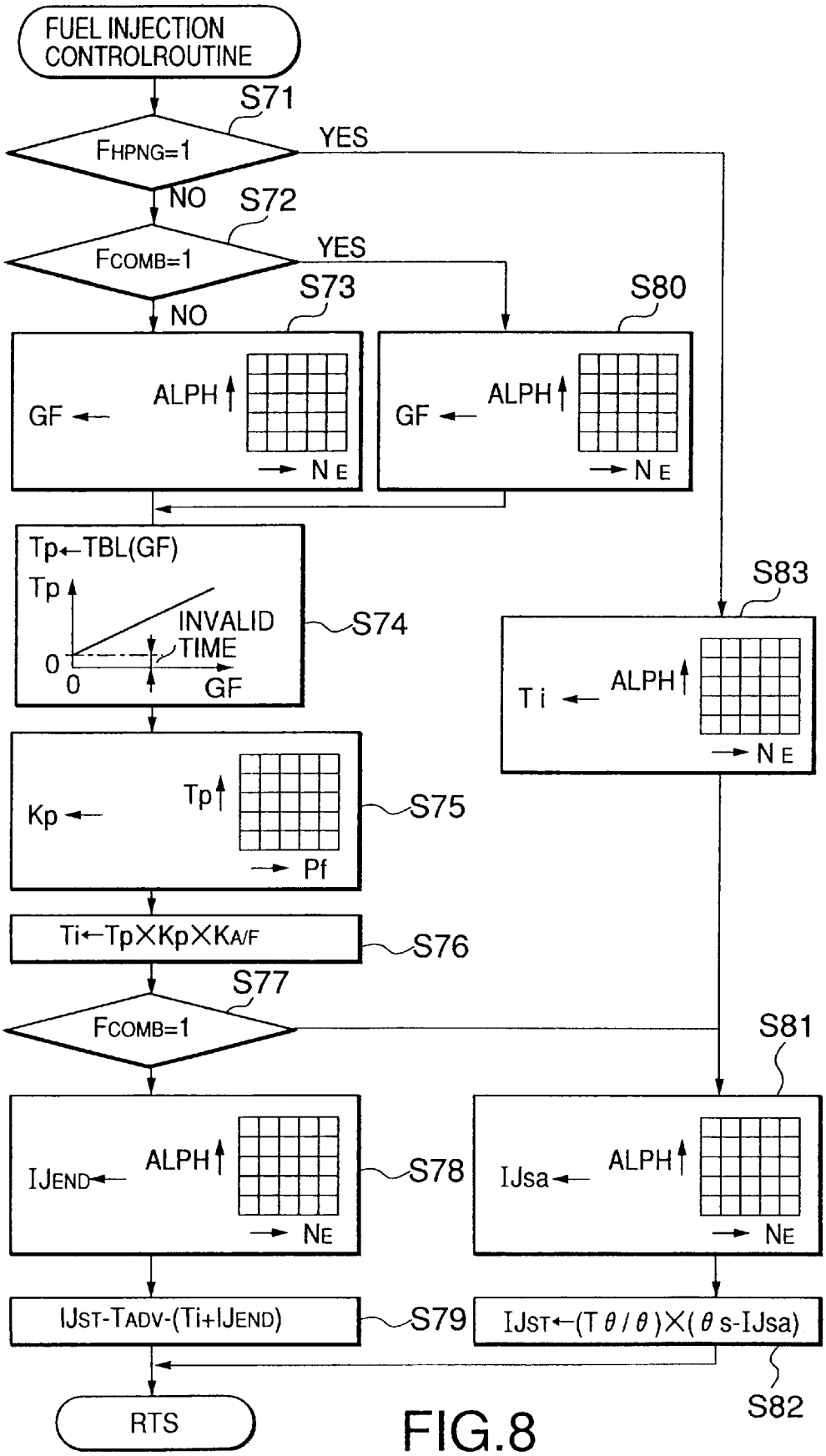
FIG. 8 is a flow chart of a fuel injection control routine in the first preferred embodiment of the present invention.

On the other hand, when the high-pressure fuel system is normal at FHPNG=0 by making reference to the high-pressure fuel system NG flag FHPNG of the high-pressure fuel system diagnosing routine in the by-pass selector valve control routine of FIG. 5, the ignition control routine of FIG. 7 and the fuel injection control routine of FIG. 8, the by-pass selector valve 29 is controlled to be closed. In addition, in accordance with the combustion system selected by the combustion system selecting routine of FIG. 6 which is executed every a predetermined period of time and which will be described later, the fuel injection pulse width Ti for the injector 13 for defining the fuel injection quantity adapted to the respective combustion systems is set on the basis of the engine operating condition so as to be correspond to the controlled fuel pressure PfB regulated by the high pressure regulator 27, and the fuel injection timing and the ignition timing are set so as to be adapted to the respective combustion systems.

In addition, when FHPNG=1, i.e., when the high-pressure fuel system is abnormal, the by-pass selector valve 29 is controlled to be open, and the fuel injection pulse width Ti adapted to the uniform premixed combustion is set on the basis of the engine operating condition in accordance with the pressure of the low pressure fuel regulated by the low pressure regulator 28. Then, at this time, the fuel injection timing and ignition timing adapted to the uniform premixed combustion are set on the basis of the engine operating condition to carry out the uniform premixed combustion based on the early injection regardless of the selection of the combustion system.

The by-pass selector valve control routine of FIG. 5 will be described below. The by-pass selector valve control routine is executed every a predetermined period of time (e.g., 10 msec) after the system initialization. At step S41, the reference to the high-pressure fuel system NG flag FHPNG is made. At the high-pressure fuel system is normal at FHPNG=0, the routine goes to step S42 wherein the solenoid coil of the by-pass selector valve 29 is unenergized (SOL←OFF) to close the by-pass selector valve 29, and the routine ends.

Therefore, when the high-pressure fuel system is normal, the by-pass selector valve 29 is closed to prevent the fuel from leaking from the fuel by-pass passage 21*d*, so that the high pressure fuel pressurized by the high pressure pump 25 and regulated to a predetermined controlled fuel pressure by the high pressure regulator 27 is fed to the injector 13 in the usual manner.

On the other hand, when FHPNG=1 at step S41, i.e., when the high-pressure fuel system is abnormal, the routine goes to step S43 wherein the solenoid coil of the by-pass selector valve 29 is energized (SOL←ON) to open the by-pass selector valve 29, and the routine ends.

As a result, when the high-pressure fuel system is abnormal, the by-pass selector valve 29 is open to establish the communication between the high-pressure fuel system and the low-pressure fuel system via the fuel by-pass passage 21*d*. Therefore, when the high-pressure fuel system is abnormal, the low pressure fuel fed by the feed pump 24 to be regulated to a predetermined fuel pressure by the low pressure regulator 28 is fed directly to the high-pressure fuel system to be fed to the injector 13 independent of the high pressure fuel fed by the high pressure pump 25 and the high pressure regulator 27.

In addition, after the system initialization, the combustion system selecting routine shown in FIG. 6 is executed every a predetermined period of time (e.g., 10 msec) in parallel to the high-pressure fuel system diagnosing routine, and the stratified combustion or the uniform premixed combustion is selected as a combustion system on the basis of the engine operating condition based on the engine speed and the accelerator position ALPH.

This combustion system selecting routine will be described below. First, at step S51, the reference to an area determining value is made with the interpolation calculation on the basis of the current engine speed NE to set an area determining value L0 for determining which the stratified combustion or the uniform premixed combustion is selected.

This area determining value L0 is a determining value as a reference for switching the combustion system to the stratified combustion or the uniform premixed combustion in accordance with the engine load. In this preferred embodiment, an accelerator position ALPH indicative of a required load is adopted as an example of the engine load, and the accelerator position ALPH detected by the accelerator position sensor 31 is compared with the area determining value LO to determine which the stratified combustion or the uniform premixed combustion is selected. Furthermore, this selection of the combustion system is carried out by changing the fuel injection timing and the ignition timing.

As described above, the stratified combustion is a combustion system for injecting the fuel into a corresponding cylinder in a compression stroke to complete the fuel injection immediately before ignition to ignite the rear end portion of the fuel spray by means of a spark plug 14. Since the stratified combustion utilizes only air around the fuel, it is possible to obtain a stable combustion in a very small fuel injection quantity with respect to the quantity of filled air, so that the stratified combustion is suitable for the engine operation during low speeds with low loads. On the other hand, the uniform premixed combustion is a combustion system for injecting the fuel into a corresponding cylinder at a relatively early timing, i.e., in an exhaust stroke end or intake stroke, to ignite the injected fuel after the injected fuel is dispersed in the combustion chamber 12 to be uniformly mixed with air. This uniform premixed combustion has a high quantity of utilized air and can improve the engine output, so that the uniform premixed combustion is suitable for the engine operation during high engine speeds with high loads.

Figure 18:
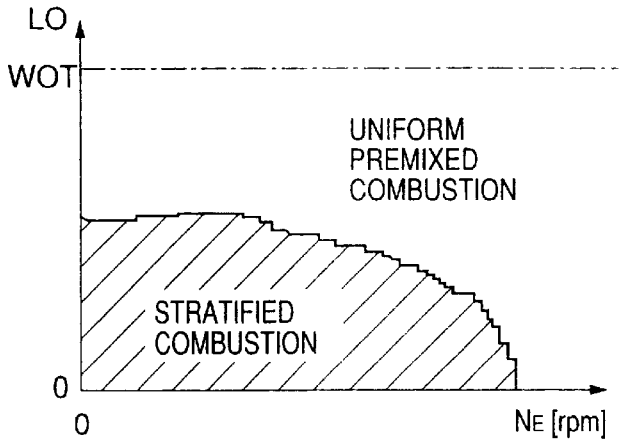
FIG. 18 is an explanatory drawing of an area determining value table in the first preferred embodiment of the present invention.

Therefore, the area determining value table is obtained as follows. First, a proper accelerator position for switching the combustion system to the stratified combustion or the uniform premixed combustion every an area based on the engine speed NE is previously derived by simulations or experiments. This proper accelerator position is used as an area determining value L0 to set a table using the engine speed NE as a parameter to obtain the area determining value table. This area determining value table is stored in the ROM 52 as a series of addresses. An example of the area determining value table is shown in FIG. 18. As shown in FIG. 18, the area determining value table stores therein area determining values L0 which decrease as the engine speed NE increases.

Then, the routine goes to step S52 wherein the current accelerator position ALPH detected by the accelerator position sensor 31 is compared with the area determining value L0.

When ALPH≦L0, i.e., during low engine speeds with low loads (the area shown by the slanting lines in FIG. 18), the stratified combustion is selected in order to improve fuel consumption and exhaust emission. In order to indicate that the stratified combustion has been selected, a combustion system determining flag FCOMB is cleared at step S53 (FCOMB←0), and the routine ends.

On the other hand, at step S52, when ALPH>L0, i.e., during high engine speeds with high loads, the uniform premixed combustion is selected in order to improve the engine output. In order to indicate that the uniform premixed combustion has been selected, the combustion system determining flag FCOMB is set at step S54 (FCOMB←1), and the routine ends.

When the high-pressure fuel system is normal (FHPNG=0), the reference to the combustion system determining flag FCOMB set by the combustion system selecting routine is made in each of the ignition control routine of FIG. 7 and the fuel injection control routine of FIG. 8. When FCOMB=0, i.e., when the stratified combustion has been selected, the fuel injection pulse width Ti defining the fuel injection quantity adapted to the stratified combustion for the injector 13 is set on the basis of the engine operating condition in accordance with the controlled fuel pressure PfB (PfB=7 MPa in this preferred embodiment) regulated by the high pressure regulator 27. In addition, the fuel injection timing is set for a compression stroke of a cylinder #i to be injected, and the ignition timing adapted to the stratified combustion is set on the basis of the engine operating condition. Thus, during low engine speeds with low loads, the stratified combustion is carried out to improve exhaust emission and fuel consumption.

When the FCOMB=1, i.e., when the uniform premixed combustion is selected, the fuel injection pulse width Ti defining the fuel injection quantity adapted to the uniform premixed combustion is set for the injector 13 on the engine operating condition in accordance with the controlled fuel pressure PfB regulated by the high pressure regulator 27. In addition, the fuel injection timing is set in an exhaust stroke end or intake stroke for a cylinder #i to be injected, and the ignition timing adapted to the uniform premixed combustion is set. Thus, during high engine speeds with high loads, the uniform premixed combustion is carried out to improve the engine output.

On the other hand, when the high-pressure fuel system is abnormal (FHPNG=1), since the low pressure fuel of the low pressure fuel system is fed directly to the injector 13 by opening the by-pass selector valve 29, the fuel injection pulse width Ti adapted to the uniform premixed combustion is set on the basis of the engine operating condition in accordance with the pressure of the low pressure fuel (0.2 MPa in this preferred embodiment) regulated by the low pressure regulator 28. At this time, the fuel injection timing and ignition timing adapted to the uniform premixed combustion are set on the basis of the engine operating condition, so that the uniform premixed combustion based on the early injection is carried out regardless of the selection of the combustion system.

Before describing the fuel injection control routine, the ignition control routine of FIG. 7 will be described below.

This ignition control routine is executed every a predetermined period of time (e.g., 10 msec). First, at step S61, the reference to the high-pressure fuel system NG flag FHPNG is made.

When FHPNG=0, i.e., when the high-pressure fuel system is normal, the routine goes to step S62 wherein the reference to the combustion system determining flag FCOMB is made. When FCOMB=0, i.e., when the stratified combustion is selected, the routine goes to step S63. At step S63, on the basis of the engine speed NE and the accelerator position ALPH indicative of a required load as the engine operating condition, the reference to a stratified combustion period basic ignition advance value table stored in the ROM 52 is made with the interpolation calculation, and a basic ignition advance value ADVBASE is set as a basic ignition timing adapted to the stratified combustion.

The stratified combustion period basic ignition advance value table is set as follows. First, the optimum ignition timing adapted to the stratified combustion is previously derived by simulations or experiments every engine operation area based on the accelerator position ALPH and the engine speed NE. The derived ignition timing adapted to the stratified combustion is used as the basic ignition advance ADVBASE defining the degree of ignition angle CA BTDC to set a table, which uses the accelerator position ALPH and the engine speed NE as parameters. The table thus set is the stratified combustion ignition advance value table, which is stored in the ROM 52 at a series of addresses.

Thereafter, the routine goes to step S64 wherein an ignition timing learning correction value ADVKR, by which the ignition delay and ignition advance are learned every operation area in accordance with the presence of a knocking detected by the knock sensor 32, is set by making reference to an ignition timing learning correction value table with the interpolation correction, which has been stored in the backup RAM 54 on the basis of the accelerator position ALPH and the engine speed NE.

Then, at step S65, the ignition timing learning correction value ADVKR is added to the basic ignition advance ADVBASE to carry out the learning correction to set a controlled ignition advance ADV defining the ignition timing (ADV←ADVBASE+ADVKR).

Then, at step S66, an unenergizing timing, i.e., an ignition timing TADV defining the ignition timing, for the ignition coil 15 based on the input of the crank pulse θ1 is set on the basis of the controlled ignition advance ADV.

In this preferred embodiment, the ignition timing is controlled by a so-called time control system. As shown in FIGS. 14 and 15, the energizing starting timing (dowel set) and the unenergizing timing (ignition timing; dowel cut) are set for the ignition coil 15 by a period of time after the input of the crank pulse θ1.

That is, since the control ignition advance ADV is an angular data (BTDC° CA), the control ignition advance ADV must be converted to a period of time from the input of the crank pulse θ1 to ignition. In this preferred embodiment, assuming that an input interval for the current crank pulse is Tθ and an angle between crank pulses corresponding to the input interval for the current crank pulse Tθ is θ, an ignition timing TADV is set on the basis of the input of the crank pulse θ1 by the following formula from a period of time per rotation of 1° CA.

$$TADV \leftarrow (T\theta/\theta)\times(\theta 1-ADV)$$

θ1:θ1=97° CA in this preferred embodiment

Then, at step S67, the energizing time (dowel) DWL for the ignition coil 15 is set by making reference to a table with the interpolation calculation on the basis of the battery voltage VB. The energizing time DWL defines the optimum energizing time for the primary current of the coil depending on the battery voltage VB. An example of this table is shown at step S67. That is, when the battery voltage VB falls, the energizing time DWL is increased to ensure the ignition energy, and when the battery voltage VB rises, the energizing time DWL is decreased to prevent energy loss and the heat generation of the ignition coil 15.

Then, the routine goes to step S68 wherein the energizing time DWL is subtracted from the ignition timing TADV to set an energizing starting timing TDWL based on the input of the crank pulse θ1 (TDWL←TADV←DWL), and the routine ends.

On the other hand, when FHPNG=1 at step S61, i.e., when the high-pressure fuel system is abnormal, or when FHPNG=0 at step S61, i.e., when the high-pressure fuel system is normal, and when FCOMB=1 at step S62, i.e., when the uniform premixed combustion is selected, the routine goes to step S69.

At step S69, a basic ignition advance ADVBASE serving as a basic ignition timing adapted to the uniform premixed combustion is set by making reference to the uniform premixed combustion period basic ignition advance value table with the interpolation calculation on the basis of the accelerator position ALPH which indicates the engine speed NE and the required load as the engine operating condition.

The uniform premixed combustion period basic ignition advance value table is set as follows. First, the optimum ignition timing adapted to the uniform premixed combustion is previously derived by simulations or experiments every engine operation area based on the accelerator position ALPH and the engine speed NE. The derived ignition timing adapted to the uniform premixed combustion is used as the basic ignition advance ADVBASE to set a table which uses the accelerator position ALPH and the engine speed NE as parameters. The set table is the uniform premixed combustion period basic ignition advance value table, which is stored in the ROM 52 at a series of addresses. Furthermore, the basic ignition advance ADVBASE during the uniform premixed combustion shows a value advanced from the stratified combustion time.

Then, the routine goes to step S64, an ignition timing learning correction value ADVKR is set on the basis of the accelerator position ALPH and the engine speed NE by making reference to the ignition timing learning correction value table with the interpolation calculation. Then, at steps S65 and S66, the ignition timing learning correction value ADVKR is added to the basic ignition advance ADVBASE adapted to the uniform premixed combustion, which has been set at step S69, to set a control ignition advance ADV, and this control ignition advance ADV based on angular data is converted to an ignition timing TADV based on the input of the crank pulse θ1. Then, at steps S67 and S68, an energizing time DWL is set on the basis of the battery voltage VB by making reference to a table, and the energizing time DWL is subtracted from the ignition timing TADV to set an energizing starting timing TDWL. Then, the routine ends.

As a result of the above described steps, data on a cylinder to be ignited in the cylinder determining/engine speed calculating routine are read by a θ1 crank pulse interruption routine of FIG. 9, which is executed in synchronism with the input of the crank pulse θ1 and which will be described later, and the current energizing starting timing TDWL and the ignition timing TADV, which have been set in the ignition control routine, are read out. Then, the energizing starting timing TDWL is set in an energizing starting timing timer for a cylinder to be ignited, and the ignition timing TADV is set in an ignition timing timer for the cylinder to be ignited. In addition, the respective timers are started in synchronism with the input of the crank pulse θ1, and ignition adapted to the combustion system is carried out.

In addition, when the high-pressure fuel system is normal and when the stratified combustion is selected, the reference to the ignition timing TADV defining the ignition timing is made in the fuel injection control routine of FIG. 8, and a fuel injection starting timing IJST defining the fuel injection timing for the corresponding cylinder is set on the basis of the ignition timing TADV.

The fuel injection control routine shown in FIG. 8 win be described below.

This fuel injection control routine is executed every a predetermined period of time (e.g., 10 msec). First, step S71, the reference to the high-pressure fuel system NG flag FHPNG is made by the high-pressure fuel system diagnosing routine.

When FHPNG=0, i.e., when the high-pressure fuel system is normal, the routine goes to step S72 wherein the reference to the combustion system determining flag FCOMB is made. When FCOMB=0, i.e., when the stratified combustion is selected, the routine goes to step S73. At step S73, on the basis of the engine speed NE and the accelerator position ALPH indicative of a required load as the engine operating condition, the reference to the stratified combustion period basic fuel injection quantity table is made with the interpolation calculation to set a basic fuel injection quantity GF (unit: g) corresponding to a fuel injection quantity which is adapted to the stratified combustion and which is used for obtaining a predetermined engine output.

The stratified combustion period basic fuel injection quantity table is set as follows. First, the optimum ignition quantity per cycle of one cylinder, which is adapted to the stratified combustion and which is suited to obtain a predetermined engine output, is previously derived by simulations or experiments every engine operation area based on the engine speed NE and the accelerator position ALPH. The derived optimum fuel injection quantity is used as a basic fuel injection quantity GF to set a table using the engine speed NE and the accelerator position ALPH as parameters. The basic injection table thus set is the stratified combustion period basic fuel injection quantity table, which is stored in the ROM 52 at a series of addresses.

Then, the routine goes to step S74, the reference to the basic fuel injection pulse width table is made with the interpolation calculation on the basis of the basic fuel injection quantity GF, and a basic fuel injection pulse width Tp (unit: msec) for the injector 13 is set to obtain the basic fuel injection quantity GF.

The basic fuel injection pulse width table is set as follows. The basic fuel injection pulse width Tp defining an injection-valve opening period of the injector 13 suited to obtain the basic fuel injection quantity GE is previously derived by simulations or experiments every area based on the basic fuel injection quantity GE while the pressure of the fuel fed to the injector 13 is the controlled fuel pressure PfB (PfB=7 MPa in this preferred embodiment) regulated by the high pressure regulator 27, so that the basic fuel injection pulse width table is set as a table, which uses the basic fuel injection quantity GF as a parameter and which is stored in the ROM 52 at a series of addresses.

An example of the basic fuel injection pulse width table is shown at step S74. As the basic fuel injection quantity GF increases, it is required to increase the basic fuel injection pulse width Tp defining the basic injection-valve opening period of the injector 13 in order to obtain the basic fuel injection quantity GF. Therefore, the basic fuel injection pulse width table stores therein the basic fuel injection pulse width Tp increasing as the basic fuel injection quantity GP increases. Furthermore, an invalid period of time until the injector 13 is actually open after a fuel injection pulse width signal is outputted to the injector 13, is substantially constant regardless of the fuel pressure. When the basic fuel injection pulse width Tp is set, the invalid period of time is also corrected.

When FHPNG=0, i.e., when the high-pressure fuel system is normal, the by-pass selector valve 29 is open by the by-pass selector valve control routine to prevent the fuel from leaking from the fuel by-pass passage 21*d*, and the high pressure fuel, the pressure of which is raised by the high pressure pump 25 and which is regulated to a predetermined controlled fuel pressure by the high pressure regulator 27, is fed to the injector 13. Therefore, at this time, if the basic fuel injection quantity GF is converted to the basic fuel injection pulse width Tp so as to be coincident with the controlled fuel pressure PfB regulated by the high pressure regulator 27, it is possible to obtain a fuel injection quantity corresponding to a required injection quantity when the high-pressure fuel system is normal similar to conventional systems.

Subsequently, at step S75, the reference to a fuel pressure correction factor table is made with the interpolation calculation on the basis of the fuel pressure Pf detected by the fuel pressure sensor 35 and the basic fuel injection pulse width Tp, and a fuel pressure correction factor Kp (unit: non) for correcting the basic fuel injection pulse width Tp is set in accordance with the fuel pressure Pf.

The fuel pressure correction factor table is set as follows. First, a factor suited to correct the basic fuel injection pulse width Tp to obtain the basic fuel injection quantity GP is previously derived by simulations or experiments every area based on the fuel pressure Pf and the basic fuel injection pulse width Tp. The derived factor is used as the fuel pressure correction factor Kp to set a table using the fuel pressure Pf and the basic fuel injection pulse width Tp as parameters. The fuel pressure correction factor table thus set are stored in the ROM 52 at a series of addresses. Furthermore, in this preferred embodiment, the fuel pressure used in the fuel pressure correction factor table as a parameter is set in the range of, e.g., from 1 MPa to 9 MPa, in order to cover the fuel pressure in a practical use range of the high-pressure fuel system in view of the increasing process of the fuel pressure Pf when the engine is started.

The basic fuel injection pulse width Tp is set so as to be coincident with the controlled fuel pressure PfB (=7 MPa) regulated by the high pressure regulator 27, and the correction using the fuel pressure correction factor Kp is given as a multiplying term with respect to the basic fuel injection pulse width Tp as shown at step S76 which will be described later. Therefore, when the fuel pressure Pf of the high-pressure fuel system detected by the fuel pressure sensor 35 is coincident with the controlled fuel pressure PfB (Pf=7 MPa in this preferred embodiment), the correction using the fuel pressure correction factor Kp is not carried out, so that a value of Kp=1.0 is stored in the corresponding fuel pressure range of the fuel pressure correction factor table. The fuel pressure correction factor table stores therein fuel pressure correction factors KP, which gradually decrease from Kp=1.0 in order to decrease the basic fuel injection pulse width Tp as the fuel pressure Pf increases in an area wherein the fuel pressure Pf is higher than the controlled fuel pressure PfB, and fuel pressure correction factors Kp, which gradually increase from Kp=0 in order to increase the basic fuel injection pulse width Tp as the fuel pressure Pf decreases in an area wherein the fuel pressure Pf is lower than the controlled fuel pressure PfB.

However, in an area wherein the fuel injection pulse width Tp is very small (e.g., Tp<0.6~0.7 msec in this preferred embodiment), when the fuel pressure Pf is high, the injection-valve opening force of the injector 13 based on the fuel pressure Pf increases more highly than that when the fuel pressure Pf is low. Therefore, when the fuel pressure Pf is high, the decreases of the effective opening time and effective opening area of the injector 13 have a greater influence on the amount of fuel injected from the injector 13 than that when the fuel pressure Pf is low. In addition, when the fuel injection pulse width is the same, the amount of fuel injected from the injector 13 decreases as the fuel pressure Pf increases. For that reason, in an area wherein the basic fuel injection pulse width Tp is less than a predetermined value (Tp<0.6~0.7 msec in this preferred embodiment), the fuel pressure correction factor table stores therein fuel pressure coefficients Kp which increase as the fuel pressure Pf increases.

Then, the routine goes to step S76 wherein the basic fuel injection pulse width Tp is multiplied by the fuel pressure correction factor Kp to carry out the fuel pressure correction and multiplied by air-fuel ratio feedback correction factor KA/F to carry out the air-fuel ratio correction, to set a final fuel injection pulse width Ti for the injector 13 (Ti←Tp×Kp×KA/F).

Furthermore, the air-fuel ratio feedback correction factor KA/F is well known, and set in accordance with the compared results of a target air-fuel ratio, which is set in accordance with the engine operating area, with the actual air-fuel ratio A/F detected by the linear $O_2$ sensor 36. The air-fuel ratio feedback correction factor KA/F is used for correcting the basic fuel injection pulse width Tp so that the actual air-fuel ratio A/F converges at the target air-fuel ratio.

Thereafter, at step S77, the reference to the combustion system determining flag FCOMB is made again. When FCOMB=0, i.e. when the stratified combustion is selected, the routine goes to step S78 wherein the fuel injection end timing table is searched on the basis of the engine operating condition based on the engine speed NE and the accelerator position ALPH, to set a fuel injection end timing IJEND (unit: msec) by the interpolation calculation.

The stratified combustion is a combustion system for injecting the fuel in a compression stroke to complete the fuel injection immediately before ignition to ignite the rear end portion of the fuel spray by means of a spark plug 14. That is, in this preferred embodiment, after the fuel is injected from the injector 13, when the air-fuel mixture having an air-fuel ratio of a combustible range by the fuel spray reaches a portion between discharge electrodes of the spark plug 14 by the cylinder intake air flow, the rear end portion of the fuel spray is ignited by means of the spark plug 14 to propagate flames to achieve the stratified combustion, so that it is required to manage the interval between the fuel injection end and the ignition.

Therefore, the fuel injection end timing table is set as follows. First, the optimum fuel injection end timing before ignition adapted to the stratified combustion, i.e., a period of time until the rear end portion of the fuel spray fuel-air mixture reaches a portion between the discharge electrodes of the spark plug 14 by the cylinder intake air flow after the fuel is injected from the injector 13, is previously derived by simulations or experiments every engine operating area based on the engine speed NE and the accelerator position ALPH indicative of a required load. This time value is used as a fuel injection end timing IJEND to set the fuel injection end timing table as a table using the engine speed NE and the accelerator position ALPH as parameters. This fuel injection end timing table is stored in the ROM 52 at a series of addressed.

Then, the routine goes to step S79 wherein the ignition timing TADV is read by the ignition control routine, and a fuel injection starting timing IJST (unit: msec) defining a fuel injection starting timing based on the input of the crank pulse θ1 is set by the inverse operation of the ignition timing TADV by means of the fuel injection end timing IJEND and the fuel injection pulse width Ti (IJST←TADV←(Ti+IJEND)). Then, the routine ends.

In this preferred embodiment, the fuel injection starting timing is controlled by the time control system, and when the stratified combustion is carried out, the fuel injection starting timing IJST for the corresponding cylinder is set by a period of time after the input of the crank pulse θ1 as shown in the time chart of FIG. 14.

That is, the fuel injection end timing IJEND indicates the interval between the fuel injection end and the ignition as a time value before ignition. Therefore, the fuel injection end timing IJEND must be converted to a period of time until the fuel injection is started after the crank pulse θ1 is inputted. For that reason, in this preferred embodiment, the sum of the fuel injection end timing IJEND and the fuel injection pulse width Ti is subtracted from the ignition timing TADV, which has been set on the basis of the input of the crank pulse θ1, to set the fuel injection starting timing IJST based on the input of the crank pulse θ1.

On the other hand, when FHPNG=0, i.e., when the high-pressure fuel system is normal, and when FCOMB=1 at step S72, i.e., when the uniform premixed combustion is selected, the routine goes from step S72 to step S80 wherein the reference to a uniform premixed combustion period basic fuel injection quantity table is made with the interpolation calculation on the basis of the engine operating condition based on the engine speed NE and the accelerator position ALPH to set a basic fuel injection quantity GF (unit: g) which is adapted to the unit premixed combustion and which is used for obtaining a predetermined engine output.

The uniform premixed combustion period basic fuel injection quantity table is set as follows. First, the optimum fuel injection quantity per cycle of one cylinder, which is adapted to the uniform premixed combustion and which is suited to obtain a predetermined engine output, is previously derived by simulations and experiments every area based on the engine speed NE and the accelerator position ALPH indicative of a required load. The derived optimum fuel injection quantity is used as a basic fuel injection quantity GF to set the uniform premixed combustion period basic fuel injection quantity table as a table using the engine speed NE and the accelerator position ALPH as parameters. This basic fuel injection quantity table is stored in the ROM 52 at a series of addresses.

After the basic fuel injection quantity GF is set, the routine goes to step S74 wherein the reference to the basic fuel injection pulse table is made with the interpolation calculation on the basis of the basic fuel injection quantity GF to set a basic fuel injection pulse width Tp for the injector 13, which is used for obtaining the basic fuel injection quantity Gf. Then, at step S75, the reference to the fuel pressure correction factor table is made with the interpolation calculation on the basis of the fuel pressure Pf detected by the fuel pressure sensor 35 and the basic fuel injection pulse width Tp to set a fuel pressure correction factor Kp. Then, at step S76, the basic fuel injection pulse width Tp is multiplied by the fuel pressure correction factor Kp and the air-fuel ratio feedback correction factor KA/F to carry out the fuel pressure correction and air-fuel ratio correction to set a final fuel injection pulse width Ti for the injector 13.

Then, at step S77, the reference to the combustion system determining flag FCOMB is made again. When FCOMB=1, i.e., when the uniform premixed combustion is selected, the routine goes from step S77 to step S81.

At step S81, the fuel injection starting angle table is searched on the basis of the engine operating condition based on the engine speed NE and the accelerator position ALPH to set a fuel injection starting angle IJsa (unit: ° CA) based on the compression top dead center for the corresponding cylinder by the interpolation calculation.

During the uniform premixed combustion, the fuel injection is preferably completed as soon as possible to diffuse the injected fuel to sufficiently mix the injected fuel with new air. However, during high engine speeds with high loads, a large fuel injection quantity is required, so that the fuel injection pulse width Ti increases and the time required for one cycle decreases. Therefore, unless the fuel injection starting timing is suitably managed, the fuel injection may be started from the initial to middle in an exhaust stroke to cause the blow-by of the fuel into the exhaust system.

That is, during the uniform premixed combustion, it is required to start the fuel injection in the exhaust stroke end or intake stroke. In this preferred embodiment, the fuel injection starting timing is managed at a crank angle before compression top dead center based on the compression top dead center of the corresponding cylinder (see FIG. 15).

Therefore, the fuel injection starting angle table is set as follows. First, the optimum fuel injection starting angle before compression top dead center of the corresponding cylinder adapted to the uniform premixed combustion is previously derived by simulations or experiments every area based on the engine speed NE and the accelerator position ALPH. The derived optimum fuel injection starting angle is used as a fuel injection starting angle IJsa to set the fuel injection starting angle table as a table using the engine speed NE and the accelerator position ALPH as parameters. This fuel injection starting angle table is stored in the ROM 52 at a series of addresses.

Then, at step S82, as a time value for defining a fuel starting timing after the input of a reference crank pulse, a fuel injection starting timing IJST (unit: msec) is set on the basis of the fuel injection starting angle IJsa.

In this preferred embodiment, as described above, the fuel injection starting timing is controlled by the time control system. As shown in the time chart of FIG. 15, during the uniform premixed combustion, the fuel injection starting timing IJST for the corresponding cylinder is set by the time after the input of the crank pulse θ2, two pulses in advance of the corresponding cylinder.

That is, since the fuel injection starting angle IJsa is a crank angle data based on the compression top dead center of the corresponding cylinder, this is converted to time, and the resulting value is subtracted from a period of time from the input of the crank pulse θ2, two pulses in advance of the corresponding cylinder, which is a reference for setting the fuel injection starting timing IJST, to the compression top dead center of the corresponding cylinder. Thus, a desired fuel injection starting timing IJST can be calculated.

Assuming that the current crank pulse input interval is Tθ and the angle between crank pulses corresponding to the current crank pulse input interval Tθ is θ, a period of time TθS from the input of the crank pulse θ2, two pulses in advance of the corresponding cylinder, which is a reference for setting the fuel injection starting timing IJST, to the compression top dead center of the corresponding cylinder can be calculated by the following formula from a period of time per a rotation of 1° CA (Tθ/θ).

$$T\theta S=(T\theta/\theta)\times\theta S$$

Furthermore, the θS is an angle from the crank pulse θ2, two pulses in advance of the corresponding cylinder, to the compression top dead center of the corresponding cylinder, and previously stored in the ROM 52 as fixed data. In this preferred embodiment, θS=2×180+65=425° CA.

Therefore, a value ((Tθ/θ)−IJsa) obtained by converting the fuel injection starting angle IJsa to time can be subtracted from the time value TθS(=(Tθ/θ)×θS) to derive a fuel injection starting timing IJST, and a fuel injection starting timing IJST when the uniform premixed combustion is selected can be set by the following formula.

$$IJST\leftarrow(T\theta/\theta)\times(\theta S=IJsa)$$

After the fuel injection starting timing IJST is set, the routine ends.

On the other hand, at step S71, when FHPNG=1, i.e., when the high-pressure fuel system is abnormal, the routine goes from step S71 to S83 regardless of the selection of the combustion system.

At step S83, the reference to an abnormal period fuel injection pulse width table is made with the interpolation calculation on the basis of the engine operating condition based on the engine speed NE and the accelerator position ALPH, and a fuel injection pulse width Ti (unit: msec) defining a fuel injection quantity, which is adapted to the uniform premixed combustion and which is used for obtaining a predetermined engine output, is set at the pressure of a low pressure fuel regulated by the low pressure regulator 28.

The abnormal period fuel injection pulse width table is set as follow. First, a fuel injection quantity per cycle of one cylinder, which is adapted to the uniform premixed combustion and which is suited to obtain a predetermined engine output, is previously derived by simulations or experiments every area based on the engine speed NE and the accelerator position ALPH indicative of a required load. Then, a fuel injection pulse width Ti used for obtaining the fuel injection quantity is derived when the pressure of the fuel fed to the injector 13 is the pressure of a low pressure fuel (0.2 MPa in this preferred embodiment) regulated by the low pressure regulator 28. Then, the abnormal period fuel injection pulse width table is set as a table using the engine speed NE and the accelerator position ALPH as parameters to be stored in the ROM 52 at a series of addresses.

That is, when FHPNG=1, i.e., when the high-pressure fuel system is abnormal, the by-pass selector valve 29 is open by the above described by-pass selector valve control routine, so that the low pressure fuel of the low-pressure fuel system fed by the feed pump 24 to be regulated by the low pressure regulator 28 is fed directly to the injector 13. Therefore, at this time, a fuel injection pulse width Ti adapted to the uniform premixed combustion is set on the basis of the engine operating condition based on the engine speed NE and the accelerator position ALPH in accordance with the pressure of the low pressure fuel (0.2 MPa in this preferred embodiment) regulated by the low pressure regulator 28.

Furthermore, in this preferred embodiment, the fuel injection pulse width Ti, which is set when the high-pressure fuel system is abnormal, is set in accordance with the pressure of the low pressure fuel (0.2 MPa) fed to the injector 13, so as to be a value about 2 through 2.5 times as large as the fuel injection pulse width Ti which is set in accordance with the controlled fuel pressure PfB (7 MPa) regulated by the high pressure regulator 27 when the high-pressure fuel system is normal.

In addition, there is an upper limit to the fuel injection pulse width Ti stored in the abnormal period fuel injection pulse width table, and the engine output is preferably restricted by the upper limit of the fuel injection pulse width Ti when the high-pressure fuel system is abnormal.

That is, when the high-pressure fuel system is abnormal, the engine output is restricted by the upper limit of the fuel injection pulse width Ti to inhibit the degree of abnormality of the high-pressure fuel system from increasing and to surely prevent the controllability of fuel injection from deteriorating by the fail safe control, so that it is possible to prevent the combustion state of the engine 1 from deteriorating.

After the fuel injection pulse width Ti is set, the routine goes to step S81 wherein the reference to the fuel injection starting angle table is made with the interpolation calculation on the basis of the engine operating condition based on the engine speed NE and the accelerator position ALPH, and a fuel injection starting angle IJsa based on the compression top dead center of the corresponding cylinder is set. Then, at step S82, a fuel injection starting timing IJST is set on the basis of the fuel injection starting, angle IJsa, and the routine ends.

That is, when FHPNG=1, i.e., when the high-pressure fuel system is abnormal, the by-pass selector valve 29 is open to feed the low pressure fuel of the low-pressure fuel system to the injector 13 to inject the low pressure fuel into the cylinder (the combustion chamber 12). Therefore, as shown in FIG. 16, if the fuel injection timing is set in a compression stroke in order to carry out the stratified combustion, the differential pressure between the pressure of the low pressure fuel injected from the injector 13 and the cylinder pressure can not be sufficiently ensured, and the fuel injection quantity can not be accurately measured by the injection-valve opening period of the injector 13 based on the fuel injection pulse width Ti, so that the controllability of fuel injection deteriorates.

Therefore, when the high-pressure fuel system is abnormal, a fuel injection pulse width Ti adapted to the uniform premixed combustion is set on the basis of the engine operating condition based on the engine speed NE and the accelerator position ALPH in accordance with the pressure of the low pressure fuel (0.2 MPa in this preferred embodiment) regulated by the low pressure regulator 28, and a fuel injection timing is set in an exhaust stroke end or intake stroke so as to sufficiently ensure the differential pressure between the pressure of the low pressure fuel and the cylinder pressure, to achieve the uniform premixed combustion. Thus, the fuel injection quantity can be accurately measured by the injection-valve opening period of the injector 13 based on the fuel injection pulse width Ti, so that it is possible to prevent the controllability of fuel injection from deteriorating.

Figure 9:
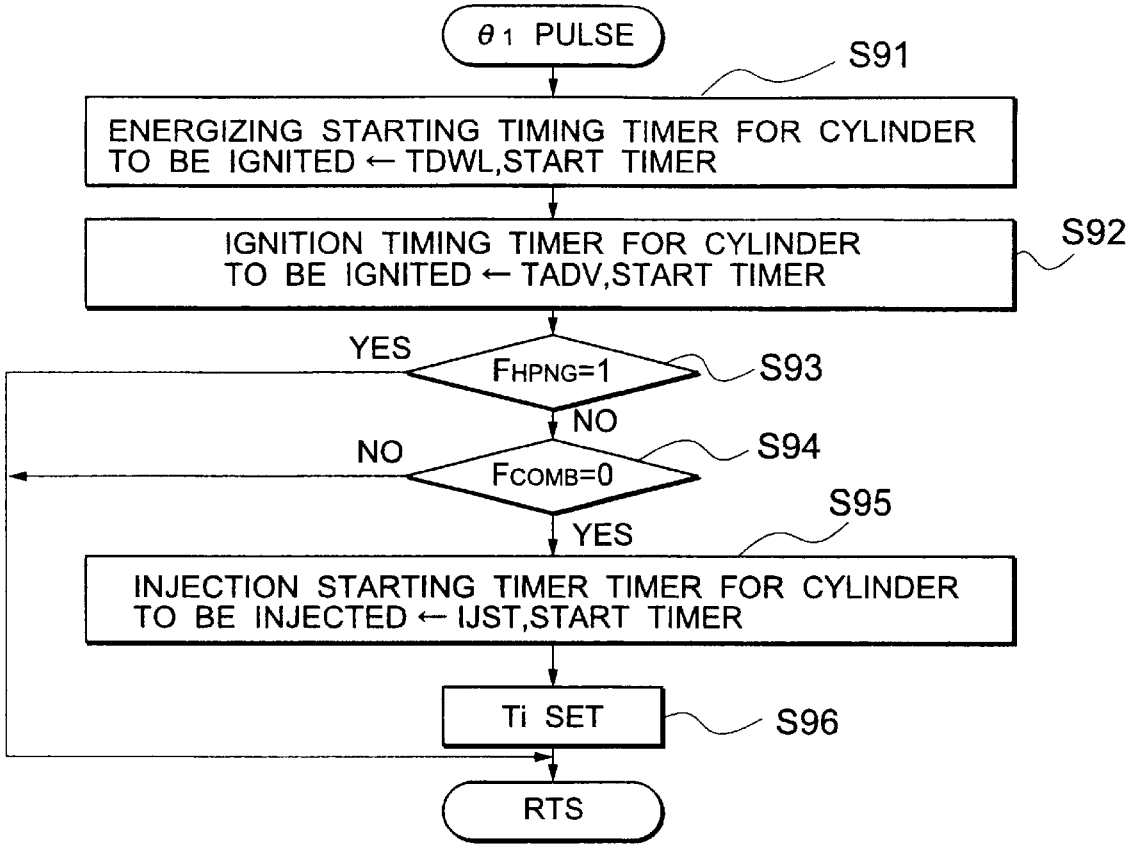
FIG. 9 is a flow chart of a θ1 crank pulse interruption routine in the first preferred embodiment of the present invention.

As a result of the above described steps, the ignition adapted to each of the combustion systems is carried out in the θ1 crank pulse interruption routine of FIG. 9, which is executed in synchronism with the input of the crank pulse θ1.

Moreover, when FHPNG=0, i.e., when the high-pressure fuel system is normal, and when FCOMB=0, i.e., when the stratified combustion is selected, data of a cylinder to be injected, which correspond to the stratified combustion in the above described cylinder determining/engine speed calculating routine, are, read out, and the current fuel injection starting timing IJST and the fuel injection pulse width Ti, which correspond to the stratified combustion set in the above described fuel injection control routine, are read out, by the θ1 crank pulse interruption routine. Then, the fuel injection starting timing IJST is set in the injection starting timing timer for a cylinder to be injected, and the fuel injection pulse width Ti is set in the fuel injection timer. In synchronism with the input of the crank pulse θ1, the injection starting timing timer is started to carry out the fuel injection adapted to the stratified combustion.

The θ1 crank pulse interruption routine of FIG. 9 will be described below.

This θ1 crank pulse interruption routine is executed each time a crank pulse θ1 is inputted in accordance with the engine operation. At steps S91 and S92, data of a cylinder to be injected are read out in the cylinder determining/engine speed calculating routine, and the current energizing starting timing TDWL and the ignition timing TADV are read out in the ignition control routine. Then, the energizing staring timing TDWL and the ignition timing TADV arc set in the energizing timing timer and ignition timing timer of a cylinder to be ignited, respectively, and the respective timers are started.

Then, at step S93, the reference to the high-pressure fuel system NG lag FHPNG is made in the high-pressure fuel system diagnosing routine. When FHPNG=1, i.e., when the high-pressure fuel system is normal, the routine goes to step S94 wherein the reference to the combustion system determining lag FCOMB is made.

When FCOMB=1, i.e., when the uniform premixed combustion is selected, the routine ends directly.

On the other hand, when the high-pressure fuel system is normal and when FCOMB=0, i.e., when the stratified combustion is selected, the routine goes from step F94 to step S95 wherein data of a cylinder #i to be injected during the stratified combustion, the cylinder having been determined by the cylinder determining/engine speed calculating routine, are read out, and the current fuel injection starting timing IJST, which has been set by the fuel injection control routine, is read out. Then, the fuel injection staring timing IJST is set in an injection starting timing timer for a cylinder #i to be injected, and the injection starting timing timer is started.

Then, at step S96, the current fuel injection pulse width Ti, which has been set in the fuel injection control routine, is read out, and the fuel injection pulse width Ti is set in a fuel injection timer for a cylinder #i to be injected. Then, the routine ends.

By the ignition control routine, the energizing starting timing TDWL and the ignition timing TADV are set on the basis of the input of the crank pulse θ1 during either of the stratified combustion and the uniform premixed combustion, so as to be set to a value adapted to each of the combustion systems in accordance with the high-pressure fuel system NG flag FHPNG and the combustion system determining flag FCOMB. The fuel injection starting timing IJST and the fuel injection pulse width Ti are also set to values adapted to each of the combustion systems in accordance with the combustion system determining flag FCOMB.

That is, when FHPNG=0, i.e., when the high-pressure fuel system is normal, and when FCOMB=0, i.e., when the stratified combustion is selected, the fuel injection timing IJST and fuel injection pulse width Ti, which are adapted to the stratified combustion, are set. In addition, at steps S95 and S96, the current fuel injection starting timing IJST and fuel injection pulse width Ti, which arc adapted to the stratified combustion, are read out to be set in the injection starting timing timer and the fuel injection timer, respectively. In addition, at this time, the fuel injection starting timing IJST are set on the basis of the input of the crank pulse θ1.

Therefore, when FHPNG=0, i.e., when the high-pressure fuel system is normal, and when FCOMB=0, i.e., when the stratified combustion is selected, the injection starting timer is started at step S95 of this routine, which is executed in synchronism with the input of the crank pulse θ1, and the clocking of the fuel injection starting timing IJST is started.

That is, when FHPNG=0, i.e., when the high-pressure fuel system is normal, and when FCOMB=0, i.e., when the stratified combustion is selected, if this routine is executed by the input of the crank pulse θ1 of BTDC of the cylinder #2 as shown in the time chart of FIG. 14, the cylinder to be ignited is the cylinder #2, and the cylinder to be injected is the cylinder #2, which has been determined when the last crank pulse θ2 is inputted.

In order to facilitate better understanding of the invention, as shown in FIGS. 14 and 15, the same cylinder (cylinder #2) will be described. When the high-pressure fuel system is normal and when the stratified combustion is selected, the injection starting timing timer for a corresponding cylinder is started by the input of the crank pulse θ1 at a crank angle before compression top dead center of the corresponding cylinder as shown in FIG. 14.

At this time, the fuel injection staring timing IJST, which has been set by the inverse operation from the ignition timing TADV by means of the fuel injection control routine and which is adapted to the stratified combustion, is set in the injection stating timing timer. This fuel injection starting timing IJST defines the time suited to carry out the stratified combustion wherein after the fuel is injected before the ignition based on the ignition timing TADV, the fuel spray from the injector 13 reaches a portion between discharge electrodes of the spark plug 14 by the cylinder intake air flow, and the rear end portion of the fuel spray is ignited by the spark plug 14.

Figure 11:
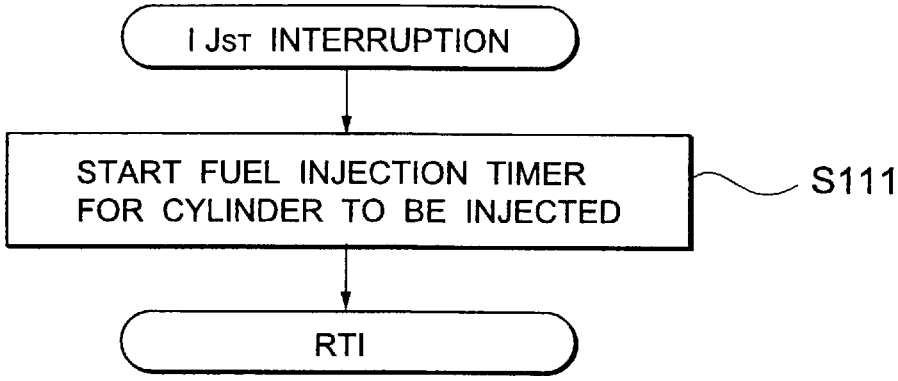
FIG. 11 is a flow chart of an IJST interruption routine in the first preferred embodiment of the present invention.

When the time clocked by the injection starting timing timer reaches the fuel injection starting timing IJST, the IJST interruption routine of FIG. 11 is started. At step S11, the fuel injection timer for the corresponding cylinder is started, and the routine ends.

As a result, an injector driving signal based on the fuel injection pulse width Ti, which has been set in the fuel injection timer, is outputted to the injector 13 for the corresponding cylinder (see FIG. 14), so that a predetermined amount of fuel measured by the injector valve opening period corresponding to the fuel injection pulse width Ti is injected from the injector 13 for the corresponding cylinder.

When FHPNG=0, i.e., when the high-pressure fuel system is normal, the by-pass selector valve 29 provided in the fuel by-pass passage 21*d* is closed by the by-pass selector valve control routine, and a high-pressure fuel pressurized by the high pressure pump 25 to be regulated to a predetermined controlled fuel pressure PfB by the high pressure regulator 27 is fed to the injector 13 similar to conventional systems.

In addition, when FHPNG=0, i.e., when the high-pressure fuel system is normal, and when FCOMB=0, i.e., when the stratified combustion is selected, the fuel injection pulse width Ti is set so as to have an appropriate value as follows. That is, a basic fuel injection quantity GF adapted to the stratified combustion is set by the fuel injection control routine on the basis of the engine operating condition based on the engine speed NE and the accelerator position ALPH, and the basic fuel injection quantity GF is converted to a basic fuel injection pulse width Tp in accordance with the controlled fuel pressure PfB regulated by the high pressure regulator 27. Moreover, the basic fuel injection pulse width Tp is set so as to compensate the variation of the actual fuel injection quantity based on the fuel pressure Pf of the high-pressure fuel system by the fuel pressure correction factor Kp. Then, the fuel injection pulse width Ti is set so that the actual fuel injection quantity injected from the injector 13 is coincident with a required injection quantity which is set in accordance with the engine operating condition.

Thus, the fuel pressure fed to the injector 13 is compatible with the fuel injection pulse width Ti, and an appropriate quantity of fuel corresponding to a required injection quantity, which is measured in accordance with the fuel injection pulse width Ti and adapted to the stratified combustion and which ensures a predetermined output in accordance with the engine operating condition, is injected from the injector 13 of the corresponding cylinder.

In addition, when FHPNG=0, i.e., when the high-pressure fuel system is normal, and when FCOMB=0, i.e., when the stratified combustion is selected, the ignition timing TADV adapted to the stratified combustion is set by the ignition control routine, and the energizing starting timing TDWL is set by the ignition control routine on the basis of the ignition timing TADV. At steps S91 and S92 of the θ1 crank pulse interruption routine, the current energizing starting timing TDWL and the current ignition timing TADV, which is adapted to the stratified combustion, are read to be set in the energizing starting timing timer and ignition timing timer for the corresponding one of cylinders, and the energizing starting timing timer and ignition timing timer are also started in synchronism with the input of the crank pulse θ1 of BTDC of the corresponding cylinder.

Figure 12:
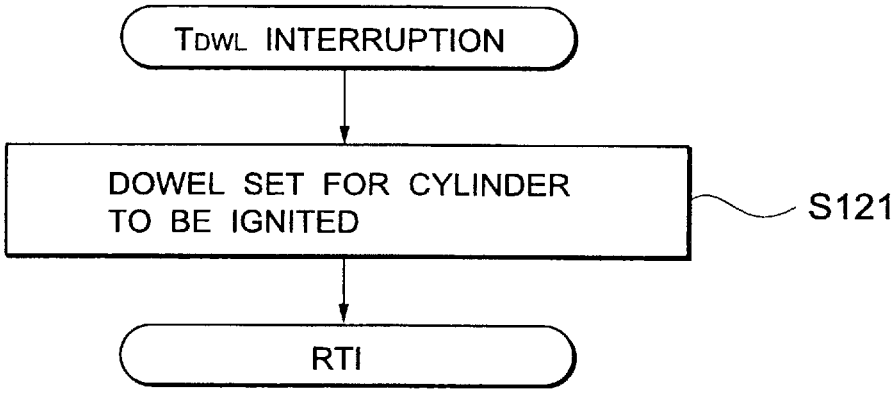
FIG. 12 is a flow chart of a TDWL interruption routine in the first preferred embodiment of the present invention.

Then, when the time clocked by the energizing starting timing timer reaches the energizing starting timing TDWL, the TDWL interruption routine of FIG. 12 is started. At step S121, an energizing signal to a corresponding cylinder is outputted from the ECU 50 to the igniter 16 by the dwell set for the corresponding cylinder (see FIG. 14), and the energizing (dwell) of the spark coil 15 of the corresponding cylinder is started.

Figure 13:
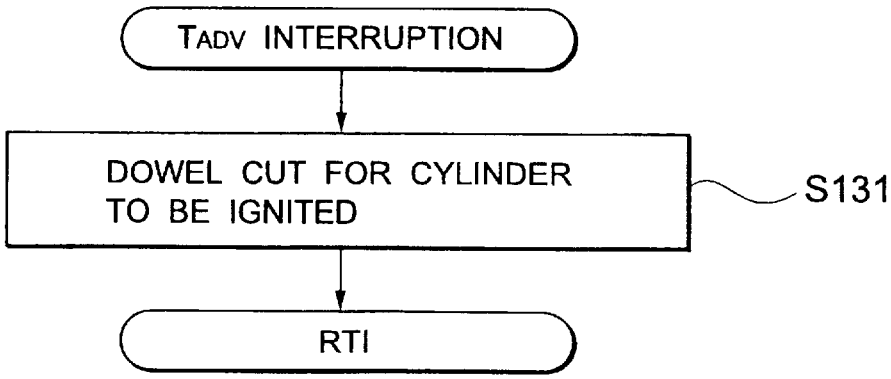
FIG. 13 is a flow chart of a TADV interruption routine in the first preferred embodiment of the present invention.

Thereafter, when the time clocked by the ignition timing timer reaches the ignition timing TADV which has been set in the ignition timing timer and which is adapted to the stratified combustion, the TADV interruption routine of FIG. 13 is started. At step S131, the dwell to the ignition coil 15 of the corresponding cylinder is cut, and the routine ends.

As a result, a high secondary voltage is induced in the ignition coil 15 of the corresponding cylinder, and the discharge electrode of the spark plug 14 of the corresponding cylinder is sparked.

When FHPNG=0, i.e., when the high-pressure fuel system is normal, and when FCOMB=0, i.e., when the stratified combustion is selected, the fuel injection starting timing IJST is set by the inverse operation based on the ignition timing TADV as described above. Therefore, when the fuel spray from the injector 13 surely reaches a portion between the discharge electrodes of the spark plug 14 by the cylinder intake air flow, the spark plug 14 of the corresponding cylinder is ignited to burn the rear end portion of the fuel spray, so that flames are propagated in the fuel spray air-fuel mixture to carry out the stratified combustion. Thus, during low engine speeds with low loads, when FHPNG=0, i.e., when the high-pressure fuel system is normal, the stratified combustion can improve fuel consumption and exhaust emission.

Figure 10:
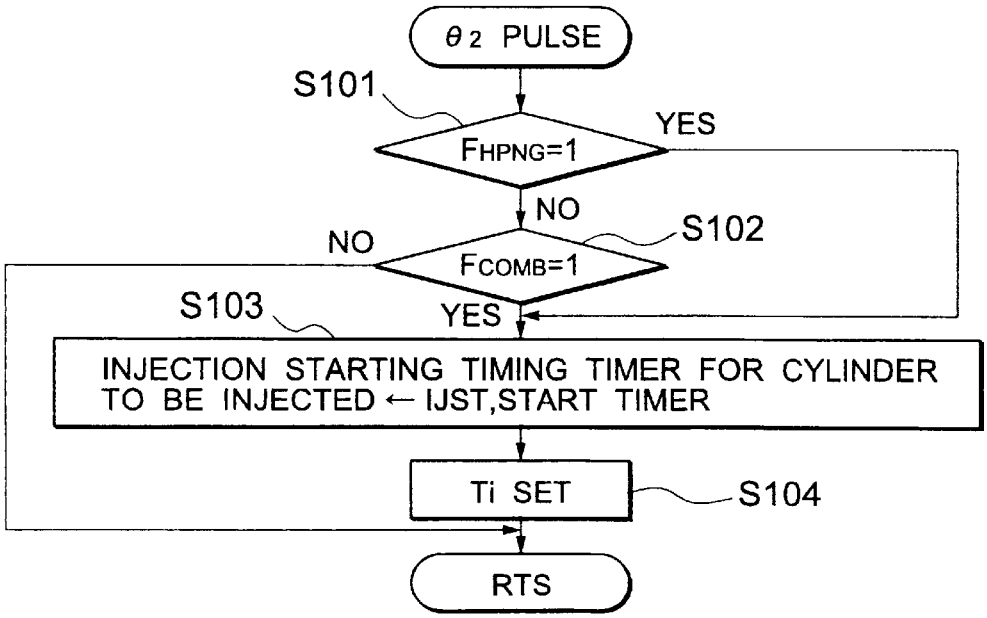
FIG. 10 is a flow chart of a θ2 crank pulse interruption routine in the first preferred embodiment of the present invention.

On the other hand, when FHPNG=0, i.e., when the high-pressure fuel system is normal, and when FCOMB=1, i.e., when the uniform premixed combustion is selected, or when FHPNG=0, i.e., when the high-pressure fuel system is abnormal, data of a cylinder to be injected, which correspond to the uniform premixed combustion, are read out, and the current fuel injection starting timing IJST and fuel injection pulse width Ti, which have been set in the fuel injection control routine and which correspond to the uniform premixed combustion, are read out, in a θ2 crank pulse interruption routine of FIG. 10, which is started in synchronism with the input of the crank pulse θ2. Then, the fuel injection starting timing IJSF is set in the injection starting timing timer of the cylinder to be injected, and the fuel injection pulse width Ti is set in the fuel injection timer. The injection starting timing timer is started in synchronism with the input of the crank pulse θ2 to carry out the fuel injection adapted to the uniform premixed combustion.

The θ2 crank pulse interruption routine of FIG. 10 will be described below. At step S101, the high-pressure fuel system diagnosing routine makes reference to the high-pressure fuel system NG flag FHPNG. When FHPNG=1, i.e., when the high-pressure fuel system is abnormal, the routine jumps to step S103. When FHPNG=0, i.e., when the high-pressure fuel system is normal, the routine goes to step S102 wherein the reference to the combustion system determining flag FCOMB is made.

Then, when FCOMB=0, i.e., when the stratified combustion is selected, the routine ends directly.

On the other hand, when the high-pressure fuel system is normal and when FCOMB=1, i.e., when the uniform premixed combustion is selected, or when FHPNG=1, i.e., when the high-pressure fuel system is abnormal, the routine goes from the corresponding step to step S103 wherein a cylinder data #i to be injected during the uniform premixed combustion, which has been determined by the cylinder determining/engine speed calculating routine, is read out and the current fuel injection starting timing IJST, which has been set by the fuel injection control routine, is read out. In addition, the fuel injection starting timing IJST is set in the injection starting timing timer of the cylinder #i to be injected, and the injection starting timing timer is started.

Then, at step S104, the current fuel injection pulse width Ti, which has been set by the fuel injection control routine, is read out, and this fuel injection pulse width Ti is set in the fuel injection timer of the cylinder #i to be injected. Then, the routine ends.

When FHPNG=0, i.e., when the high-pressure fuel system is normal, and when FCOMB=1, i.e., when the uniform premixed combustion is selected, or when FHPNG=1, i.e., when the high-pressure fuel system is abnormal, the fuel injection timing IJST, which has been set by the inverse operation on the basis of the compression top dead center of the corresponding cylinder and which is adapted to the uniform premixed combustion, is set and the fuel injection pulse width Ti for obtaining the fuel injection quantity, which is adapted to the uniform premixed combustion and which is used for obtaining the predetermined engine output corresponding to the engine operating condition at that time, is set.

Therefore, at steps S103 and S104, the current fuel injection starting timing IJST and the current fuel injection pulse width Ti, which are adapted to the uniform premixed combustion, are read out to be set in the injection starting timing timer and the fuel injection timer, respectively. In addition, as shown in FIG. 15, the injection starting timing timer of the corresponding cylinder is started by the input of the crank pulse θ2, two pulses before compression top dead center of the corresponding cylinder.

Then, when the time clocked by the injection starting timing timer reaches the fuel injection starting timing IJST, the IJST interruption routine of FIG. 11 is started, and the fuel injection timer of the corresponding cylinder is started at step S111. Then, the routine ends.

As a result, an injector driving signal based on the fuel injection pulse width Ti, which has been set in the fuel injection timer, is outputted to the injector 13 of the corresponding cylinder (see FIG. 15), and a predetermined amount of fuel measured by the injector valve opening period corresponding to the fuel injection pulse width Ti is injected.

When FHPNG=0, i.e., when the high-pressure fuel system is normal, the by-pass selector valve 29 provided in the fuel by-pass passage 21*d* is open by the by-pass selector valve control routine, and a high pressure fuel, which has been pressurized by the high pressure pump 25 to be regulated to a predetermined controlled fuel pressure PfB by the high pressure regulator 27, is fed to the injector 13.

When FHPNG=0, i.e., when the high-pressure fuel system is normal, and when FCOMB=1, i.e., when the uniform premixed combustion is selected, the fuel injection pulse width Ti is set so as to have an appropriate value as follows. That is, a basic fuel injection quantity GF adapted to the uniform premixed combustion is set by the fuel injection control routine on the basis of the engine operating condition based on the engine speed NE and the accelerator position ALPH, and the basic fuel injection quantity GF is converted to a basic fuel injection pulse width Tp in accordance with the controlled fuel pressure PfB regulated by the high pressure regulator 27. Moreover, the basic fuel injection pulse width Tp is set so as to compensate the venation of the actual fuel injection quantity based on the fuel pressure Pf of the high-pressure fuel system by the fuel pressure correction factor Kp. Then, the fuel injection pulse width Ti is set so that the actual fuel injection quantity injected from the injector 13 is coincident with a required injection quantity which is set in accordance with the engine operating condition.

Thus, when FHPNG=0, i.e., when the high-pressure fuel system is normal, and when FCOMB=1, i.e., when the uniform premixed combustion is selected, the pressure of the high pressure fuel fed to the injector 13 is compatible with the fuel injection pulse width Ti, and an appropriate quantity of fuel corresponding to a required injection quantity, which is measured in accordance with the fuel injection pulse width Ti so as to be adapted to the uniform premixed combustion and which obtains a predetermined engine output air-fuel ratio in accordance with the engine operating condition at that time, is injected from the injector 13 of the corresponding cylinder.

On the other hand, when FHPNG=1, i.e., when the high-pressure fuel system is abnormal, the by-pass selector valve 29 provided in the fuel by-pass passage 21*d* is open by the by-pass selector valve control routine to establish the communication between the high-pressure fuel system and the low-pressure fuel system via the fuel by-pass passage 21*d*, so that a low pressure fuel, which has been fed from the feed pump 24 and regulated to a predetermined fuel pressure by the low pressure regulator 28, is fed to the injector 13 regardless of the high pressure fuel fed by the high pressure pump and the high pressure regulator 27.

When the high-pressure fuel system is abnormal, the fuel injection pulse width Ti is set by the fuel injection control routine on the basis of the engine operating condition based on the engine speed NE and the accelerator position ALPH so as to be coincident with the pressure of the low pressure fuel regulated by the low pressure regulator 28 and so as to be adapted to the uniform premixed combustion. In addition, the fuel injection pulse width Ti is set so that the actual fuel injection quantity injected from the injector corresponds to a required injection quantity while the pressure of the fuel fed to the injector 13 is the pressure of a low pressure fuel regulated by the low pressure regulator 28.

Thus, even if FHPNG=1, i.e., even if the high-pressure fuel system is abnormal, the pressure of the low pressure fuel fed to the injector is compatible with the fuel injection pulse width Ti, and an appropriate quantity of fuel corresponding to a required injection quantity, which is measured in accordance with the fuel injection pulse width Ti so as to be adapted to the uniform premixed combustion and which ensures a predetermined output in accordance with the engine operating condition at that time, is injected from the injector 13 of the corresponding cylinder.

Moreover, at this time, since the fuel injection timing is set in an exhaust stroke end or intake stroke, wherein the cylinder pressure is low, by the fuel injection starting timing IJST in accordance with the uniform premixed combustion, the differential pressure between the pressure of the low pressure fuel injected from the injector 13 and the cylinder pressure is sufficiently ensured, and the fuel injection quantity can be accurately measured by the injection-valve opening period of the injector 13, so that it is possible to prevent the controllability of fuel injection from deteriorating.

Thereafter, the θ1 crank pulse interruption routine is started by the crank pulse θ1 of BTCD of the corresponding cylinder. Then, the current energizing starting timing TDWL and the ignition timing TADV are set in the energizing starting timing timer and ignition timing timer for the corresponding cylinder, respectively, and the respective timers are started.

When FHPNG=0, i.e., when the high-pressure fuel system is normal, and when FCOMB=1, i.e., when the uniform premixed combustion is selected, or when FHPNG=1, i.e., when the high-pressure fuel system is abnormal, the ignition timing TADV adapted to the uniform premixed combustion and the energizing starting timing TDWL based on the ignition timing TADV have been set by the ignition control routine. Therefore, at steps S91 and S92 of the θ1 crank pulse interruption routine, the current energizing starting timing TDWL and the current ignition timing TADV adapted to the uniform premixed combustion are read out to be set in the energizing starting timing timer and ignition timing timer for the corresponding cylinder, respectively, and the energizing starting timing timer and ignition timing timer for the corresponding cylinder are started in synchronism with the input of the crank pulse θ1 of BTDC of the corresponding cylinder.

Then, when the time clocked by the energizing starting timer reaches the energizing starting timing TDWL, the TDWL interruption routine of FIG. 12 is started. At step S121, an energizing signal for the corresponding cylinder is outputted from the ECU 50 to the igniter 16 by the dwell set of the corresponding cylinder (see FIG. 15), and the energizing (dwell) of the ignition coil 15 of the corresponding cylinder is started.

Thereafter, the time clocked by the ignition timing timer reaches the ignition timing TADV which has been set in the ignition timing timer so as to be adapted to the uniform premixed combustion, the TADV interruption routine of FIG. 13 is started, and the dwell of the ignition coil 15 of the corresponding cylinder is cut at step S131. Thus, a high secondary voltage is induced in the ignition coil 15 of the corresponding cylinder, and the discharge electrode of the spark plug 14 of the corresponding cylinder is sparked.

As described above, the fuel injection timing IJST during the uniform premixed combustion is set in the exhaust stroke end or intake stroke by the inverse operation based on the compression top dead center of the corresponding cylinder, and the fuel injection is started when an appropriate uniform premixed state of the fuel spray and new air can be obtained during ignition.

Therefore, in the state that the injected fuel is sufficiently mixed with new air in the combustion chamber 12, i.e., in the uniform premixed state that the fuel spray is sufficiently diffused, ignition is carried out, so that the air-fuel mixture in the uniform premixed state is immediately burned. Thus, when FHPNG=0, i.e., when the high-pressure fuel system is normal, during high engine speeds with high loads, a high mean effective pressure can be obtained by the uniform premixed combustion, so that it is possible to ensure a required engine output and to improve the engine output.

In addition, when FHPNG=1, i.e., when the high-pressure fuel system is abnormal, the low pressure fuel of the low-pressure fuel system is fed directly to the injector 13, and the uniform premixed combustion is carried out by the early injection regardless of the selection of the fuel combustion system, so that it is possible to prevent the controllability of fuel injection from deteriorating due to the abnormal fuel pressure of the high-pressure fuel system and to prevent the engine combustion state from deteriorating.

Figure 24:
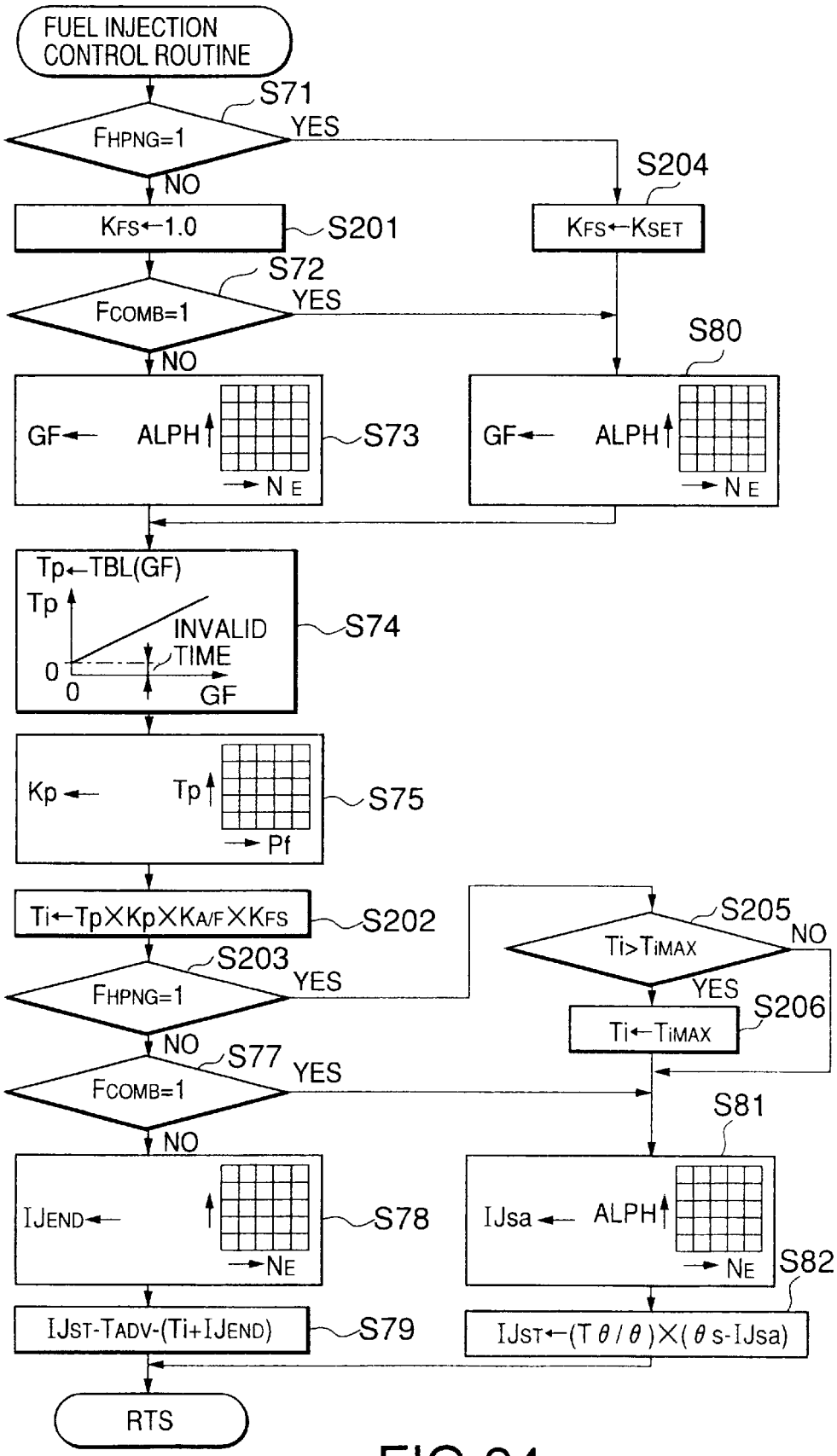
FIG. 24 is a flow chart of a fuel injection control routine in the second preferred embodiment of the present invention.

Referring to FIG. 24, the second preferred embodiment of the present invention will be described below.

In the above described first preferred embodiment, the abnormal period fuel injection pulse width table has been provided for storing therein the fuel injection pulse width Ti suited to obtain the required injection quantity, which is adapted to the uniform premixed combustion at the pressure of the low pressure fuel regulated by the low pressure regulator 28, by using the engine speed NE and the accelerator position ALPH as parameters. When FHPNG=1, i.e., when the high-pressure fuel system is abnormal, the fuel injection pulse width Ti adapted to the uniform premixed combustion has been set on the basis of the engine operating condition based on the engine speed NE and the accelerator position ALPH in accordance with the pressure of the low pressure fuel regulated by the low pressure regulator 28, by making reference to the abnormal period fuel injection pulse width table.

On the other hand, in this preferred embodiment, when the high-pressure fuel system is abnormal, similar to when the high-pressure system is normal and when the uniform premixed combustion is selected, a basic fuel injection quantity GF adapted to the uniform premixed combustion is set by a uniform premixed combustion period basic fuel injection quantity table, and the basic fuel injection quantity GF is converted by the basic fuel injection pulse width table to a basic fuel injection pulse width Tp in accordance with a controlled fuel pressure PfB regulated by the high pressure regulator 27. Moreover, when the high-pressure fuel system is abnormal, an abnormal period correction factor KFS for correcting to increase the basic fuel injection pulse width Tp is set in accordance with the pressure of a low pressure fuel regulated by the low pressure regulator 28. This abnormal period correction factor KFS is incorporated into an operation expression for the fuel injection pulse width Ti, so that the basic fuel injection pulse width Tp, which has been set in accordance with the controlled fuel pressure PfB regulated by the high pressure regulator 27, is corrected to be increased in accordance with the pressure of the low pressure fuel regulated by the low pressure regulator 28 to briefly set a fuel injection pulse width Ti adapted to the uniform premixed combustion in accordance with the pressure of the low pressure fuel regulated by the low pressure regulator 28 when the high-pressure fuel system is abnormal.

Thus, it is possible to omit the abnormal period fuel injection pulse width table, so that it is possible to reduce the man-hour for the data setting of the fuel injection pulse width Ti stored in the abnormal period fuel injection table, and the capacity of the memory (ROM 52) used by the table. In addition, since a single abnormal period correction factor KFS can be used, the setting operations of the fuel injection pulse width Ti during the normal and abnormal states of the high-pressure fuel system can be commonly used to some extent to simplify the control in comparison with the first preferred embodiment, so that the data setting man-hour can be remarkably reduced.

Specifically, in this preferred embodiment, a fuel injection control routine of FIG. 24 is used in place of the fuel injection control routine of FIG. 8 in the first preferred embodiment.

Furthermore, other routines are the same as those in the first preferred embodiment, so that the descriptions thereof are omitted. In addition, in the fuel injection control routine of FIG. 24, the same reference numbers are used for the same steps as those in the first preferred embodiment, and the detailed descriptions thereof are omitted.

The fuel injection control routine of FIG. 24 will be described below.

Similar to the first preferred embodiment, the fuel injection control routine of FIG. 24 is executed every a predetermined period of time (e.g., 10 msec) after the system initialization. First, at step S71, the reference to a high-pressure fuel system NG flag FHPNG is made. When FHPNG=0, i.e., when the high-pressure fuel system is normal, the routine goes to step S201 wherein an abnormal period correction factor KFS for increasing a basic fuel injection pulse width Tp during the abnormal state of the high-pressure fuel system is set to be "1.0" (KFS←0).

That is, when FHPNG=0, i.e., when the high-pressure fuel system is normal, the by-pass selector valve 29 is closed by the by-pass selector vale control routine, so that a high pressure fuel regulated by the high pressure regulator 27 is fed to the injector 13. The basic fuel injection pulse width Tp, which is an object to be corrected by the abnormal period correction factor KFS, is set in accordance with a controlled fuel pressure PfB (=7 MPa) regulated by the high pressure regulator 27, by a process which will be described later. Moreover, the abnormal period correction factor Kp is given as a multiplying term for the basic fuel injection pulse width Tp as shown at step S202 which will be described later.

Therefore, when FHPNG=0, i.e., when the high-pressure fuel system is normal, the abnormal period correction factor KFS is set to be "1.0" so that no corrections are made in the abnormal period correction factor KFS.

Thereafter, the routine goes to step S72 wherein the reference to a combustion system determining flag FCOMB is made.

Then, when FCOMB=0, i.e., when the stratified combustion is selected, the routine goes to step S73 wherein the reference to a stratified combustion period basic fuel injection quantity table is made with the interpolation calculation on the basis of the engine operating condition based on the engine speed NE and the accelerator position ALPH, to set a basic fuel injection quantity GF corresponding to a required injection quantity, which is adapted to the stratified combustion and which is used for obtaining a predetermined engine output.

After the basic fuel injection quantity GF is set, the routine goes to step S74 wherein the reference to a basic fuel injection pulse width table is made with the interpolation calculation on the basis of the basic fuel injection quantity GF, to set a basic fuel injection pulse width Tp for the injector 13, which is used for obtaining the basic fuel injection quantity GF, at a controlled fuel pressure PfB (=7 MPa) regulated by the high pressure regulator 27. Subsequently, at step S75, the reference to a fuel pressure correction factor table is made with the interpolation calculation on the basis of a fuel pressure Pf detected by the fuel pressure sensor 35 and the basic fuel injection pulse width Tp, to set a fuel pressure correction factor Kp.

Furthermore, similar to the first preferred embodiment, the range of fuel pressure as a parameter in the fuel pressure correction factor table covers fuel pressures in a practical use range of the high-pressure fuel system in view of the rising process of the fuel pressure Pf during start-up, so that it is set to be in the range of, e.g., from 1 MPa to 9 MPa.

Then, at step S202, the basic fuel injection pulse width Tp is multiplied by the fuel pressure correction factor Kp and an air-fuel ratio correction factor KA/F to carry out the pressure correction and the air-fuel ratio correction, and multiplied by the correction factor KFS, which has been set at step S201, to set a final fuel injection pulse width Ti for the injector 13 (Ti←Tp×Kp×KA/F×KFS).

At this time, the abnormal period correction factor KFS has been set to be KFS=1.0 as described above. Therefore, when the high-pressure fuel system is normal and when the stratified combustion is selected, the increasing correction using the abnormal period correction factor KFS is not carried out, and a fuel injection pulse width Ti adapted to the stratified combustion is set in accordance with the controlled fuel pressure PfB regulated by the high pressure regulator 27.

That is, when FHPNG=0, i.e., when the high-pressure fuel system is normal, the by-pass selector valve 29 provided in the fuel by-pass passage 21*d* is closed by the by-pass selector valve control routine, and the high pressure fuel pressurized by the high pressure pump 25 to be regulated to the predetermined controlled fuel pressure PfB by the high pressure regulator 27 is fed to the injector in the usual manner.

Then, when FHPNG=0, i.e., when the high-pressure fuel system is normal, and when FCOMB=0, i.e., when the stratified combustion is selected, the fuel injection pulse width Ti is set so as to have an appropriate value as follows. That is, a basic fuel injection quantity GP adapted to the stratified combustion is set on the basis of the engine operating condition based on the engine speed NE and the accelerator position ALPH, and the basic fuel injection quantity GF is converted to a basic fuel injection pulse width Tp in accordance with the controlled fuel pressure PfB regulated by the high pressure regulator 27. Moreover, the basic fuel injection pulse width Tp is set so as to compensate the variation of the actual fuel injection quantity based on the fuel pressure Pf of the high-pressure fuel system by the fuel pressure correction factor Kp. Then, the fuel injection pulse width Ti is set so that the actual fuel injection quantity injected from the injector 13 is coincident with a required injection quantity which is set in accordance with the engine operating condition.

Thus, the fuel pressure fed to the injector 13 is compatible with the fuel injection pulse width Ti, and when FHPNG=0,i.e., when the high-pressure fuel system is normal, and when FCOMB=0, i.e., when the stratified combustion, an appropriate amount of fuel corresponding to the required injection quantity, which is measured in accordance with the fuel injection pulse width Ti and which is adapted to the stratified combustion and ensures a predetermined output corresponding to the engine operating condition at that time, can be injected from the injector 13 of the corresponding cylinder similar to the first preferred embodiment.

Then, at step S203, the reference to the high-pressure fuel system NG flag FHPNG is made again. When FHPNG=0, i.e., when the high-pressure fuel system is normal, the routine goes to step S77 wherein the reference to the combustion system determining flag FCOMB is made.

When FCOMB=0, i.e., when the stratified combustion is selected, the routine goes to step S78 wherein the reference to a fuel injection end timing table is made with the interpolation calculation on the basis of the engine operating condition based on the engine speed NE and the accelerator position ALPH, to set a fuel injection end timing IJEND. Then, at step S79, an ignition timing TADV is read out by the ignition control routine, and a fuel injection starting timing IJST based on the input of the crank pulse θ1 is set by subtracting the fuel injection timing IJEND and the fuel injection pulse width Ti from the ignition timing TADV. Then, the routine ends.

On the other hand, when FHPNG=0, i.e., when the high-pressure fuel system is normal, and when FCOMB=1 at step S72, i.e., when the uniform premixed combustion is selected, the routine goes from step S72 to step S80 wherein the reference to a uniform premixed combustion period basic fuel injection quantity table is made with the interpolation calculation on the basis of the engine operating condition based on the engine speed NE and the accelerator position ALPH, and a basic fuel injection quantity GF which is adapted to the uniform premixed combustion and which is used for obtaining a predetermined output air-fuel ratio, is set.

After the basic fuel injection quantity GF is set, the routine goes to step S74 wherein the reference to a basic fuel injection pulse width table is made with the interpolation calculation on the basis of the basic fuel injection quantity GF, to set a basic fuel injection pulse width Tp for the injector 13 which is used for obtaining the basic fuel injection quantity GF at a controlled fuel pressure PfB regulate( by the high pressure regulator 27. Then, at step S75, the reference to a fuel pressure correction factor table is made with the interpolation calculation on the basis of the fuel pressure Pf detected by the fuel pressure sensor 35 and the basic fuel injection pulse width Tp, to set a fuel pressure correction factor Kp.

Then, at step S202, the basic fuel injection pulse width Tp is multiplied by the fuel pressure correction factor Kp, an air-fuel ratio feedback correction factor KA/F and an abnormal period correction factor KFS to set a final fuel injection pulse width Ti for the injector 13 (Ti←Tp×Kp×KA/F×KFS).

At this time, the abnormal period correction factor KFS is set to be KFS=1.0 at step S201. Therefore, when the high-pressure fuel system is normal and when the uniform premixed combustion is selected, the increasing correction using the abnormal period correction factor KFS is not carried out, and a fuel injection pulse width Ti adapted to the uniform premixed combustion is set in accordance with the controlled fuel pressure PfB regulated by the high pressure regulator 27.

When FHPNG=0, i.e., when the high-pressure fuel system is normal, the by-pass selector valve 29 provided in the fuel by-pass passage 21*d* is open by the by-pass selector valve control routine, and a high pressure fuel pressurized by the high pressure pump 25 to be regulated to a predetermined controlled fuel pressure PfB by the high pressure regulator 27 is fed to the injector 13.

Then, when FHPNG=0, i.e., when the high-pressure fuel system is normal, and when FCOMB=1, i.e., when the uniform premixed combustion is selected, the fuel injection pulse width Ti is set so as to have an appropriate value as follows. That is, a basic fuel injection quantity GF adapted to the uniform premixed combustion is set on the basis of the engine operating condition based on the engine speed NE and the accelerator position ALPH, and the basic fuel injection quantity GF is converted to a basic fuel injection pulse width Tp in accordance with the controlled fuel pressure PfB regulated by the high pressure regulator 27. Moreover, the basic fuel injection pulse width Tp is set so as to compensate the variation of the actual fuel injection quantity based on the fuel pressure Pf of the high-pressure fuel system by the fuel pressure correction factor Kp. Then, the fuel injection pulse width Ti is set so that the actual fuel injection quantity injected from the injector 13 is coincident with a required injection quantity which is set in accordance with the engine operating condition.

Thus, the pressure of the high pressure fuel fed to the injector 13 is compatible with the fuel injection pulse width Ti, and an appropriate quantity of fuel corresponding to a required injection quantity, which is measured in accordance with the fuel injection pulse width Ti and which is adapted to the uniform premixed combustion and obtains a predetermined engine output air-fuel ratio in accordance with the engine operating condition at that time, can be injected from the injector 13 of the corresponding cylinder.

Then, at step S203, the reference to the high-pressure fuel system NG flag FHPNG is made again. When FHPNG=0, i.e., when the high-pressure fuel system is normal, the reference to a combustion system determining flag FCOMB is made at step S77. When FCOMB=1, i.e., when the uniform premixed combustion is selected, the routine goes from step S77 to step S81.

At step S81, the reference to a fuel injection stating angle table is made with the interpolation calculation on the basis of the engine operating condition based on the engine speed NE and the accelerator position ALPH, to set a fuel injection starting angle IJsa based on the compression top dead center of the corresponding cylinder. Subsequently, at step S82, a fuel injection starting timing IJST is set on the basis of the fuel injection starting angle lJsa, and the routine ends.

On the other hand, when FHPNG=1 at step S71, i.e., when the high-pressure fuel system is abnormal, the routine goes to step S204 regardless of the selection of the combustion system.

Then, at step S204, an abnormal period correction factor KFS is newly set by a preset value KSET (KFS←KSET).

When FHPNG=1, i.e., when the high-pressure fuel system is abnormal, the by-pass selector value 29 is open by the by-pass selector valve control routine, so that a low pressure fuel regulated by the low pressure regulator 28 is fed to the injector 13. In addition, in this preferred embodiment, even if the high-pressure fuel system is abnormal, a basic fuel injection quantity GF adapted to the uniform premixed combustion is set by a uniform premixed combustion period basic fuel injection quantity table, and the basic fuel injection quantity GF is converted to a basic fuel injection pulse width Tp by the basic fuel injection pulse width table in accordance with the controlled fuel pressure PfB (=7 MPa) regulated by the high pressure regulator 27.

Moreover, the basic fuel injection pulse width Tp, which has been set in accordance with the controlled fuel pressure PfB (=7 MPa) regulated by the high pressure regulator 27, are corrected so as to be increased by the abnormal period correction factor KFS in accordance with the pressure of the low pressure fuel (=0.2 MPa) regulated by the low pressure regulator 28, to set a fuel injection pulse width Ti which corresponds to the pressure of the low pressure fuel regulated by the low pressure regulator 28 and which is adapted to the uniform premixed combustion, so that the fuel pressure fed to the injector 13 is compatible with the fuel injection pulse width Ti.

Therefore, the preset value KSET for setting the abnormal period correction factor KFS when the high-pressure fuel system is abnormal is set as follows. First, a coefficient value for correcting to increase the basic fuel injection pulse width Tp, which has been set in accordance with the controlled fuel pressure PfB (=7 MPa) regulated by the high pressure regulator 27, to obtain the same fuel injection quantity as a required injection quantity is previously derived by simulations or experiments while the low pressure fuel regulated by the low pressure regulator 28 is fed to the injector 13. The derived coefficient value is set as the preset value KSET to be stored in the ROM 52 as fixed data. In this preferred embodiment, the preset value KSET is set to be, e.g., KSET=2~2.5.

After the abnormal period correction factor KFS is set, the routine goes to step S80 wherein the reference to a uniform premixed combustion period basic fuel injection quantity table is made with the interpolation calculation on the basis of the engine speed NE and the accelerator position ALPH, to set a basic fuel injection quantity GF which is adapted to the uniform premixed combustion and which is used for obtaining a predetermined output.

Then, at step S74, the reference to a basic fuel injection pulse width table is made with the interpolation calculation on the basis of the basic fuel injection quantity GF, to set a basic fuel injection pulse width Tp corresponding to the controlled fuel pressure PfB (=7 MPa) regulated by the high pressure regulator 27. Moreover, at step S75, the reference to a fuel pressure correction factor table is made with the interpolation calculation on the basis of the fuel pressure Pf detected by the fuel pressure sensor 35 and the basic fuel injection pulse width Tp, to set a fuel pressure correction factor Kp, and the routine goes to step S202.

At step S202, the basic fuel injection pulse width Tp is multiplied by the fuel pressure correction Kp and an air-fuel ratio feedback correction factor KA/F, and multiplied by the abnormal period correction coefficient KFS, which has been newly set at step S204, so that the basic fuel injection pulse width Tp, which has been set in accordance with the controlled fuel pressure PfB (=7 MPa) regulated by the high pressure regulator 27, is corrected to be increased in accordance with the pressure of the low pressure fuel (=0.2 MPa) regulated by the low pressure regulator 28 to set a final fuel injection pulse width Ti for the injector 13 ($Ti \leftarrow Tp \times Kp \times KA/F \times KFS$).

Thus, when FHPNG=1, i.e., when the high-pressure fuel system is abnormal, the fuel injection pulse width Ti can be set to be an appropriate value so that the actual fuel injection quantity injected to the injector 13 is coincident with the required injection quantity which is set in accordance with the engine operating condition, in accordance with the pressure of the low pressure fuel regulated by the low pressure regulator 28 to be fed to the injector 13.

Thus, the fuel pressure fed to the injector 13 is compatible with the fuel injection pulse width Ti, and even if FHPNG=1, i.e., even if the high-pressure fuel system is abnormal, an appropriate quantity of fuel corresponding to a required injection quantity, which is measured in accordance with the fuel injection pulse width Ti and adapted to the uniform premixed combustion and which ensures a predetermined output in accordance with the engine operating condition, can be injected from the injector 13 of the corresponding cylinder.

Thereafter, at step S203, the reference to the high-pressure fuel system NG flag FHPNG is made again. When FHPNG=1, i.e., when the high-pressure fuel system is abnormal, the routine goes to step S205 wherein the fuel injection pulse width Ti is compared with an upper limit TiMAX which is preset to restrict the engine output.

That is, when the high-pressure fuel system is abnormal, the upper limitation of the fuel injection pulse width Ti is carried out by the upper limit TiMAX to restrict the engine output to inhibit the degree of abnormality of the high-pressure fuel system from increasing and to surely prevent the controllability of fuel injection from deteriorating due to the fail safe control, so that it is possible to prevent the combustion state of the engine 1 from deteriorating.

Then, at step S205, when $Ti \leqq TiMAX$, i.e., when the fuel injection pulse width Ti is not higher than the upper limit TiMAX, the routine jumps directly to step S81 without carrying out the upper limitation of the fuel injection pulse width Ti. On the other hand, when $Ti < TiMAX$, i.e., when the fuel injection pulse width Ti exceeds the upper limit TiMAX, the routine goes to step S206 wherein the upper limitation of the fuel injection pulse width Ti is carried out ($Ti \leftarrow TiNGMAX$), and the routine goes to step S81.

At step S81, the reference to a fuel injection starting angle table is made with the interpolation calculation on the basis of the engine operating condition based on the engine speed NE and the accelerator position ALPH, to set a fuel injection starting angle IJsa based on the compression top dead center of the corresponding cylinder. Subsequently, at step S82, a fuel injection starting timing IJST is set on the basis of the fuel injection starting angle IJsa, and the routine ends.

In this preferred embodiment, even if FHPNG=0, i.e., even if the high-pressure fuel system is normal, the abnormal period coefficient factor KFS as KFS=1.0 is incorporated into the operation expression of the fuel injection pulse width Ti while no correction are made by the abnormal period correction factor KFS. However, the present invention should not be limited thereto. When the high-pressure fuel system is normal, the setting of the abnormal period correction factor KFS may be omitted, and the abnormal period correction factor KFS may be omitted in the operation expression of the fuel injection pulse width Ti. That is, when at least the high-pressure fuel system is abnormal, the abnormal period correction factor KFS for correcting to increase the basic fuel injection pulse width Tp may be set in accordance with the pressure of the low pressure fuel regulated by the low pressure regulator 28, to correct the basic fuel injection pulse width Tp to set a final fuel injection pulse width.

Figure 25:
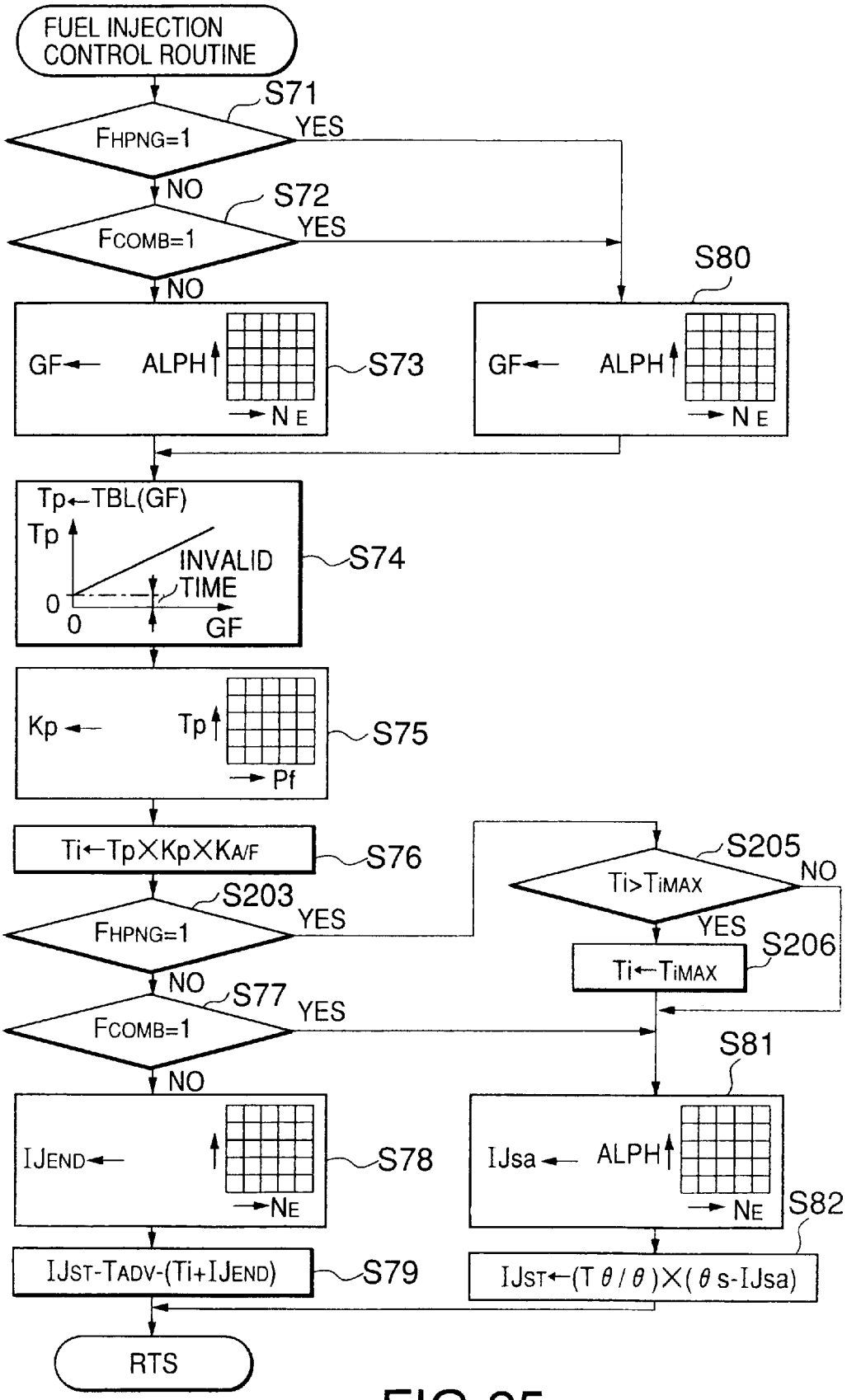
FIG. 25 is a flow chart of a fuel injection control routine in the third preferred embodiment of the present invention.

Referring to FIG. 25, the third preferred embodiment of the present invention will be described below.

In this preferred embodiment, the fuel pressure range covered by the fuel pressure correction factor table is extended to the pressure of the low pressure fuel range regulated by the low pressure regulator 28 without being limited to the practical fuel pressure range in the above described preferred embodiments.

When the high-pressure fuel system is abnormal, similar to when the high-pressure fuel system is normal and when the uniform premixed combustion is selected, a basic fuel injection quantity GF adapted to the uniform premixed combustion is set by a uniform premixed combustion period basic fuel injection quantity, and the basic fuel injection quantity GF is converted by the basic fuel injection pulse width table to a basic fuel injection pulse width Tp corresponding to a controlled fuel pressure PfB regulated by the high pressure regulator 27. Then, on the basis of an actual fuel pressure Pf of the high-pressure fuel system detected by the fuel pressure sensor 35, i.e., on the basis of the pressure of the fuel actually fed to the injector 13, a fuel pressure correction factor Kp is set by making reference to the fuel pressure correction factor table, and the basic fuel injection pulse width Tp is corrected by the fuel pressure correction factor Kp to set a final fuel injection pulse width Ti for the injector 13.

That is, the parameter range of fuel pressure in the fuel pressure correction factor table is extended to the pressure of the low pressure fuel range regulated by the low pressure regulator 28, so that the by-pass selector valve 29 is open by the by-pass selector valve control routine when the high-pressure fuel system is abnormal. Thus, even if the low pressure fuel regulated by the low pressure regulator 28 is fed to the injector 13, the basic fuel injection pulse width Tp, which has been set in accordance with the controlled fuel pressure PfB regulated by the high pressure regulator 27, can be compensated by the fuel pressure correction factor Kp in accordance with the actual fuel pressure fed to the injector 13, so that the fuel pressure fed to the injector is compatible with the fuel injection pulse width Ti.

Thus, the setting operations of the fuel injection pulse width Ti when the high-pressure fuel system is normal and abnormal can be quite commonly used, so that the control system can be more simplified in comparison with the second preferred embodiment.

Specifically, in this preferred embodiment, a fuel injection control routine shown in FIG. 25 is used in place of the fuel injection control routines in the above described preferred embodiments.

Furthermore, other routines are the same as those in the above described first preferred embodiment, so that the descriptions thereof are omitted. In addition, in the fuel injection control routine of FIG. 25, the same reference numbers are used for the same steps as those in the above described preferred embodiments, and the detailed descriptions thereof are omitted.

The fuel injection control routine of FIG. 25 will be described below.

Similar to the above described preferred embodiments, the fuel injection control routine of FIG. 25 is executed every a predetermined period of time (e.g., 10 msec) after the system initialization. First, at step S71, the reference to a high-pressure fuel system NG flag FHPNG is made. When FHPNG=0, i.e., when the high-pressure fuel system is normal, the routine goes to step S72 wherein the reference to a combustion system determining flag FCOMB is made.

When FCOMB=0, i.e., when the stratified combustion is selected, the routine goes to step S73 wherein the reference to a stratified combustion period basic fuel injection quantity table is made with the interpolation calculation on the basis of the engine operating condition based on the engine speed NE and the accelerator position ALPH, to set a basic fuel injection quantity GF corresponding to a required injection quantity which is adapted to the stratified combustion and which is used for obtaining a predetermined engine output.

After the basic fuel injection quantity GF is set, the routine goes to step S74 wherein the reference to a basic fuel injection pulse width table is made with the interpolation calculation on the basis of the basic fuel injection quantity GP, to set a basic fuel injection pulse width Tp for the injector 13, which is used for obtaining the basic fuel injection quantity GE, at a controlled fuel pressure PfB (=7 MPa) regulated by the high pressure regulator 27. Subsequently, at step S75, the reference to a fuel pressure correction factor table is made with the interpolation calculation on the basis of the fuel pressure Pf of the high-pressure fuel system detected by the fuel pressure sensor 35 and the basic fuel injection pulse width Tp, to set a fuel pressure correction factor Kp for compensating the basic fuel injection pulse width Tp, which has been set in accordance with the controlled fuel pressure PfB regulated by the high pressure regulator, in accordance with the actual fuel pressure fed to the injector 13.

In the fuel pressure correction factor table for use in this preferred embodiment, the covered fuel pressure range is extended to the pressure of the low pressure fuel range regulated by the low pressure regulator 28 without being limited to the practical fuel pressure range of the high-pressure fuel system.

That is, the fuel pressure correction factor table is set as follows. First, the basic fuel injection pulse width Tp, which has been set in accordance with the controlled fuel pressure PfB (=7 MPa) regulated by the high pressure regulator 27, is corrected every area defined by the fuel pressure Pf and the basic fuel injection pulse width Tp, and a coefficient suited to obtain the basis fuel injection quantity GF is previously derived by simulations or experiments. Then, this coefficient is used as a fuel pressure correction factor Kp, and the fuel pressure correction factor table is set as a table using the fuel pressure Pf and the basic fuel injection pulse width Tp as parameters. The fuel pressure correction factor table is stored in the ROM 52 at a series of addresses. The fuel pressure range serving as a parameter in the fuel pressure correction factor table does not only cover the practical fuel pressure range of the high-pressure fuel system including the rising process of the fuel pressure Pf during start-up, but it also covers the pressure of the low pressure fuel obtained by feeding the low pressure fuel to the injector 13 by means of the low pressure regulator 28, so that it is set to be in the range of, e.g., from 0.2 MPa to 9 MPa, in this preferred embodiment.

After the fuel pressure correction factor Kp is set, the routine goes to step S76 wherein the basic fuel injection pulse width Tp is multiplied by the fuel pressure correction factor Kp and an air-fuel ratio feedback correction factor KA/F to carry out the fuel pressure correction and the air-fuel ratio correction to set a final fuel injection pulse width Ti for the injector 13 ($Ti \leftarrow Tp \times Kp \times KA/F$).

Then, at step S203, the reference to the high-pressure fuel system NG flag FHPNG is made again. When FHPNG=0, i.e., when the high-pressure fuel system is normal, the routine goes to step S77 wherein the reference to the combustion system determining flag FCOMB is made.

When FCOMB=0, i.e., when the stratified combustion is selected, the routine goes to step S78 wherein the reference to a fuel injection end timing table is made with the interpolation calculation on the basis of the engine operating condition based on the engine speed NE and the accelerator position ALPH, to set a fuel injection end timing IJEND. Then, at step S79, an ignition timing RADV is read out by the ignition control routine, and a fuel injection starting timing IJST based on the crank pulse θ1 is set by the inverse operation of the fuel injection end timing IJEND and the fuel injection pulse width Ti from the ignition timing TADV. Then, the routine ends.

On the other hand, when FHPNG=1 at step S71, i.e., when the high-pressure fuel system is abnormal, or when FHPNG=0 at step S71, i.e., when the high-pressure fuel system is normal, and when FCOMB=1, i.e., when the uniform premixed combustion is selected, the routine goes from the corresponding step to step S80 wherein the reference to a uniform premixed combustion period basic fuel injection quantity table is made with the interpolation calculation on the basis of the engine operating condition based on the engine speed NE and the accelerator position ALPH, to set a basic fuel injection quantity GF which is adapted to the uniform premixed combustion and which is used for obtaining a predetermined output air-fuel ratio.

After the basic fuel injection quantity GF is set, the routine goes to step S74 wherein the reference to a basic fuel injection pulse width table is made with the interpolation calculation on the basis of the basic fuel injection quantity GF, to set a basic fuel injection pulse width Tp for the injector 13, which is used for obtaining the basic fuel injection quantity GF, at a controlled fuel pressure PfB regulated by the high pressure regulator 27. Then, at step S75, the reference to a fuel pressure correction factor table is made with the interpolation calculation on the basis of the fuel pressure Pf of the high-pressure fuel system detected by the fuel pressure sensor 35 and the basic fuel injection pulse width Tp, to set a fuel pressure correction factor Kp.

Then, step S76, the basic fuel injection pulse width Tp is multiplied by the fuel pressure correction factor Kp and the air-fuel ratio feedback correction factor KA/F to carry out the fuel pressure correction and the air-fuel ratio correction to set a final fuel injection pulse width Ti for the injector 13.

Then, at step S203, the reference to the high-pressure fuel system NG flag FHPNG is made again. When FHPNG=0, i.e., when the high-pressure fuel system is normal, the reference to a combustion system determining flag FCOMB is made at step S77. When FCOMB=1, i.e., when the uniform premixed combustion is selected, the routine goes from step S77 to step S81.

On the other hand, at step S203, when FHPNG=1, i.e., when the high-pressure fuel system is abnormal, the routine goes to step S205 wherein the fuel injection pulse width Ti is compared with an upper limit TiMAX which has been previously set to restrict the engine output.

When Ti≦TiMAX, i.e., when the fuel injection pulse width Ti is not greater than the upper limit TiMAX, the upper limitation of the fuel injection pulse width Ti is not carried out, and the routine jumps directly to step S81. On the other hand, when Ti>TiMAX, i.e., when the fuel injection pulse width Ti exceeds the upper limit TiMAX, the upper limitation of the fuel injection pulse width Ti is carried out by the upper limit TiMAX at step S206 (Ti←TiMAX), and the routine goes to step S81.

At step S81, the reference to a fuel injection starting angle table is made with the interpolation calculation on the basis of the engine operating condition based on the engine speed NE and the accelerator position ALPH, to set a fuel injection starting angle IJsa based on the compression top dead center of the corresponding cylinder. Subsequently, at step S82, a fuel injection starting timing IJST is set on the basis of the fuel injection starting angle IJsa, and the routine ends.

As described above, in the fuel pressure correction factor table, the covered fuel pressure range is not limited to the practical fuel pressure range of the high-pressure fuel system including the rising process of the fuel pressure Pf during start-up, so that it is extended to the pressure of the low pressure fuel range obtained by feeding the low pressure fuel to the injector 13 by means of the low pressure regulator 28 when the high-pressure fuel system is abnormal. In this pressure correction factor table, the fuel pressure correction factor Kp, which is suited to obtain the basis fuel injection quantity GF by correcting the basic fuel injection pulse width Tp set in accordance with the controlled fuel pressure PfB (=7 MPa) regulated by the high pressure regulator 27, is stored every area defined by the fuel pressure Pf and the basic fuel injection pulse width Tp.

Therefore, the reference to the fuel pressure correction factor table is made on the basis of the fuel pressure Pf of the high-pressure fuel system detected by the fuel pressure sensor 35, i.e., the actual fuel pressure fed to the injector, and on the basis of the basic fuel injection pulse width Tp, to set the fuel pressure correction factor Kp, and the basic fuel injection pulse width Tp, which has been set in accordance with the controlled fuel pressure PfB regulated by the high pressure regulator 27, is corrected by the pressure correction factor Kp to set the final fuel injection pulse width Ti defining the injection-valve opening period of the injector 13. Thus, it is possible to compensate the variation in actual fuel injection quantity with respect to the required fuel injection quantity due to the difference between fuel pressures fed to the injector 13. Therefore, when a high-pressure fuel system receiving a high pressure fuel is normal, or even if a high-pressure fuel system receiving a low pressure fuel is abnormal, the fuel injection pulse width Ti can be set to be an appropriate value so that the actual fuel injection quantity injected from the injector 13 is coincident with the required injection quantity.

As a result, in either case where the high-pressure fuel system is normal or abnormal, the same setting of the fuel injection pulse width Ti can be used, so that the control system can be simplified. In addition, when a high-pressure fuel system receiving a high pressure fuel is normal, or even if a high-pressure fuel system receiving a low pressure fuel is abnormal, the fuel pressure fed to the injector 13 can be compatible with the fuel injection pulse width Ti, so that an appropriate quantity of fuel corresponding to the required fuel injection quantity can be injected.

Figure 26:
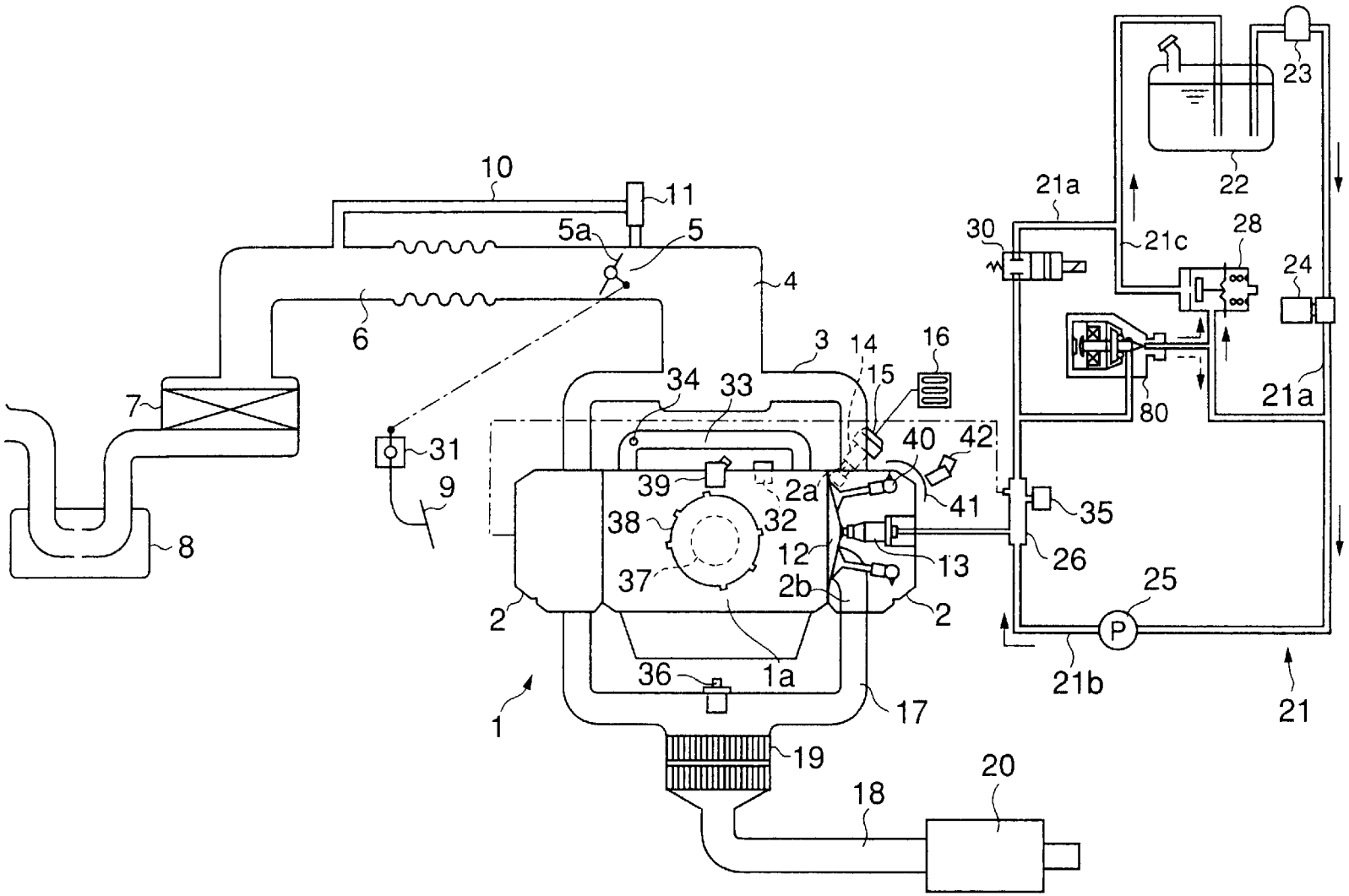
FIG. 26 is a general schematic view of an in-cylinder fuel injection engine in the fourth preferred embodiment of the present invention.
Figure 27:
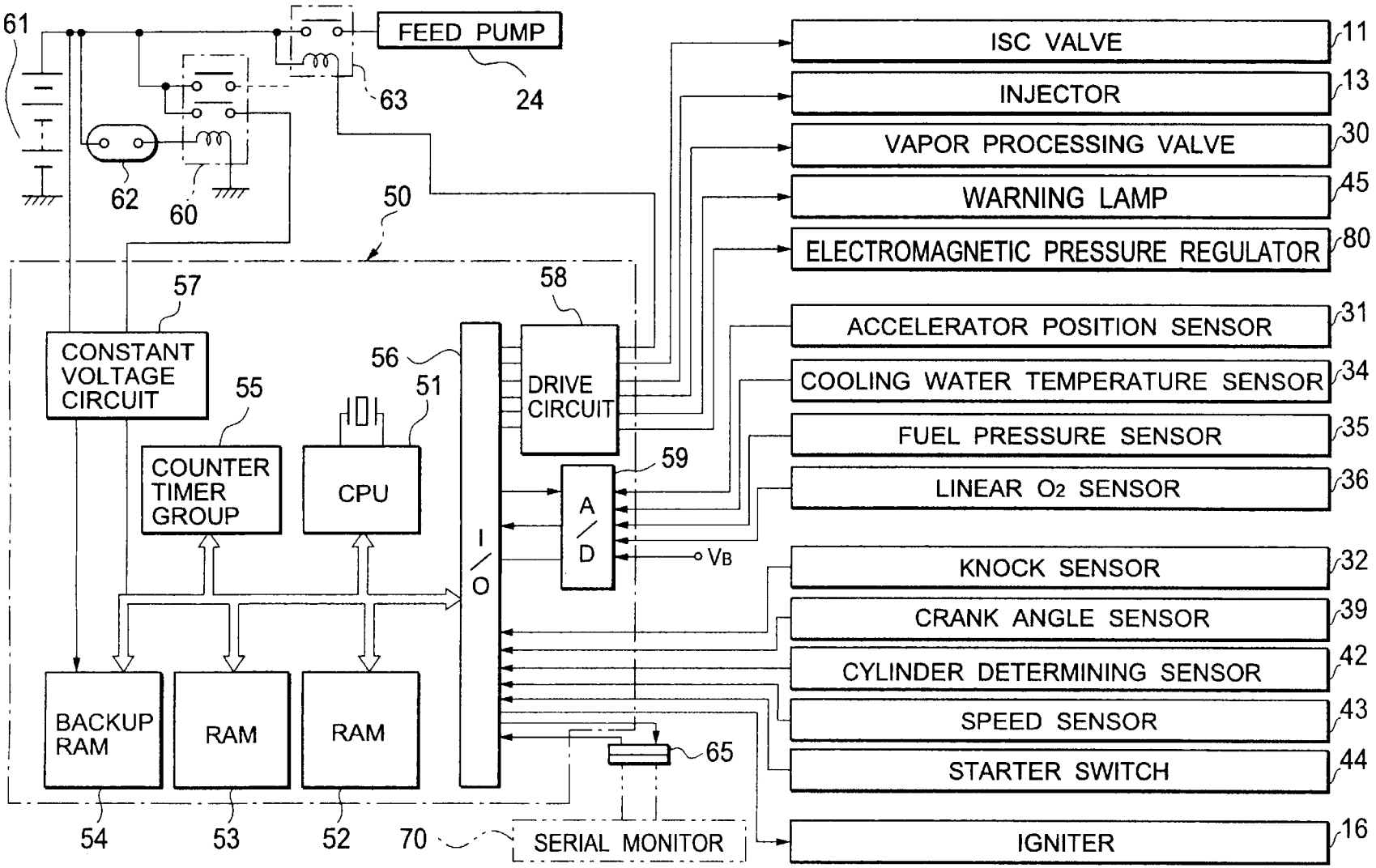
FIG. 27 is a circuit diagram of an electronic control system in the fourth preferred embodiment of the present invention.
Figure 28:
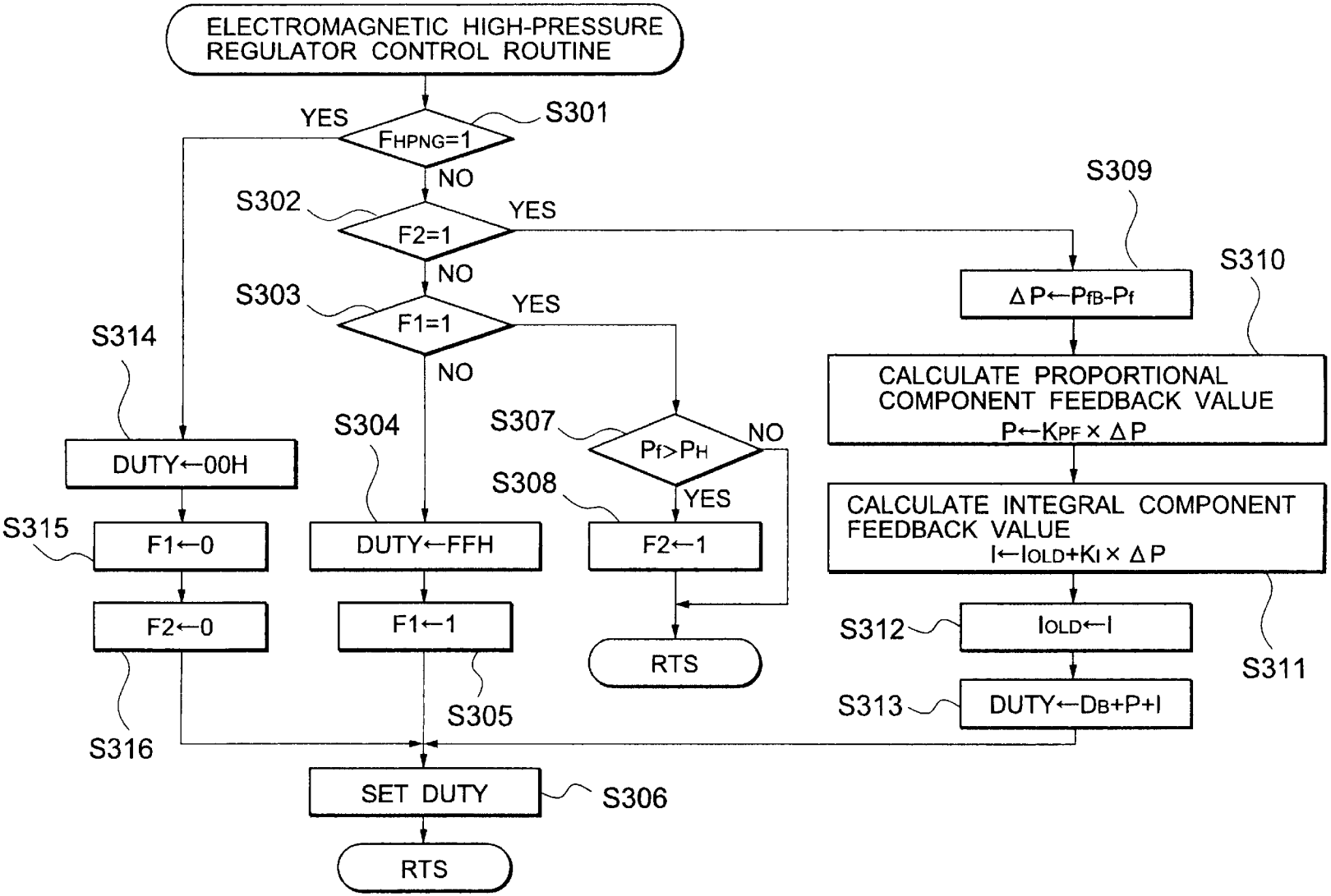
FIG. 28 is a flow chart of an electromagnetic high-pressure regulator control routine in the fourth preferred embodiment of the present invention.

Referring to FIGS. 26 through 28, the fourth preferred embodiment of the present invention will be described below.

In this preferred embodiment, an electromagnetic high-pressure regulator 80, which can be controlled by an ECU 50, is used as a high pressure regulator to dispense with the fuel by-pass passage 21*d* and the by-pass selector valve 29 provided in the above described preferred embodiments.

Furthermore, the same reference numbers are used for the same elements as those in the above described preferred embodiments, and the descriptions thereof are omitted.

The electromagnetic high-pressure regulator 80 in this preferred embodiment is a normally open type, and the valve position thereof is controlled in accordance with the duty ratio DUTY of a drive signal outputted from the ECU 50. When the duty ratio DUTY of the drive signal outputted from the ECU 50 is 00H (0%), the regulator 80 is fully open, and the valve position thereof decreases as the duty ratio DUTY increases. When the duty ratio DUTY is FFH (100%), the regulator 80 is fully closed.

As shown in FIG. 26, the downstream side of the electromagnetic high-pressure regulator 80 is connected to a fuel return passage between a low-pressure fuel passage 21*a* downstream of a feed pump 24 and the upstream of a low pressure regulator 28, as a low-pressure fuel system.

In addition, as shown in FIG. 27, the electromagnetic high-pressure regulator 80 is connected to the output port of the I/O interface 56 of the ECU 50 via a drive circuit 58.

The ECU 50 executes an electromagnetic high-pressure regulator control routine shown in FIG. 28. When FHPNG=

0, i.e., when the high-pressure fuel system is normal, a duty ratio DUTY of a drive signal to the electromagnetic high-pressure regulator 80 is set in accordance with the compared results of a predetermined target controlled fuel pressure PfB (e.g., PfB=7 MPa in this preferred embodiment) with a fuel pressure Pf of the high-pressure fuel system detected by a fuel pressure sensor 35, and the feedback control for the electromagnetic high-pressure regulator 80 is carried out so that the fuel pressure Pf of the high-pressure fuel system converges at the controlled fuel pressure PfB. On the other hand, when FHPNG=1, i.e., when the high-pressure fuel system is abnormal, a controlled variable for fully opening the electromagnetic high-pressure regulator 80 is set, i.e., the duty ratio DUTY of the drive signal to the electromagnetic high-pressure regulator 80 is set to be DUTY=00H. Thus, the electromagnetic high-pressure regulator 80 is fully open to establish the communication between the high-pressure fuel system and the low-pressure fuel system, so that a low pressure fuel fed to the feed pump 24 to be regulated to a predetermined fuel pressure by the low pressure regulator 28 is fed directly to the high-pressure fuel system to be fed to the injector 13.

That is, in this preferred embodiment, the ECU 50 also has a function as high-pressure regulator control means according to the present invention.

Furthermore, other routines in the above described preferred embodiments are suitably adopted, and the descriptions thereof are omitted. In addition, in this preferred embodiment, the by-pass selector valve 29 is not provided, so that the by-pass selector valve control routine of FIG. 5 in the above described first preferred embodiment is not required.

The electromagnetic high-pressure regulator control routine of FIG. 28 will be described below.

The high-pressure regulator control routine shown in FIG. 28 is executed every a predetermined period of time (e.g., 10 msec) after the system initialization. First, at step S301, the reference to a high-pressure fuel system NG flag FHPNG is made. When FHPNG=0, i.e., when the high-pressure fuel system is normal, the routine goes to step S302.

At step S302, the reference to a usual control transition flag F2 indicating the transition to a usual control (feedback control) is made. This usual control transition flag F2 is set when the fuel pressure Pf of the high-pressure fuel system reaches a predetermined fuel pressure after the engine is started, so that the initial value thereof is F2=0.

When F2=0, the routine goes to step S303 wherein the reference to an initialization completion flag 1, which is set when the initialization of the duty ratio DUTY to the electromagnetic high-pressure regulator 80 is completed, is made. When F1=0, i.e., if this routine is executed first time when the high-pressure fuel system is normal, the routine goes to step S304 wherein the duty ratio DUTY is set to be "FFH" for fully closing the electromagnetic high-pressure regulator 80 (DUTY←FFH). Subsequently, at step S304, the initialization completion flag F1 is set by the completion of the initialization (F1←1). Then, at step S306, the duty ratio DUTY set at step S304 is set, and the routine ends.

As a result, a drive signal based on the duty ratio DUTY=FFH is outputted to the electromagnetic high-pressure regulator 80, so that the electromagnetic high-pressure regulator 80 is fully closed to prevent the fuel from leaking from the electromagnetic high-pressure regulator 80.

After the initialization F1=1 is completed, the routine goes from step S303 to S307 wherein the fuel pressure Pf of the high-pressure fuel system detected by the fuel pressure sensor 35 is compared with a preset pressure PH.

The preset pressure PH determines whether the fuel pressure Pf of the high-pressure fuel system, i.e., the pressure of the fuel fed to the injector 13, substantially reaches the target controlled fuel pressure PfB. In this preferred embodiment, the preset pressure PH is set so that PH=6~7 MPa.

When Pf≦PH, i.e., when the fuel pressure Pf of the high-pressure fuel system does not yet reach the target controlled fuel pressure, the routine ends directly. When Pf>PH, i.e., when the fuel pressure Pf of the high-pressure fuel system substantially reaches the target controlled fuel pressure, the routine goes to step S308 wherein the usual control transition flag F2 indicative of the transition to the usual control (feedback control) is set (F2←1), and the routine ends.

That is, after the driving of the high pressure pump 25 is started by the engine start-up, until the fuel pressure Pf of the high-pressure fuel system reaches the predetermined fuel pressure, the electromagnetic high-pressure regulator 80 is fully closed to carry out the open loop control of the electromagnetic high-pressure regulator 80, so that the fuel is prevented from leaking from the electromagnetic high-pressure regulator to early raise the fuel pressure Pf of the high-pressure fuel system to the target controlled fuel pressure PfB.

Thereafter, the routine goes from step S302 to S309 since the usual control transition flag F2 is set. At steps 309 through 313, a duty ratio DUTY of a drive signal to the electromagnetic high-pressure regulator 80 is set in accordance with the compared results of the target controlled fuel pressure PfB (=7 MPa) with the fuel pressure Pf of the high-pressure fuel system detected by the fuel pressure sensor 35, and the feedback control of the electromagnetic high-pressure regulator 80 is carried out so that the fuel pressure Pf of the high-pressure fuel system converges at the controlled fuel pressure PfB.

That is, at step S309, the fuel pressure Pf of the high-pressure fuel system detected by the fuel pressure sensor 35 is subtracted from the preset target controlled fuel pressure PfB to derive a difference ΔP between the controlled fuel pressure PfB and the fuel pressure Pf (ΔP←PfB−Pf). Subsequently, at step S310, a proportional constant KPF of a proportional integral control (PI control) is multiplied by the difference ΔP to derive a proportional component feedback value (P←KPF×ΔP). Moreover, at step S311, the last integral component feedback value IOLD is added to a value obtained by multiplying an integral constant KI of the proportional integral control by the difference ΔP, to derive a new integral component feedback value I (I←IOLD+KI×ΔP).

Then, at step S312, the last integral component feedback value IOLD is updated by the currently derived integral component feedback value I to be ready for the next routine. Subsequently, at step S313, the proportional component feedback value P and the integral component feedback value I are added to a basic duty ratio DB which is preset in accordance with the controlled fuel pressure PfB, to derive a duty ratio DUTY defining the controlled variable for the electromagnetic high-pressure regulator 80 (DUTY←DB+P+I).

Then, the routine goes to step S306 wherein the duty ratio DUTY calculated at step S313 is set, and the routine ends.

As a result, a drive signal based on the duty ratio DUTY is outputted from the ECU 50 to the electromagnetic high-pressure regulator 80, and the valve position of the electromagnetic high-pressure regulator 80 is controlled in accordance with the duty ratio DUTY to carry out the feedback control so that the fuel pressure Pf of the high-pressure fuel system converges at the controlled fuel pressure PfB.

Therefore, when FHPNG=0, i.e., when the high-pressure fuel system is normal, a high pressure fuel pressurized by the high pressure pump 25 to be regulated to a predetermined controlled fuel pressure by the electromagnetic high-pressure regulator 80 is fed to the injector 13.

On the other hand, at step S301, when FHPNG=1, i.e., when the high-pressure fuel system is abnormal, the routine goes to step S314 wherein the duty ratio DUTY defining the controlled variable for the electromagnetic high-pressure regulator 80 is set to be "00H" for fully opening the electromagnetic high-pressure regulator 80 (DUTY←00H). Then, at steps S315 and S316, the initialization completion flag F1 and the usual control transition flag F2 are cleared, respectively (F1←0, F2←0). Then, the routine goes to step S306 wherein the duty ratio DUTY (=00H) set at step S314 is set, and the routine ends.

As a result, the drive signal based on the duty ratio DUTY=00H is outputted to the electromagnetic high-pressure regulator 80 to fully open the electromagnetic high-pressure regulator 80.

Thus, when the high-pressure fuel system is abnormal, the electromagnetic high-pressure regulator 80 is fully open to establish the communication between the high-pressure fuel system and the low-pressure fuel system, so that the low pressure fuel fed by the feed pump 24 to be regulated to a predetermined fuel pressure by the low pressure regulator 28 can be fed directly to the high-pressure fuel system to be fed to the injector independent of the high pressure fuel similar to the above described first preferred embodiment.

Therefore, the electromagnetic regulator 80 can have the same function as that of the by-pass selector valve 29 in the above described first preferred embodiment, and it is possible to dispense with the by-pass selector valve 29 and the fuel by-pass passage 21*d,* so that it is possible to reduce the number of parts of the fuel feed system to simplify the construction of the fuel feed system.

Furthermore, the present invention should not be limited to the above described preferred embodiments. For example, while the accelerator position ALPH has been used as an example of engine load in the above described preferred embodiments, a throttle position, an intake air quantity, an intake pipe pressure downstream of a throttle valve, or an intake air quantity per one intake stroke may be adopted in place of the accelerator position ALPH.

In addition, while the ignition timing and the fuel injection timing have been controlled by the time control system in the above described preferred embodiments, the present invention should not be limited thereto, but the angular control system may be adopted to control the ignition timing and fuel injection timing by angle.

While the presently preferred embodiments of the present invention have been shown and described, it is to be understood that this disclosures are for the purpose of illustration and that various changes and modification may be made without departing from the scope of the invention as set forth in the appended claims.

What is claimed is:

1. A system for controlling an in-cylinder fuel injection engine, wherein a low pressure fuel fed from a low pressure pump is regulated to a predetermined fuel pressure by a low pressure regulator to be fed to a high pressure pump, the pressure of said fuel being raised by said high pressure pump and regulated to a predetermined controlled fuel pressure by a high pressure regulator to feed a high pressure fuel to an injector, and wherein a fuel injection quantity is set on the basis of an engine operating condition, said fuel injection quantity of said fuel being injected directly into a cylinder by the injector, said control system comprising:

opening/closing valve means provided in a fuel by-pass passage provided for by passing said high pressure regulator to establish a communication between a high-pressure fuel system and a low-pressure fuel system;

diagnosing means for monitoring at least one of the behavior of a fuel pressure of said high-pressure fuel system and the relationship between an air-fuel ratio and a fuel injection pulse width for the injector, said diagnosing means determining that said high-pressure fuel system is abnormal when meeting at least one of conditions that said behavior of the fuel pressure is abnormal and that said air-fuel ratio is incompatible with said fuel injection pulse width;

opening/closing valve control means for closing said opening/closing valve means when said high-pressure fuel system is normal and for opening said opening/closing valve means when said high-pressure fuel system is abnormal;

fuel injection control means for setting a fuel injection pulse width defining a fuel injection quantity for the injector on the basis of the engine operating condition in accordance with the controlled fuel pressure regulated by said high pressure regulator when said high-pressure fuel system is normal, said fuel injection control means setting the fuel injection pulse width on the basis of the engine operating condition in accordance with the pressure of a low pressure fuel regulated by said low pressure regulator when said high-pressure fuel system is abnormal;

a fuel pressure correction factor table which uses a fuel pressure in a practical use range of said high-pressure fuel system as a parameter for storing therein a fuel pressure correction factor for correcting the variation in fuel injection quantity based on said fuel pressure; and an abnormal period fuel pulse width table which uses an engine speed and an engine load as parameters for storing therein a fuel injection pulse width suited to obtain a required fuel injection quantity at the pressure of a low pressure fuel regulated by said low pressure regulator, wherein when said high-pressure fuel system is normal, said fuel injection control means sets a basic fuel injection quantity on the basis of the engine operating condition to set a basic fuel injection pulse width, which is used for obtaining said basic fuel injection quantity at a predetermined controlled fuel pressure regulated by said high-pressure regulator or said electromagnetic high-pressure regulator and which defines a basic valve opening period for said injector, on the basis of said basic fuel injection quantity, and said fuel injection control means makes reference to said fuel pressure correction factor table on the basis of the fuel pressure of said high-pressure fuel system to set a fuel pressure correction factor to correct said basic fuel injection pulse width by said fuel pressure correction factor to set a final fuel injection pulse width for the injector, and wherein when said high-pressure fuel system is abnormal, said fuel injection control means makes reference to said abnormal period fuel injection pulse width table on the basis of the engine speed and the engine load to set a final fuel injection pulse width for the injector.

2. A system for controlling an in-cylinder fuel injection engine, wherein a low pressure fuel fed from a low pressure pump is regulated to a predetermined fuel pressure by a low pressure regulator to be fed to a high pressure pump, the pressure of said fuel being raised by said high pressure pump and regulated to a predetermined controlled fuel pressure by a high pressure regulator to feed a high pressure fuel to an injector, and wherein during low engine speeds with low loads, a stratified combustion based on a late injection is selected to set a fuel injection quantity, a fuel injection timing and an ignition timing, which are adapted to the stratified combustion, on the basis of the engine operating condition, and during high engine speeds with high loads, a uniform premixed combustion based on an early injection is selected to set a fuel injection quantity, a fuel injection timing and an ignition timing, which are adapted to the uniform premixed combustion, on the basis of the engine operating condition, said injection quantity of fuel being injected directly into a cylinder by the injector to ignite the injected fuel by a spark plug at said ignition timing to achieve the stratified combustion or the uniform premixed combustion, said system control comprising:

opening/closing valve means provided in a fuel by-pass passage provided for by-passing said high pressure regulator to establish a communication between a high-pressure fuel system and a low-pressure fuel system;

diagnosing means for monitoring at least one of the behavior of a fuel pressure of said high-pressure fuel system and the relationship between an air-fuel ratio and a fuel injection pulse width for the injector, said diagnosing means determining that said high-pressure fuel system is abnormal when meeting at least one of conditions that said behavior of the fuel pressure is abnormal and that said air-fuel ratio is incompatible with said fuel injection pulse width;

opening/closing valve control means for closing said opening/closing valve means when said high-pressure fuel system is normal and for opening said opening/closing valve means when said high-pressure fuel system is abnormal; and combustion system selecting means for selecting the stratified combustion based on the late injection during low engine speeds with low loads, and the uniform premixed combustion based on the early injection during high engine speeds with high loads, on the basis of the engine operating condition;

fuel injection control means for setting a fuel injection pulse width for the injector, which defines a fuel injection quantity adapted to the stratified combustion, on the basis of the engine operating condition in accordance with the controlled fuel pressure regulated by said high pressure regulator and for setting a fuel injection timing in a compression stroke of a cylinder to be injected when said high-pressure fuel system is normal and when the stratified combustion is selected, said fuel injection control means setting a fuel injection pulse width for the injector, which is adapted to the uniform premixed combustion, on the basis of the engine operating condition in accordance with the controlled fuel pressure regulated by said high pressure regulator and setting a fuel injection timing in an exhaust stroke end or intake stroke of a cylinder to be injected when said high pressure fuel system is normal and when the uniform premixed combustion is selected, and said fuel injection control means setting a fuel injection pulse width adapted to the uniform premixed combustion on the basis of said engine operating condition in accordance with the pressure of a low pressure fuel regulated by said low pressure regulator and setting a fuel injection timing adapted to the uniform premixed combustion when said high-pressure fuel system is abnormal; and ignition timing control means for setting an ignition timing adapted to the stratified combustion on the basis of the engine operating condition when said high-pressure fuel system is normal and when the stratified combustion is selected, and for setting an ignition timing adapted to the uniform premixed combustion on the basis of the engine operating condition when said high-pressure fuel system is normal and when the uniform premixed combustion is selected or when said high-pressure fuel system is abnormal.

3. A system for controlling an in-cylinder fuel injection engine as set forth in claim 2, which further comprises:

a fuel pressure correction factor table which uses a fuel pressure in a practical use range of said high-pressure fuel system as a parameter for storing therein a fuel pressure correction factor for correcting the variation in fuel injection quantity based on said fuel pressure; and an abnormal period fuel pulse width table which uses an engine speed and an engine load as parameters for storing therein a fuel injection pulse width suited to obtain a required fuel injection quantity adapted to the uniform premixed combustion at the pressure of a low pressure fuel regulated by said low pressure regulator;

said fuel injection control means setting a basic fuel injection quantity adapted to the stratified combustion on the basis of the engine operating condition when said high-pressure fuel system is normal and when the stratified combustion is selected and setting a basic fuel injection quantity adapted to the uniform premixed combustion on the basis of the engine operating condition when said high-pressure fuel system is normal and when the uniform premixed combustion is selected, said fuel injection control means setting a basic fuel injection pulse width, which is used for obtaining said basic fuel injection quantity at a predetermined controlled fuel pressure regulated by said high-pressure regulator or said electromagnetic high-pressure regulator and which defines a basic valve opening period for the injector, on the basis of said basic fuel injection quantity, and said fuel injection control means making reference to said fuel pressure correction factor table on the basis of the fuel pressure of said high-pressure fuel system to set a fuel pressure correction factor to correct said basic fuel injection pulse width by said fuel pressure correction factor to set a final fuel injection pulse width for the injector, and said fuel injection control means making reference to said abnormal period fuel injection pulse width table on the basis of the engine speed and the engine load to set a final fuel injection pulse width for the injector when said high-pressure fuel system is abnormal.

4. A system for controlling an in-cylinder fuel injection engine as set forth in claim 2, which further comprises:

a fuel pressure correction factor table which uses a fuel pressure in a practical use range of said high-pressure fuel system as a parameter for storing therein a fuel pressure correction factor for correcting the variation in fuel injection quantity based on said fuel pressure, said fuel injection control means setting a basic fuel injection quantity adapted to the stratified combustion on the basis of the engine operating condition when said high-pressure fuel system is normal and when the stratified combustion is selected and setting a basic fuel injection quantity adapted to the uniform premixed combustion on the basis of the engine operating condition when said high-pressure fuel system is normal and when the uniform premixed combustion is selected or when said high-pressure fuel system is abnormal, said fuel injection control means setting a basic fuel injection pulse width, which is used for obtaining said basic fuel injection quantity at a predetermined controlled fuel pressure regulated by said high-pressure regulator or said electromagnetic high-pressure regulator and which defines a basic valve opening period for the injector, on the basis of said basic fuel injection quantity, said fuel injection control means making reference to said fuel pressure correction factor table on the basis of the fuel pressure of said high-pressure fuel system to set a fuel pressure correction factor, said fuel injection control means setting an abnormal period correction factor for correcting to increase said basic fuel injection pulse width in accordance with the pressure of a low pressure fuel regulated by said low pressure regulator when at least said high-pressure fuel system is abnormal, and said fuel injection control means correcting said basic fuel injection pulse width by said fuel pressure correction factor and said abnormal period correction factor to set a final fuel injection pulse width for the injector.

5. A system for controlling an in-cylinder fuel injection engine as set forth in claim 2, which further comprises:

a fuel pressure correction factor table which uses the pressure of a low pressure fuel related by said low pressure regulator and a fuel pressure in a practical use range of said high-pressure fuel system as parameters for storing therein a fuel pressure correction factor for correcting the variation in fuel injection quantity based on said fuel pressure, said fuel injection control means setting a basic fuel injection quantity adapted to the stratified combustion on the basis of the engine operating condition when said high-pressure fuel system is normal and when the stratified combustion is selected and setting a basic fuel injection quantity adapted to the uniform premixed combustion on the basis of the engine operating condition when said high-pressure fuel system is normal and when the uniform premixed combustion is selected or when said high-pressure fuel system is abnormal, said fuel injection control means setting a basic fuel injection pulse width, which is used for obtaining said basic fuel injection quantity at a predetermined controlled fuel pressure regulated by said high-pressure regulator or said electromagnetic high-pressure regulator and which defines a basic valve opening period for the injector, on the basis of said basic fuel injection quantity, and said fuel injection control means making reference to said fuel pressure correction factor table on the basis of the fuel pressure of said high-pressure fuel system to set a fuel pressure correction factor to correct said basic fuel injection pulse width by said fuel pressure correction factor to set a final fuel injection pulse width for the injector.

6. A system for controlling an in-cylinder fuel injection engine as set forth in claim 2, wherein said fuel injection control means carries out an upper limitation of the fuel injection pulse width which is set when said high-pressure fuel system is abnormal.

7. A system for controlling an in-cylinder fuel injection engine as set forth in claim 2, wherein said diagnosing means determines that said high-pressure fuel system is abnormal, when meeting at least one of conditions that the fuel pressure of said high-pressure fuel system does not reach a predetermined pressure even if a predetermined period of time elapses after the engine start-up, that the fuel pressure of said high-pressure fuel system is not within an ordinary fuel pressure range after the engine start-up, and that the fuel injection pulse width continues to exceed a predetermined value for a predetermined period of time at a lean air-fuel ratio.

8. A system for controlling an in-cylinder fuel injection engine having a high pressure fuel system including a high pressure pump provided to supply a regulated high pressure fuel to an injector, a low pressure fuel system including a low pressure pump provided to feed a regulated low pressure fuel to said high pressure pump and a control unit including diagnosing means for determining whether said high pressure fuel system is normal or abnormal and pressure reducing means for reducing the pressure of said high pressure fuel when said high pressure fuel system is abnormal, said control unit comprising:

combustion control means for controlling a combustion state of said engine between a stratified combustion and a uniform premixed combination in accordance with engine operating conditions when said high pressure fuel system is normal, and for fixing the combustion state to said uniform premixed combustion when said high pressure fuel system is abnormal.

9. The system according to claim 8, further comprising a valve provided in a passage by passing said high pressure fuel system and being opened by said pressure reducing means to reduce the pressure in said high pressure fuel system when said high pressure fuel system is abnormal.

10. The system according to claim 8, further comprising an electromagnetic high pressure regulator provided to variably set the pressure of said high pressure fuel and lower the pressure in said high pressure fuel system when said high pressure fuel system is abnormal.

11. The system according to claim 8, wherein said control unit further comprises fuel injection control means for setting, when said high pressure fuel system is abnormal, a fuel injection pulse width longer than that at a normal state of said high pressure fuel system.

12. The system according to claim 11, wherein said fuel injection control means is adapted to apply an upper limit to the fuel injection pulse width when said high pressure fuel system is abnormal.

13. The system according to claim 8, wherein said diagnosing means is adapted to determine an abnormality of said high pressure fuel system when the pressure in said high pressure fuel system does not reach a predetermined level even if a predetermined period of time elapses after the engine start-up.

14. The system according to claim 8, wherein said diagnosing means is adapted to determine an abnormality of said high pressure fuel system when the pressure in said high pressure fuel system exceeds a predetermined level.

15. The system according to claim 8, wherein said diagnosing means is adapted to determine an abnormality of said high pressure fuel system when the fuel injection pulse width continues to exceed a predetermined value for a predetermined period of time under an engine operation at a lean air-fuel ratio.

* * * * *